US010435227B2

(12) United States Patent
Erickson et al.

(10) Patent No.: US 10,435,227 B2
(45) Date of Patent: Oct. 8, 2019

(54) TRIGGER OPERATED AEROSOL DISPENSER

(71) Applicant: Aptar Group Inc., Cary, IL (US)

(72) Inventors: Gregory A. Erickson, Wheaton, IL (US); Geraid J. Marquardt, Elgin, IL (US); Sean Cho, Elgin, IL (US); Bernd Blumenstein, Waltrop (DE); Bernhard Jasper, Waltrop (DE); Paul Hallman, Lakewood, IL (US)

(73) Assignee: AptarGroup, Inc, Cary, IL (US)

( * ) Notice: Subject to any disclaimer, the term of this patent is extended or adjusted under 35 U.S.C. 154(b) by 0 days.

(21) Appl. No.: 13/868,900

(22) Filed: Apr. 23, 2013

(65) Prior Publication Data

US 2013/0277397 A1 Oct. 24, 2013

Related U.S. Application Data

(60) Provisional application No. 61/637,734, filed on Apr. 24, 2012.

(51) Int. Cl.

| | |
|---|---|
| ***B65D 83/22*** | (2006.01) |
| ***B65D 83/20*** | (2006.01) |
| *B65D 83/14* | (2006.01) |

(52) U.S. Cl.

CPC ..... *B65D 83/22* (2013.01); *B65D 83/205* (2013.01); *B65D 83/206* (2013.01); *B65D 83/753* (2013.01)

(58) Field of Classification Search

CPC ..... B67B 1/00; B65D 83/00; B65D 47/241; B65D 47/248–249; B65D 47/266; B65D 83/22; B65D 83/205–206; B65D 83/753; B67D 1/00

USPC ..... 222/153.04, 153.11, 153.14, 402.1, 222/402.11, 402.13, 402.15, 321.8

See application file for complete search history.

(56) References Cited

U.S. PATENT DOCUMENTS

| | | | | |
|---|---|---|---|---|
| 2,678,147 | A | 5/1954 | Abplanalp | |
| 3,149,757 | A * | 9/1964 | Safianoff | 222/153.11 |
| 3,156,382 | A * | 11/1964 | Michell | 222/182 |

(Continued)

FOREIGN PATENT DOCUMENTS

| | | |
|---|---|---|
| EP | 119084 | 9/1985 |
| EP | 409497 | 1/1991 |

(Continued)

*Primary Examiner* — Nicholas J Weiss
*Assistant Examiner* — Andrew P Bainbridge
(74) *Attorney, Agent, or Firm* — Frijouf, Rust & Pyle P.A.

(57) ABSTRACT

A trigger operated aerosol dispenser is disclosed for dispensing an aerosol product from an aerosol container through an aerosol valve. The trigger operated aerosol dispenser comprises a base secured to the aerosol container with a dispensing head mounted to the base. A nozzle extends through the dispensing head for communicating the aerosol valve with a terminal orifice. A trigger actuator extends from the dispensing head for actuating the aerosol valve upon depression of the trigger actuator to dispense the aerosol product from the terminal orifice. The trigger operated aerosol dispenser may incorporate a lock for inhibiting the trigger from actuating the aerosol valve. In one example, the trigger operated aerosol dispenser may be actuated in an alternate manner upon a depression of the dispensing head. Preferably, the trigger operated aerosol dispenser is formed from a two piece unit.

11 Claims, 55 Drawing Sheets

(56) References Cited

U.S. PATENT DOCUMENTS

| | | | | |
|---|---|---|---|---|
| 3,185,350 | A | 5/1965 | Abplanalp et al. | |
| 3,325,054 | A | 6/1967 | Braun | |
| 3,426,948 | A | 2/1969 | Stirling | |
| 3,484,023 | A | 12/1969 | Meshberg | |
| 3,580,432 | A * | 5/1971 | Brooks | B65D 83/202 222/402.13 |
| 3,591,128 | A | 7/1971 | Ramis | |
| 3,601,290 | A * | 8/1971 | Nigro | 222/402.11 |
| 3,721,423 | A * | 3/1973 | Shay | B65D 83/205 222/402.11 |
| 3,744,682 | A | 7/1973 | Blank | |
| 3,768,707 | A * | 10/1973 | Nigro | 222/402.13 |
| 3,797,705 | A | 3/1974 | Cooprider | |
| 3,848,778 | A | 11/1974 | Meshberg | |
| 3,860,149 | A | 1/1975 | Hagianis | |
| 3,933,283 | A * | 1/1976 | Hoagland | B65D 83/205 222/402.13 |
| 3,967,760 | A | 7/1976 | Marcon | |
| 4,024,988 | A | 5/1977 | Starrett | |
| 4,324,351 | A | 4/1982 | Meshberg | |
| 4,354,621 | A | 10/1982 | Knickerbocker | |
| 4,418,842 | A | 12/1983 | DiLoreto | |
| 4,542,837 | A | 9/1985 | Raynor | |
| 4,566,611 | A * | 1/1986 | Sukopp | B05B 11/3059 222/153.13 |
| 4,773,567 | A | 9/1988 | Stoody | |
| 5,388,730 | A | 2/1995 | Abbott et al. | |
| 5,549,226 | A * | 8/1996 | Kopp | 222/402.13 |
| 5,549,228 | A * | 8/1996 | Brown | 222/570 |
| 5,649,645 | A | 7/1997 | Demarest et al. | |
| 5,762,322 | A * | 6/1998 | Smith | B65D 83/205 137/68.11 |
| 5,918,774 | A | 7/1999 | Lund | |
| 5,957,337 | A | 9/1999 | Bettison, Jr. | |
| 5,971,214 | A | 10/1999 | Bettison, Jr. | |
| 5,971,230 | A | 10/1999 | Tanaka | |
| 6,299,027 | B1 | 10/2001 | Berge et al. | |
| 6,302,302 | B1 | 10/2001 | Albisetti | |
| 6,523,722 | B1 | 2/2003 | Clark et al. | |
| 6,695,171 | B2 * | 2/2004 | Walters | B05B 11/3001 222/153.13 |
| 6,758,373 | B2 | 7/2004 | Jackson et al. | |
| 7,004,359 | B2 * | 2/2006 | Marroncles | 222/402.13 |
| 7,044,337 | B1 * | 5/2006 | Kou | 222/153.11 |
| 7,124,916 | B2 * | 10/2006 | Groh | B65D 83/22 222/153.12 |
| 7,487,891 | B2 | 2/2009 | Yerby et al. | |
| 7,611,032 | B2 * | 11/2009 | Brunerie et al. | 222/153.11 |
| 7,699,190 | B2 * | 4/2010 | Hygema | B65D 83/205 222/153.11 |
| 8,100,298 | B2 | 1/2012 | Marquardt et al. | |
| 8,356,734 | B2 * | 1/2013 | Oshimo | B65D 83/24 222/153.11 |
| 2003/0168473 | A1 * | 9/2003 | Ho | 222/153.13 |
| 2005/0017026 | A1 | 1/2005 | Yerby et al. | |
| 2005/0017027 | A1 | 1/2005 | Yerby et al. | |
| 2008/0210710 | A1 * | 9/2008 | Marquardt | B65D 83/206 222/153.11 |
| 2009/0050650 | A1 | 2/2009 | Walters et al. | |
| 2009/0127293 | A1 | 5/2009 | De Laforcade | |
| 2009/0283609 | A1 * | 11/2009 | Strand | B05B 11/3057 239/333 |
| 2010/0025437 | A1 * | 2/2010 | Oshimo et al. | 222/402.13 |
| 2011/0233235 | A1 * | 9/2011 | Adams | B65D 83/205 222/402.13 |
| 2012/0048959 | A1 | 3/2012 | Maas et al. | |

FOREIGN PATENT DOCUMENTS

| | | |
|---|---|---|
| EP | 503735 | 9/1992 |
| EP | 0 659 157 | 6/1995 |
| EP | 0935567 | 4/1998 |
| EP | 1061007 | 5/2000 |
| EP | 1 219 547 | 7/2002 |
| EP | 1219547 | 7/2002 |
| EP | 1323644 | 7/2003 |
| JP | 2001097464 | 4/2001 |
| JP | 2003305390 | 10/2003 |
| JP | 2004050130 | 2/2004 |
| WO | WO 98/16439 | 4/1998 |
| WO | WO 99/33716 | 7/1999 |
| WO | WO 2007-022422 | 2/2007 |

* cited by examiner

TRIGGER OPERATED AEROSOL DISPENSER

CROSS-REFERENCE TO RELATED APPLICATIONS

This application claims benefit of U.S. Patent Provisional application No. 61/637,734 filed Apr. 24, 2012. All subject matter set forth in provisional application No. 61/637,734 filed Apr. 24, 2012 is hereby incorporated by reference into the present application as if fully set forth herein.

BACKGROUND OF THE INVENTION

Field of the Invention

This invention relates to dispensing and more particularly to an improved trigger operated aerosol dispenser.

Description of the Related Art

An aerosol dispenser comprises an aerosol product and an aerosol propellant contained within an aerosol container. An aerosol valve is provided to control the discharge of the aerosol product from the aerosol container through the fluid pressure provided by the aerosol propellant. The aerosol valve is biased into a dosed position. A valve stem cooperates with the aerosol valve for opening the aerosol valve. An actuator engages with the valve stem to open the aerosol valve for dispensing the aerosol product from the aerosol container.

Some aerosol dispensers incorporate an articulated trigger for actuating the aerosol valve for dispensing of the aerosol product from the aerosol container. The following U.S. patents are examples of the trigger operated aerosol devices of the prior art.

U.S. Pat. No. 2,995,308 to Ashkenaz discloses a jet stream dispenser which may serve as a closure for a container of volatile refrigerant used for inducing local anesthesia or analgesia in minor surgery.

U.S. Pat. No. 3,138,331 to Kutik discloses a spraying device adapted to be fitted upon the top of a pressurized or spray can to spray the contents thereof.

U.S. Pat. No. 3,189,232 to Joffe discloses a dispenser for an aerosol container of the type having a dispensing valve that is adapted to dispense upon depression thereof. The proposed device provides a dispensing attachment that may be applied readily to a container after which the operation of some manual device such as a trigger, will effect the dispensing of the contents of the container in a controlled and effective manner.

U.S. Pat. No. 3,429,484 to Baldwin discloses an attachment for an aerosol container of the type having an annular shoulder encompassing a spray head. An inverted U-shaped jaw clamp has side legs with inturned flanges at lower ends underposed with respect to the shoulder. An actuator includes a portion extending transversely of the legs through apertures therein and is pivoted at one end to one leg and a superposed with respect to the spray head. A hand operated handle extends from said portion downwardly along side the container.

U.S. Pat. No. 3,648,905 to Kauder discloses a pressure container having an outlet valve actuated by tilting the outlet nozzle with a lever arm extending from the nozzle downwardly and outwardly in proximity to the container to facilitate one-hand operation. Also provided is a releasable locking member cooperating with the lever arm construction to prevent premature or accidental operation.

U.S. Pat. No. 3,987,942 to Morane, et al. discloses a dispensing cap for pressurized containers comprising a wall adapted to snap onto the top of the container. A movable member defines a duct adapted to seat on the outlet tube of the container valve and through which its contents may be ejected. A separable actuating member projects through the wall to actuate the movable member.

U.S. Pat. No. 4,826,054 to Frutin discloses the valve of an aerosol can actuated by a lever having a handle portion and an intermediate portion bearing on a lock member. The lever is pivotably mounted in a clip. The lock member is in screw-threaded engagement with the valve for movement therealong between closed and open positions. The lock member can be placed in any intermediate position to set a desired flow rate through the valve when the lever is depressed by the user.

U.S. Pat. No. 5,040,705 to Snell discloses a flow control apparatus for controlling the flow of a material from a container valve comprising a flow control member adapted to be mounted on the valve for rotation relative to the valve for adjustably positioning the flow control member relative to the valve and container and thereby adjustably setting a maximum permissible flow rate of material which can be dispensed from the container through the valve. A trigger is mounted on the container and pressed for moving the flow control member and valve stem to dispense material from the container. A ring is rotatably mounted on an annular rim of the container. The rim mounts the trigger so that it can rotate the flow control member. Rotation of the ring rotates the trigger, and in turn, the flow control member in an easy, safe manner without risk of possible injury to the fingers from contact with a stationary trigger support. The container is preferably necked at its upper end such that the annular diameter of the mounting ring on the annular rim of the container does not protrude outwardly of the cylindrical side wall of the container for safety and compactness in use.

U.S. Pat. No. 6,340,103 to Scheindel, et al. discloses a dispensing mechanism for a pressurized container employing a platform which sits on and engages the valve cap. A lever pivoted on the platform extends from its pivot point up and around the nozzle to terminate in the handle that is adjacent to the sidewall of the pressurized container. The upper portion of the lever engages the shoulder on the nozzle so that when the handle is manually squeezed against the sidewall of the container. The lever pushes down on the nozzle thus pushing the nozzle and valve in a downward axially direction thereby dispensing the pressurized contents of the container. It is when the nozzle is screwed into a dispensing state that the handle or the lever is pivoted away from the sidewall of the can so that it can be squeezed against the can to effect the dispensing of the contents.

U.S. Pat. No. 6,494,349 to Thompson, et al. discloses a hand-held pressurized product dispenser that includes a container with a hand-engageable body portion. A valve mechanism at the top of the container is movable with respect to the container to cause pressurized discharge of the product. A valve actuation lever is connected to the valve mechanism and extends along the container body such that a larger displacement of the end of the lever causes a controlled, relatively smaller displacement of the valve mechanism permitting adjustable "throttled" delivery of the product. Also disclosed are a product delivery member that is attached to the top of container and has a product holding structure that is positioned with respect to the valve mechanism to receive product and to hold the product in position for application. Cam members are oriented to cause the valve actuating lever to move downward as it is moved toward the container body. A movable stop member is carried on the container and faces the hand-engageable portion so as to limit travel of the hand-engageable portion toward the container.

U.S. Pat. No. 6,685,064 to Frutin discloses a dispensing apparatus for dispensing a product from a container including a product chamber within the container and a valve adjacent to the product chamber. A hinge assembly is secured to the opening of the container and to which is connected a nozzle assembly. A lever is attached by means of the hinge assembly. The nozzle assembly is rotatable between open and closed positions and includes an actuator portion provided with a cam surface which co-operates with a bearing portion on the lever such that, when the nozzle assembly is in the open position, operation of the lever causes movement of the actuator portion to open the valve and permit flow of the product out of the container.

U.S. Pat. No. 6,722,532 to Lasserre, et al. discloses a dispenser unit comprising a housing and an actuator movable relative to the housing to cause the contents of two containers to be dispensed simultaneously in mixed or separate state. Each container includes a hollow stem through which the substance is dispensed when the stem is depressed. The dispenser unit includes a fluid-conducting member distinct from the actuator and including two hoods for engaging the two stems of the containers. Depressing the actuator causes the fluid-conducting member to actuate the stems and initiate dispensing of the contents into a single passage or two separate passages of the fluid-conducting member. The fluid-conducting member is movable within the housing for accommodating mismatch in heights of the stems. The actuator includes a single internal channel or two separate channels for receiving the container contents from the fluid-conducting member.

U.S. Pat. No. 6,820,777 to Frutin discloses a dispensing apparatus for dispensing a product from a container including a product chamber within the container and a valve adjacent to the product chamber. A hinge assembly is secured to the opening of the container and to which is connected a nozzle assembly and a lever attached by a hinge assembly. The nozzle assembly is rotatable between open and closed positions. An actuator portion is provided with a cam surface which co-operates with a bearing portion on the lever such that, when the nozzle assembly is in the open position, operation of the lever causes movement of the actuator portion to open the valve and permit flow of the product out of the container.

U.S. Pat. No. 7,124,916 to Groh, et al. discloses a hand-held pressurized product dispenser including a container containing a product under pressure and a valve mechanism and base structure at the top of the container. A nozzle moves between an unactuated position and a discharge position. A side lever extends along the can and is movable to move the nozzle from the unactuated position to the discharge position. The dispenser has a dome rotatably connected to the base structure and surrounds the nozzle and interacts with the nozzle to cause rotation of the nozzle between a locked position and an unlocked position. The nozzle has one or more downwardly directed feet that align with solid areas of an upwardly directed surface in the locked position and that align with open areas of the base structure in the unlocked position such that the nozzle is free to move into the discharge position.

U.S. Pat. No. 7,631,785 to Paas, et al. discloses a trigger actuator for a container including a recess defined by one or more walls that protrude downwardly surrounding an actuating button of an overcap of the container. The trigger actuator is attached to the actuating button. The trigger actuator further includes an aperture disposed in the recess above an outlet in the actuating button and a lever disposed on a side of the trigger actuator. Pressing the lever towards the container forces the walls defining the recess downward displacing the actuating button.

U.S. Pat. No. 7,641,079 to Lott, et al. discloses a cover and trigger assembly that includes having a valve that can be actuated for dispensing the contents of the can through an outlet of the valve. The assembly includes an annular component having a helical surface secured to the can. A cover is coupled to the annular component. The cover has an opening through which a trigger extends. The cover is rotatable relative to the helical surface on the annular component for rotatably raising or lowering the cover relative to the annular component. The raising or lowering of the cover respectively prohibits or permits movement of the trigger member to actuate the valve, thereby controlling dispensing operation of the valve.

U.S. Pat. No. 7,891,529 to Paas, et al. discloses a trigger actuator for a container including a recess defined by one or more walls that protrude downwardly surrounding an actuating button of an overcap of the container wherein the trigger actuator is attached to the actuating button. The trigger actuator further includes an aperture disposed in the recess above an outlet in the actuating button and a lever disposed on a side of the trigger actuator. Pressing the lever towards the container forces the walls defining the recess downward displacing the actuating button.

U.S. Pat. No. 7,959,040 to Heirman discloses a dispensing device for dispensing a product. The dispensing device comprises: a container containing the product under pressure. The container has a top, bottom and body portion. An axial direction is defined between the bottom and top. A valve mechanism is mounted at the top of the container. The valve mechanism is movable with respect to the container for pressurized discharge of the product out of the container. A dispensing cap is mounted on the top of the container. The dispensing cap carries a nozzle debouching outside the cap for spraying the product. The nozzle is connected to the valve mechanism by a conduit. An actuating member has a horizontal arm and a vertical arm. The horizontal arm is hingedly suspended in the cap and engages the valve mechanism to actuate the valve mechanism upon pulling the vertical arm towards the container portion. The body portion of the container has a lower portion and an upper portion providing a one-hand grip. The vertical arm engages at least one finger of a hand gripping the one-hand grip. The one-hand grip is constricted in its circumference with respect to the lower portion.

United States Patent Application No. 2003/0075571 to Thompson, et al. discloses a hand-held pressurized product dispenser that includes a container with a hand-engageable body portion. A valve mechanism at the top of the container is movable with respect to the container to cause pressurized discharge of the product. A valve actuation lever is connected to the valve mechanism and extends along the container body such that a larger displacement of the end of the lever causes a controlled, relatively smaller displacement of the valve mechanism, permitting adjustable "throttled" delivery of the product. A product delivery member is attached to the top of container and has a product holding structure that is positioned with respect to the valve mechanism to receive product and to hold the product in position for application. Cam members are oriented to cause the valve actuating lever to move downward as it is moved toward the container body. A movable stop member is carried on the container and faces the hand-engageable portion so as to limit travel of the hand-engageable portion toward the container.

United States Patent Application 2004/0256418 to Scheindel discloses an axially actuated valve assembly for use in a pressurized container that is easily actuated and controlled by a user to dispense the amount of product desired. The valve stem is moved in an up and down direction so that when dispensing, the user can control amount of the valve openings that are in communication with the material to be dispensed. The flexible boot surrounds the valve stem by having an upper edge that engages the valve actuating ledge and a lower edge that engages the button when in the non-dispensing state. The boot has a squared off lower interior edge engaging the stem and the button of the valve member when in the non-dispensing state. The button of valve is small in diameter and less than the surface of the boot that the button engages. The boot has a substantially straight thin wall neck below the upper edge. Two slits in the neck reduce hoop strength to facilitate outward bowing of the mark when the valve is depressed. The upper edge extends radially inward of the thin wall neck sufficiently to further assure outward bowing of the thin wall as the valve is depressed into the dispensing state.

U.S. Design Pat. D627,224 to Bass, et al. discloses an ornamental design for an overcap.

U.S. Design Pat. D635,854 to Bass, et al. discloses an ornamental design for an overcap.

Others have incorporated a locking feature for inhibiting the dispensing of the aerosol product from the aerosol container. The following U.S. patents disclose novel inventions incorporating a locking feature for inhibiting the dispensing of the aerosol product from the aerosol container.

U.S. Pat. No. 7,487,891 to Yerby et al. discloses an actuator for actuating an aerosol valve for dispensing an aerosol product from an aerosol container. The actuator comprises an actuator button being rotatable relative to a base for movement between a locked rotational position and an unlocked rotational position. The actuator button has a rigid sidewall supporting a rigid top actuating surface with an actuator button orifice defined in the sidewall of the actuator button. The actuator button is movable relative to the base for actuating the aerosol valve to dispense the aerosol product when the actuator button is rotated into the unlocked rotational position. The actuator button is inhibited from actuating the aerosol valve when the actuator button is moved into the locked rotational position.

U.S. Pat. No. 8,100,298 to Marquardt et al. discloses an actuator for actuating an aerosol valve for dispensing an aerosol product from an aerosol container. The improved actuator comprises a base for mounting to the aerosol container. A unitary actuator button supports a nozzle extending between the aerosol valve and a terminal orifice. The actuator button is rotatable about the base between a locked rotational position and an unlocked rotational position. The unitary actuator button is movable for pivoting the nozzle button to actuate the aerosol valve for dispensing aerosol product from the terminal orifice when the actuator button is in the unlocked rotational position. The unitary actuator button is inhibited from pivoting the nozzle button when the actuator button is rotated into the locked rotational position.

U.S. Pat. No. 8,127,968 to Yerby et al. discloses an actuator for actuating an aerosol valve for dispensing an aerosol product from an aerosol container. The actuator comprises an actuator button being rotatable relative to a base for movement between a locked rotational position and an unlocked rotational position. The actuator button is tiltable relative to the base for actuating the aerosol valve to dispense the aerosol product when the actuator button is rotated into the unlocked rotational position. The actuator button is inhibited from tilting relative to the base when the actuator button is moved into the locked rotational position. The rotational movement of the actuator between the locked rotational position and the unlocked rotational position is accompanied by a double click.

It is an object of the present invention to improve upon the above art to provide a trigger operated aerosol dispenser that provides a significant advancement to the aerosol dispensing art.

Another object of this invention is to provide a trigger operated aerosol dispenser including a non-articulated trigger actuator.

Another object of this invention is to provide a trigger operated aerosol dispenser that may be actuated either by a trigger actuator or alternately be actuated by a depression of a dispenser head.

Another object of this invention is to provide a trigger operated aerosol dispenser having a reduced number of parts.

Another object of this invention is to provide a trigger operated aerosol dispenser having a reduced finger pressure for actuating the trigger operated aerosol dispenser.

Another object of this invention is to provide a trigger operated aerosol dispenser that includes a lock for inhibiting actuation of the trigger operated aerosol dispenser.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention and the detailed description describing the preferred embodiment of the invention.

SUMMARY OF THE INVENTION

A specific embodiment of the present invention is shown in the attached drawings. For the purpose of summarizing the invention, the invention relates to a two-piece trigger operated aerosol dispenser for dispensing an aerosol product from an aerosol container through an aerosol valve. The two-piece trigger operated aerosol dispenser comprises a first and a second piece. The first piece comprises a base having a mounting unitary with the base for securing the base to the aerosol container. The second piece comprises a dispensing head having a sidewall supporting a top surface. A nozzle channel extends through the dispensing head for communicating the aerosol valve with a terminal orifice. A trigger actuator is unitary with the dispensing head and extending outwardly therefrom for actuating the aerosol valve upon depression of the trigger actuator for dispensing the aerosol product from the terminal orifice.

In a more specific embodiment of the invention, the base has an outer ring and an inner ring defining an annular void between the outer ring and the inner ring of the base. A portion of the dispensing head extends into the annular void between the outer ring and the inner ring of the base. The dispensing head is tiltable within the annular void of the base upon depression of the trigger actuator for opening the aerosol valve to dispense the aerosol product from the terminal orifice.

In another specific embodiment of the invention, a lock interacts between the base and the dispensing head to inhibit the trigger actuator from actuating the aerosol valve. In one specific example, the dispensing head is rotatably mounted to the base for rotation between a locked rotational position and an unlocked rotational position. The trigger actuator actuates the aerosol valve upon depression of the trigger actuator when the dispensing head is rotated into the unlocked rotational position. The trigger actuator is inhibited from actuating the aerosol valve when the dispensing head is rotated into the locked rotational position.

In still another specific embodiment of the invention, the dispensing head has a non-articulated trigger for actuating the aerosol valve in a primary manner and has a dispensing head actuator surface for actuating the aerosol valve in a secondary manner to dispense the aerosol product from the terminal orifice.

In another embodiment of the invention, the invention comprises a lockable trigger aerosol dispenser for dispensing an aerosol product from an aerosol container through an aerosol valve. The lockable trigger aerosol dispenser comprises a base defined about an axis of symmetry of the base. A base retainer extends from the base. A mounting secures the base to the aerosol container. A dispensing head comprises a sidewall supporting a top surface. A nozzle is located within the dispensing head defining a nozzle channel extending between the aerosol valve and a terminal orifice. A dispensing head retainer extends from the dispensing head cooperating with the base retainer for rotationally securing the dispensing head to the base. The dispensing head is rotatable about the axis of symmetry of the base between a locked rotational position and an unlocked rotational position. A trigger actuator is unitary with the dispensing head adjacent to the terminal orifice for actuating the aerosol valve upon depression of the trigger actuator to dispense the aerosol product from the terminal orifice when the dispensing head is rotated into the unlocked rotational position. The trigger actuator is inhibited from actuating the aerosol valve when the dispensing head is rotated into the locked rotational position.

The foregoing has outlined rather broadly the more pertinent and important features of the present invention in order that the detailed description that follows may be better understood so that the present contribution to the art can be more fully appreciated. Additional features of the invention will be described hereinafter which form the subject matter of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
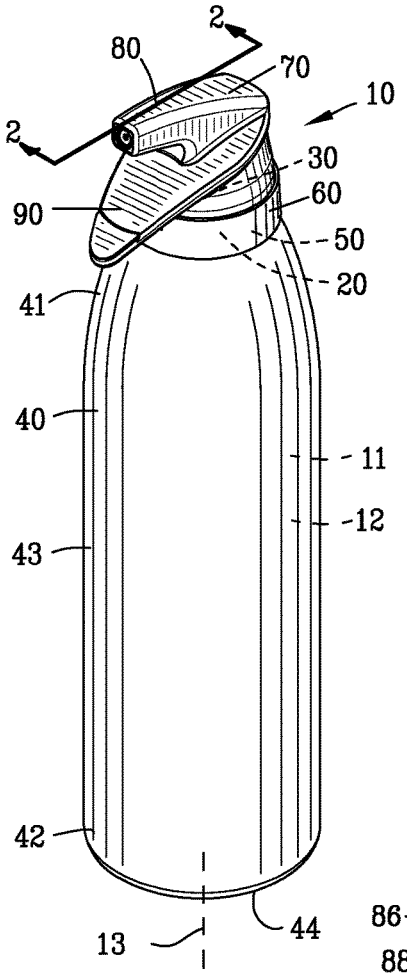
FIG. 1 is a top isometric view of a first embodiment of a trigger operated aerosol dispenser of the present invention located on an aerosol container.
Figure 2:
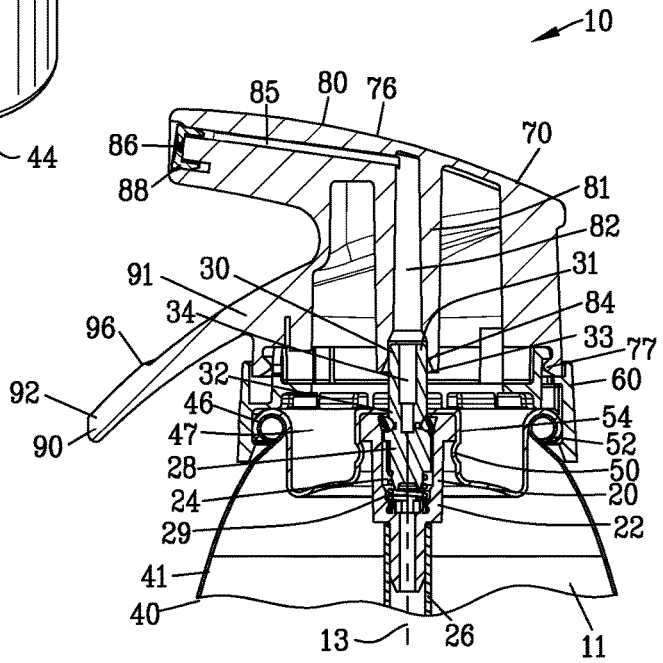
FIG. 2 is an enlarged partial sectional view along line 2-2 in FIG. 1.
Figure 3:
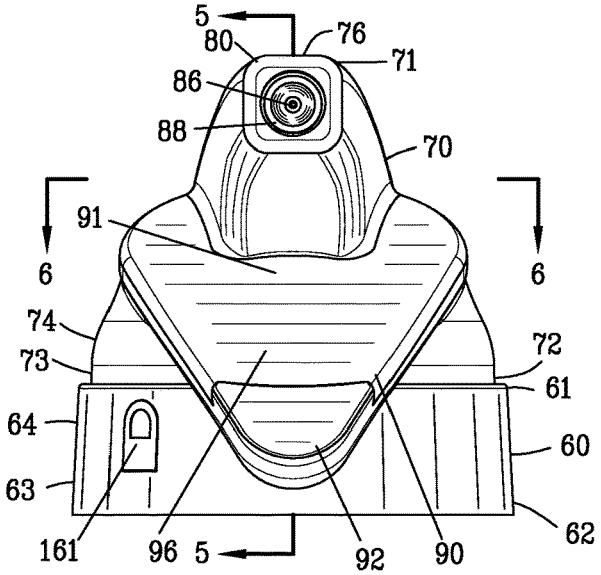
FIG. 3 is an enlarged front view of the trigger operated aerosol dispenser of FIG. 1.
Figure 4:
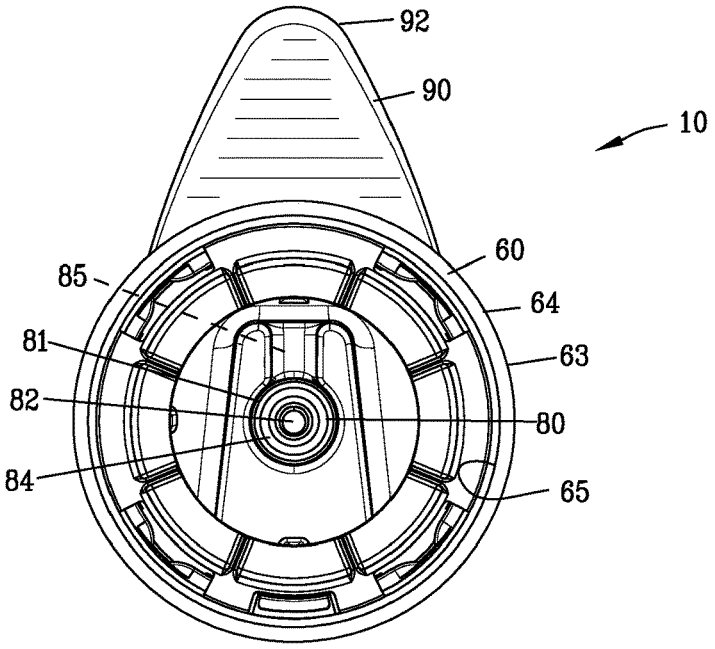
FIG. 4 is a bottom view of FIG. 3.
Figure 5:
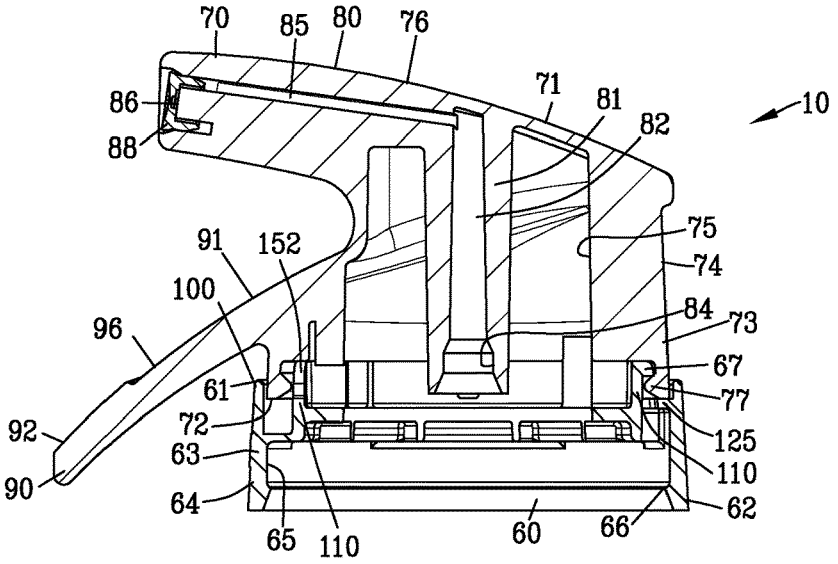
FIG. 5 is a sectional view along line 5-5 in FIG. 3.
Figure 6:
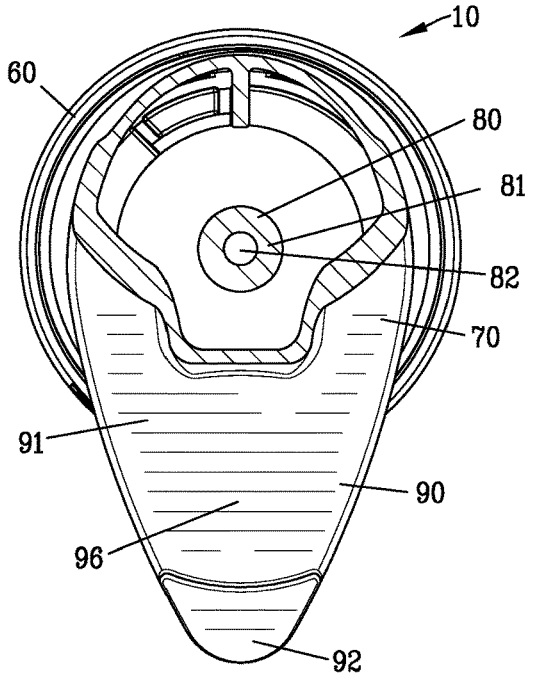
FIG. 6 is a sectional view along line 6-6 in FIG. 3.
Figure 7:
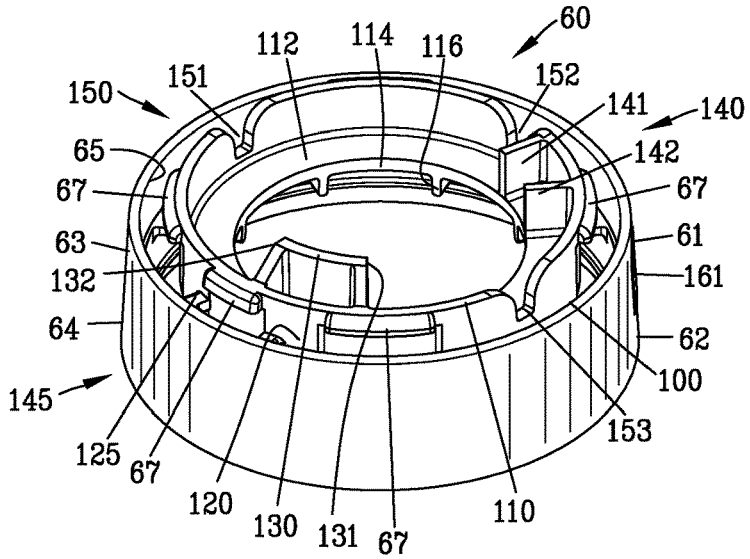
FIG. 7 is a top isometric view of a base of the trigger operated aerosol dispenser of FIGS. 1-6.
Figure 8:
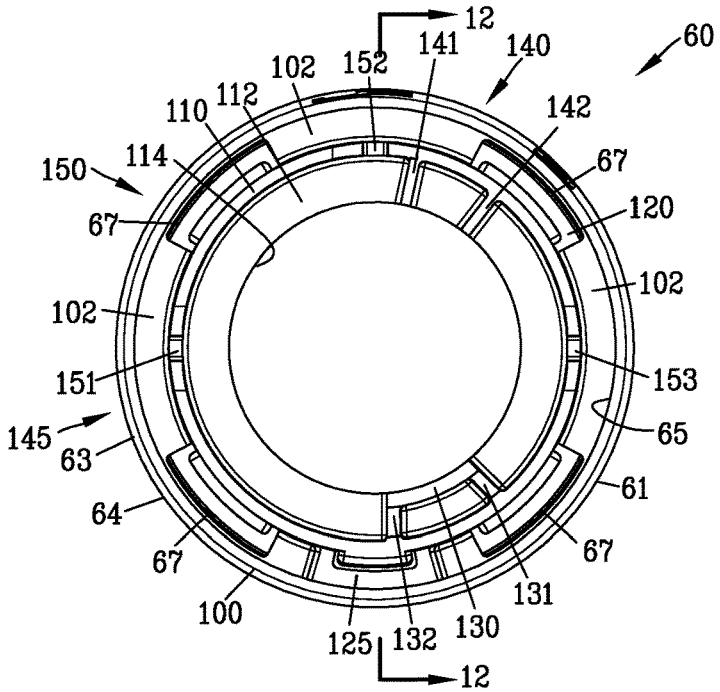
FIG. 8 is a top view of the base shown in of FIGS. 1-6.

FIGS. 1 and 2 illustrate a first embodiment of the improved trigger operated aerosol dispenser 10 of the present invention for dispensing an aerosol product 11 with an aerosol propellant 12. The terms aerosol product 11 and aerosol propellant 12 as used herein includes all types of pressurized package dispenser including pressurized gases or bag on valve dispensers.

The first embodiment of the trigger operated aerosol dispenser 10 defines an axis of symmetry 13 of the trigger operated aerosol dispenser 10. An aerosol valve 20 having a valve stem 30 cooperates with the trigger operated aerosol dispenser 10 to control the flow of the aerosol product 11 from an aerosol container 40.

The aerosol container 40 is shown as a cylindrical container of conventional design and material. The aerosol container 40 extends between a top portion 41 and a bottom portion 42 with a cylindrical sidewall 43 located therebetween. The bottom portion 42 of the aerosol container 40 is closed by an endwall 44. Although the aerosol container 40 has been shown as a conventional design, it should be understood that the trigger operated aerosol dispenser 10 of the present invention may be used with aerosol containers of various designs.

As best shown in FIG. 2, the aerosol container 40 terminates in a bead 46 defining an opening 47 in the aerosol container 40 for receiving a mounting cup 50. The mounting cup 50 includes a peripheral rim 52 for sealing to the bead 46 of the aerosol container 40. The mounting cup 50 further comprises a turret 54 for receiving the aerosol valve 20.

The aerosol valve 20 includes a valve body 22 secured to the turret 54 of the mounting cup 50 by a conventional crimping process. The valve body 22 defines an internal valve cavity 24 in fluid communication with the aerosol container 40 through a dip tube 26. The aerosol valve 20 includes a valve element 28 positioned within the internal valve cavity 24. A bias spring 29 biases the valve element 28 into a closed position to inhibit the flow of the aerosol product 11 through the valve stem 30.

The valve stem 30 extends between a first end 31 and a second end 32 and defines an outer surface 33 with a stem passageway 34 extending therein. The stem passageway 34 provides fluid communication from the internal valve cavity 24 of the valve body 22 to the second end 32 of the valve stem 30. A depression of the valve stem 30 moves the valve element 28 into an open position against the urging of the bias spring 29 to permit the flow of the aerosol product 11 from the second end 32 of the valve stem 30.

FIGS. 3-6 are various enlarged views of the trigger operated aerosol dispenser 10 of the present invention. The trigger operated aerosol dispenser 10 comprises a base 60 extending between a top portion 61 and a bottom portion 62 with a cylindrical sidewall 63 located therebetween. The sidewall 63 of the base 60 defines an outer surface 64 and an inner surface 65 coaxial with the axis of symmetry 13 of the trigger operated aerosol dispenser 10.

The base 60 includes a base mounting 66 for securing the base 60 to the aerosol container 40. The base mounting 66 is shown as annular base projections 66 extending radially inwardly for securing the base 60 to the aerosol container 40. In this example, the annular base projection 66 engages with the bead 46 of the aerosol container 40. However, it should be understood that various conventional structures may be used for securing the base 60 to the aerosol container 40.

The base 60 includes a base retainer 67 for rotationally securing a dispensing head 70 to the base 60. The base retainer 67 comprises a plurality of annular projections 67 extending radially outwardly from the base 60. The plurality of annular projections 67 are distributed about the axis of symmetry 13 of the trigger operated aerosol dispenser 10.

The dispensing head 70 is shown as unitary member extending between a top portion 71 and a bottom portion 72 with a cylindrical sidewall 73 located therebetween. The sidewall 73 of the dispensing head 70 is a substantially rigid sidewall 73 defining an outer surface 74 and an inner surface 75 coaxial with the axis of symmetry 13 of the trigger operated aerosol dispenser 10. The substantially rigid sidewall 73 of the dispensing head 70 supports a rigid top surface 76.

The dispensing head 70 includes a dispensing head retainer 77 for cooperating with the base retainer 67 for rotationally securing the dispensing head 70 to the base 60. The dispensing head retainer 77 is shown as a plurality of annular projections 77 extending radially inwardly from the inner surface 75 of the sidewall 73 of the dispensing head 70. The radially inwardly extending dispensing head retainers 77 cooperate with the radially outwardly extending base retainers 67 for rotationally securing the dispensing head 70 to the base 60.

A nozzle 80 is located within the dispensing head 70 for communication with the aerosol valve 20. The nozzle 80 includes a nozzle column 81 having a nozzle channel 82 terminating in a socket 84. The socket 84 frictionally receives the second end 32 of the valve stem 30. The nozzle channel 82 is connected to a nozzle passageway 85 terminating in a terminal orifice 86. The nozzle 80 is unitary with the dispensing head 70. The dispensing head 70 may optionally receive a terminal orifice insert 88 defining the terminal orifice 86 for controlling the spray pattern and/or the spray characteristics of the aerosol product 11 including a foaming adapter or a streaming orifice insert.

An important aspect of the present invention is the inclusion of a trigger actuator 90 extending from a proximal end of 91 to a distal end 92. The trigger actuator 90 defines a trigger actuating surface 96 for receiving a finger of an operator (not shown) for actuating the aerosol valve 20 to dispense the aerosol product 11. The proximal end 91 of the trigger 90 is unitary with the dispensing head 70 to move as a one piece unit.

As will be described in greater detail hereinafter, the dispensing head 70 is tiltable relative to the base 60 for actuating the aerosol valve 20 to dispense the aerosol product 11 from the aerosol container 40 through a nozzle 80 of the dispensing head 70. The dispensing head 70 has a top surface 76 and a trigger actuating surface 96 to provide two independent actuating surfaces for tilting the dispensing head 70 to dispense the aerosol product 11 from the aerosol container 40.

The dispensing head 70 is rotatable relative to the base 60 between a locked rotational position as shown in FIGS. 19-24 to an unlocked rotational position as shown in FIGS. 25-34. The dispensing head 70 is inhibited from tilting relative to the base 60 when the dispensing head 70 is moved into the locked rotational position as shown in FIGS. 19-24. The dispensing head 70 is tiltable relative to the base 60 to dispense the aerosol product 11 from the aerosol container 40 when the dispensing head 70 is rotated into the unlocked rotational position as shown in FIGS. 25-34.

FIGS. 7-12 are various views further illustrating the base 60 shown in FIGS. 3-6. The first end 61 of the base 60 defines an outer ring 100. The outer ring 100 is a substantially cylindrical upper portion of the cylindrical sidewall 63. A plurality of radial ribs 102 extend inwardly from the inner surface 65 of the cylindrical sidewall 63. The plurality of radial ribs 102 supports an inner ring 110. The outer ring 100 and the inner ring 110 are coaxial with the axis of symmetry 13 of the trigger operated aerosol dispenser 10.

Figure 11:
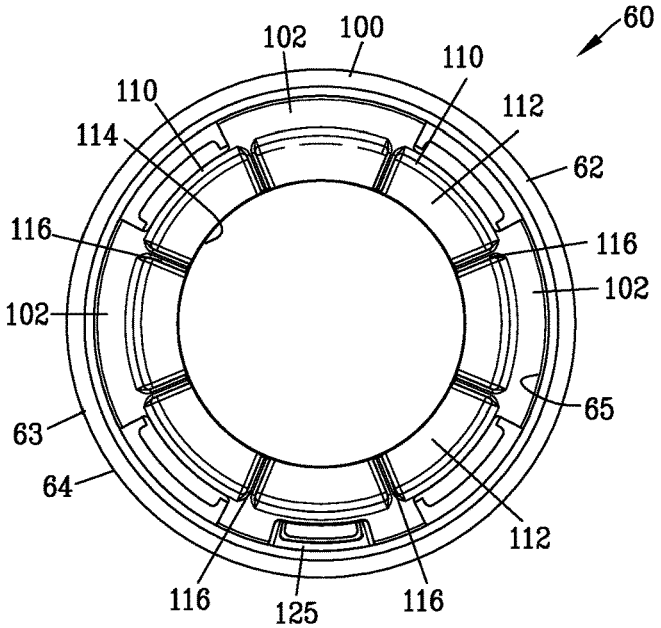
FIG. 11 is a bottom view of FIG. 8.
Figure 12:
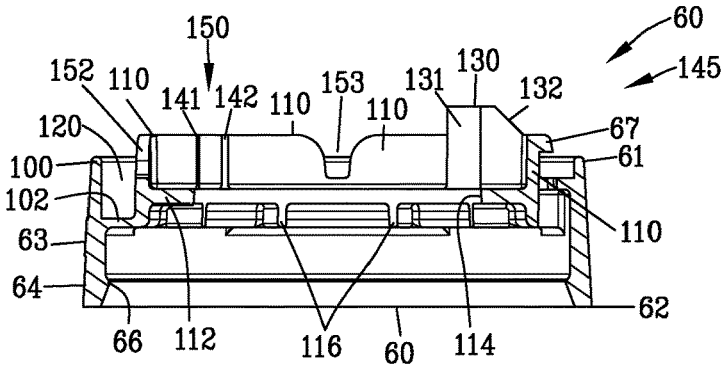
FIG. 12 is a sectional view along line 12-12 in FIG. 8.
Figure 13:
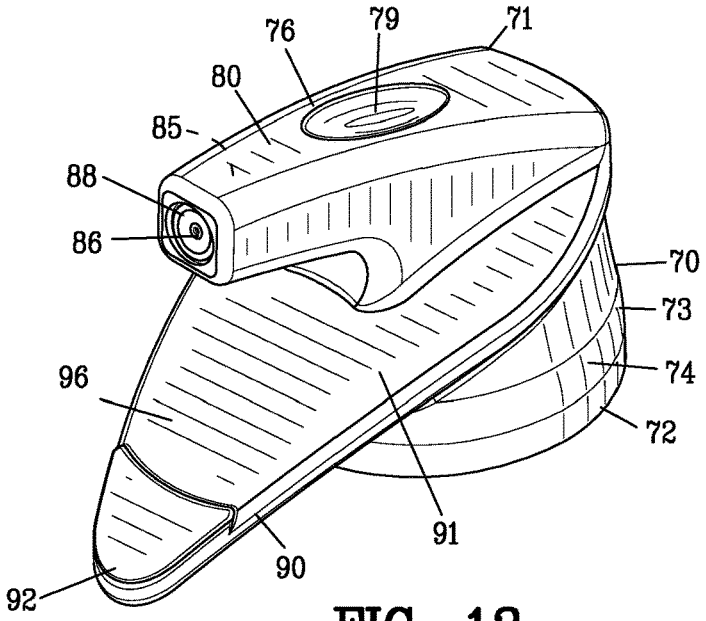
FIG. 13 is a top isometric view of the dispensing head of FIGS. 1-6.
Figure 14:
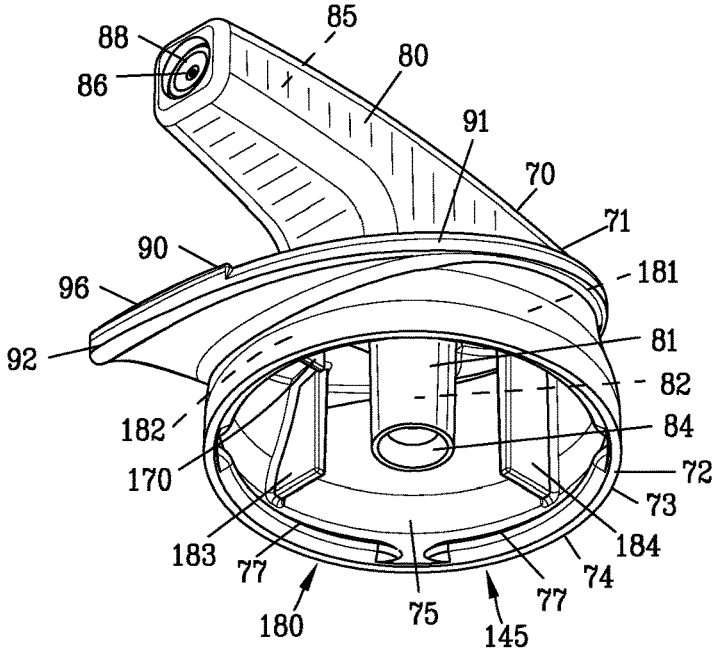
FIG. 14 is a bottom isometric view of the dispensing head of FIGS. 1-6.
Figure 15:
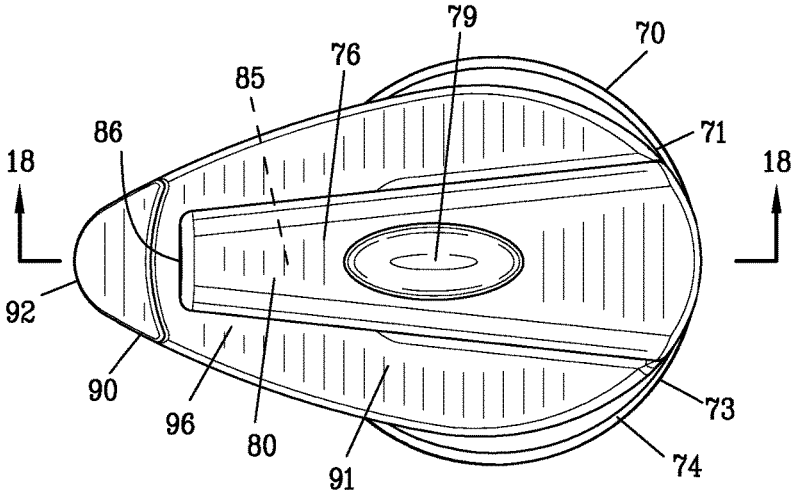
FIG. 15 is a top view of the dispensing head of FIGS. 13-14.
Figure 16:
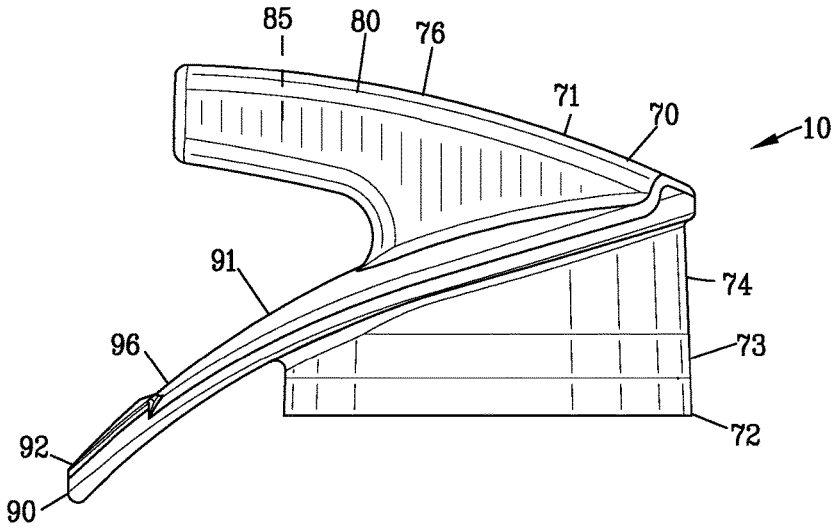
FIG. 16 is a left side view of the dispensing head of FIG. 15.
Figure 17:
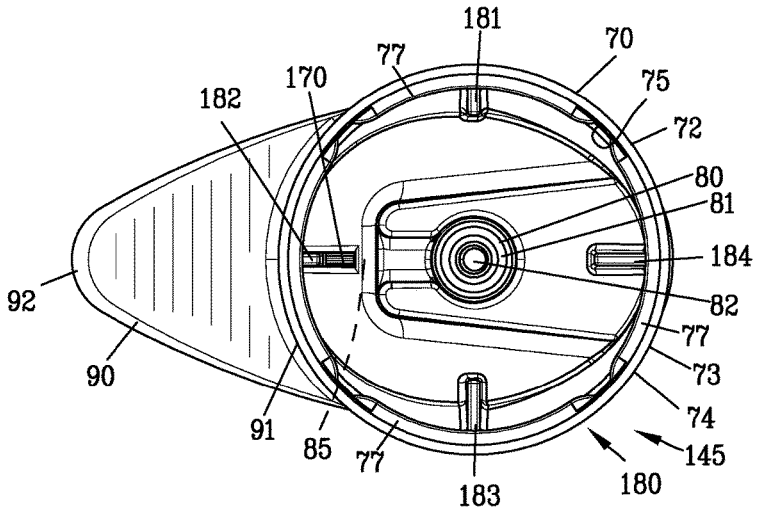
FIG. 17 is a bottom view of FIG. 16.
Figure 18:
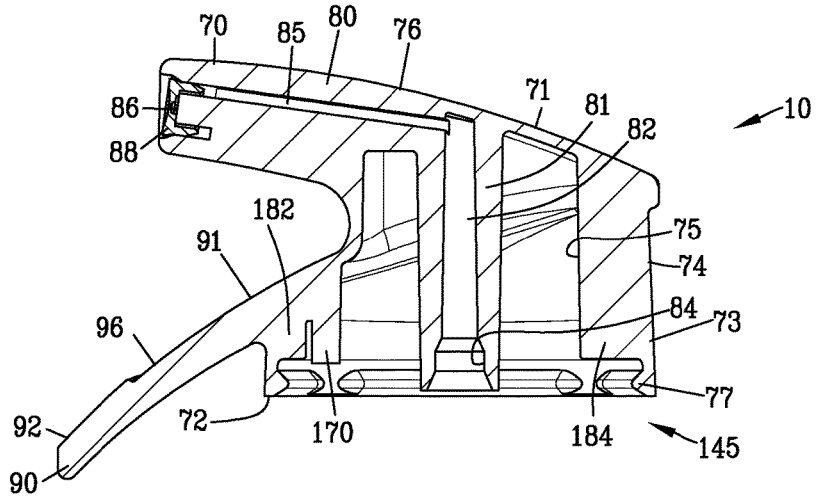
FIG. 18 is a sectional view along line 18-18 in FIG. 15.
Figure 19:
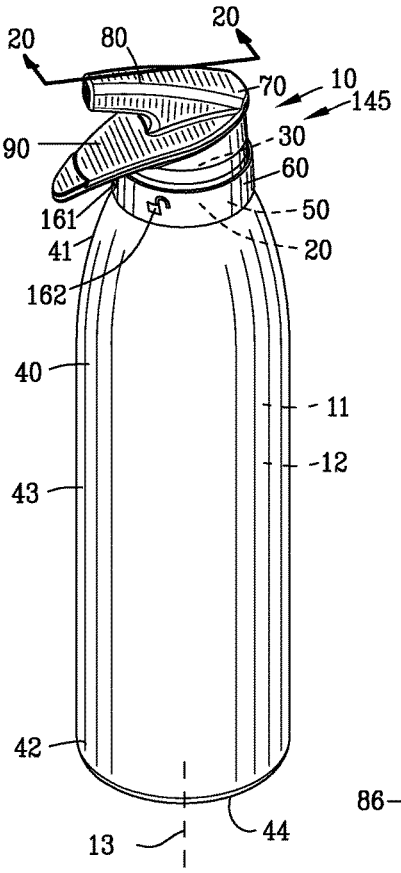
FIG. 19 is a top isometric view similar to FIG. 1 with the dispensing head being located in a locked rotational position.
Figure 20:
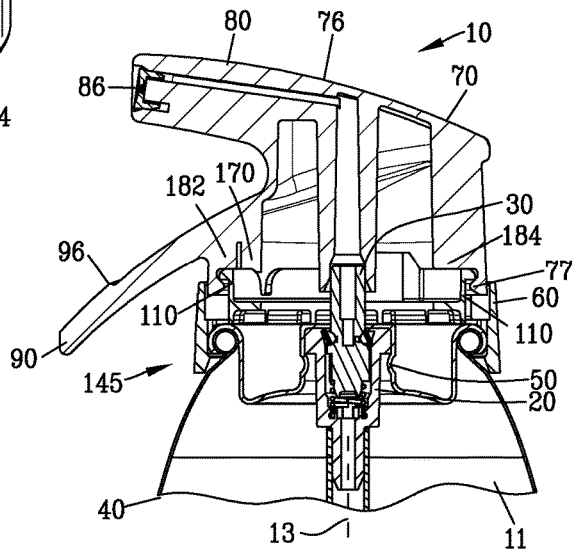
FIG. 20 is an enlarged partial sectional view along line 20-20 in FIG. 19.
Figure 21:
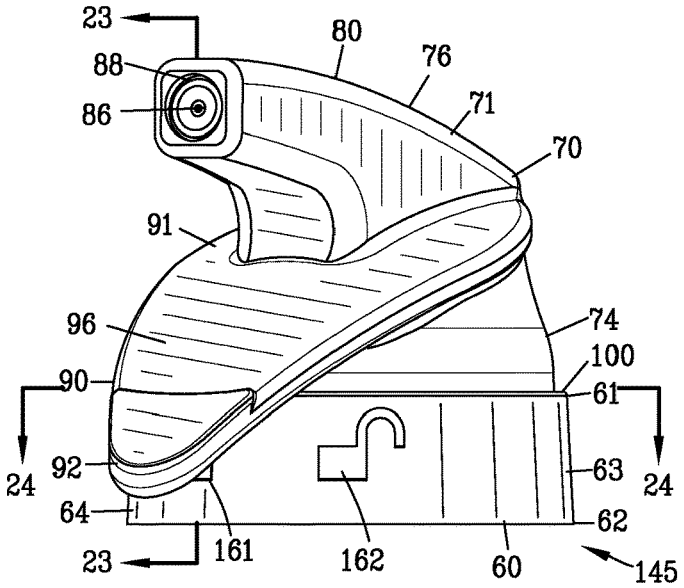
FIG. 21 is an enlarged front view of the improved actuator of FIG. 19.
Figure 22:
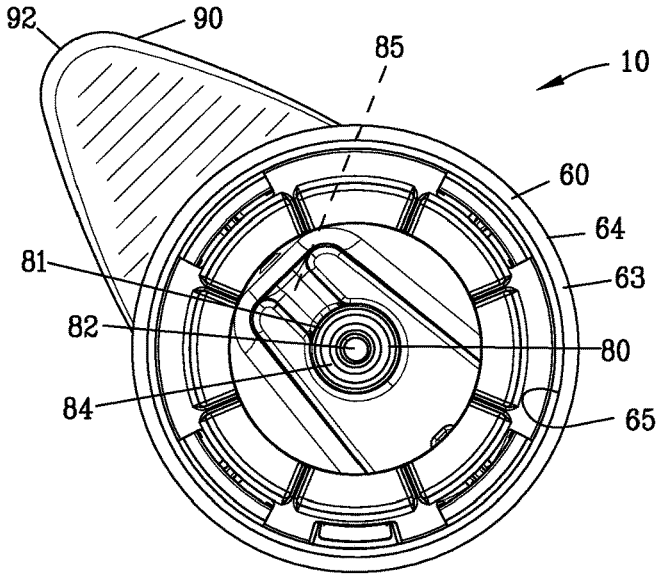
FIG. 22 is a bottom view of FIG. 21.
Figure 23:
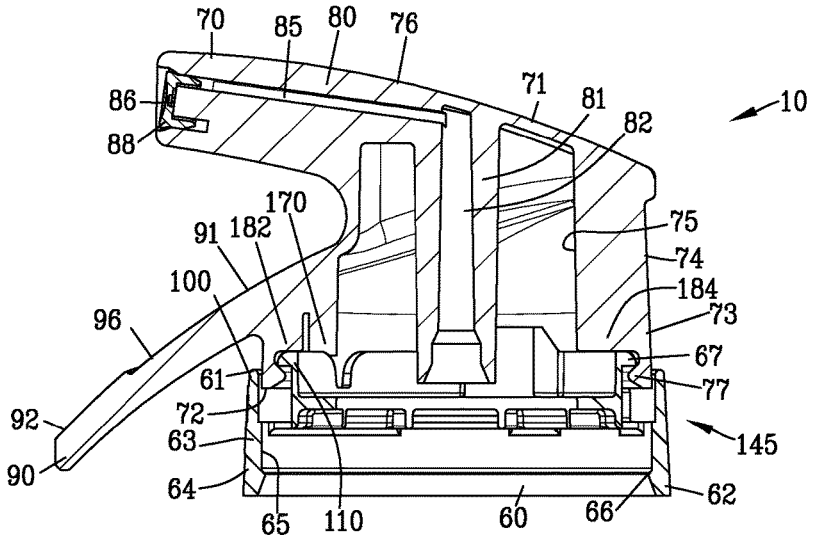
FIG. 23 is a sectional view along line 23-23 in FIG. 21.

An inner base platform 112 extends radially inwardly from the inner ring 110 and defines a central platform aperture 114 coaxial with the outer ring 100 and the inner ring 110. Preferably, the plurality of radial ribs 102 and the inner ring 110 and the inner base platform 112 are integrally formed with the base 60. As best shown in FIGS. 11 and 12, an array of base platform ribs 116 extend from the inner ring 110 to support the underside of the inner base platform 112. The inner base platform 112 defines a central platform aperture 114.

The inner ring 110 supports the base retainer 67 for cooperating with the dispensing head retainer 77 for rotationally securing the dispensing head 70 to the base 60. The base retainer 67 is shown as a plurality of annular projections 67 extending radially outwardly from the inner ring 110 of the base 60. The plurality of annular projections 67 are distributed about the axis of symmetry 13 of the trigger operated aerosol dispenser 10.

Preferably, the inner ring 110 of the base 60 is deformable for enabling the dispensing head retainer 77 to pass over the base retainer 67. After the dispensing head retainer 77 passes over the base retainer 67, the base retainer 67 engages with the dispensing head retainer 77 to retain the dispensing head 70 on the base 60. The dispensing head retainer 77 of the dispensing head 70 interlocks with the base retainer 67 for rotationally securing the dispensing head 70 to the base 60.

A void 120 is defined between the outer ring 100 and the inner ring 110 of the base 60. A bridge 125 extends across the void 120 between the outer ring 100 and the inner ring 110 of the base 60. Preferably, the bridge 125 extends across a portion of the void 120 and is located at a level below the first end 61 of the base 60. The bridge 125 occupies a minor portion of the circumference of the inner ring 110. In this example, the bridge 125 occupies a five to ten degree arc portion of the circumference of the inner ring 110 about the axis of symmetry 13 of the trigger operated aerosol dispenser 10.

The base 60 includes a base stop 130 for cooperating with the dispensing head 70 for establishing an unlocked rotational position and a locked rotational position of the dispensing head 70 relative to the base 60. More specifically, the base stop 130 extends upwardly from the inner base platform 112 and extends inwardly from the inner ring 110 to selectively interfere with the rotation of the dispensing head 70. The base stop 130 includes a locked position stop 131 and an unlocked position stop 132 defined by circumferentially spaced apart lateral surfaces 131 and 132 of the base stop 130. Preferably, the base stop 130 is integrally formed with the inner ring 110 and the inner base platform 112. The locked position stop 131 establishes a locked rotational position of the dispensing head relative to the base 60 as shown in FIGS. 19-24. The unlocked position stop 132 establishes an unlocked rotational position of the dispensing head relative to the base 60 as shown in FIGS. 25-34.

The base 60 includes audible actuator rib 140 for cooperating with the dispensing head 70 for audibly indicating the rotational position of the dispensing head 70 relative to the base 60. In this example, the audible actuator rib 140 comprises plural audible actuator ribs 141 and 142. Each of the plural audible actuator ribs 141 and 142 extends upwardly from the inner base platform 112 and extends inwardly from the inner ring 110.

The trigger operated aerosol dispenser 10 comprises a lock 145 for locking the tilting of the dispensing head 70 relative to the base 60. The lock 145 includes a groove 150 defined on the base 60 cooperating with a groove rib 180 extending from the dispensing head 70. The groove 150 is defined in the inner ring 110 of the base 60 for enabling the dispensing head 70 to the tilted relative to the base 60 as shown in FIGS. 25-34. More specifically, the groove 150 includes a plurality of grooves 151-153 formed within the inner ring 110 of the base 60. Each of the plurality of grooves 151-153 extends through the inner ring 110 to a level in proximity to the inner base platform 114 of the base 60.

Figure 9:
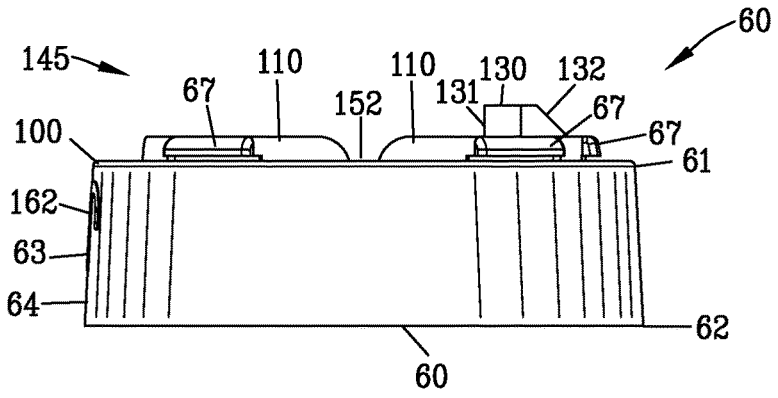
FIG. 9 is a right side view of the base of FIG. 7.
Figure 10:
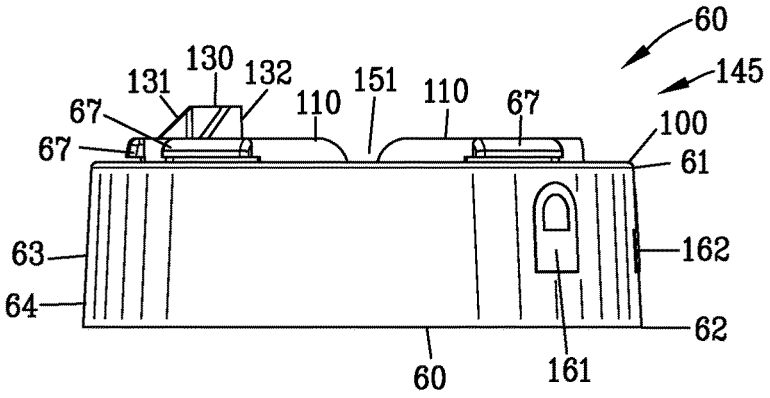
FIG. 10 is a left side view of the base of FIG. 7.

Referring to FIGS. 9 and 10, the trigger operated aerosol dispenser 10 may include a rotation indicator 160 for indicating the rotational position of the dispensing head 70 relative to the base 160. Preferably, the rotation indicator 160 includes a locked rotational position indicator 161 and an unlocked rotational position indicator 162. The trigger 90 of the dispensing head 70 functions as an alignment indicator for the locked and unlocked rotational position indicators 161 and 162. In this example, the locked and unlocked rotational position indicators 161 and 162 are located on the outer surface 64 of the base 60, but it should be appreciated by those skilled in the art that numerous variations in the arrangement of the rotation indicator 160 may be incorporated within the present invention.

FIGS. 13-18 are various views further illustrating the dispensing head 70 shown in FIGS. 3-6. The top surface 76 of the dispensing head 70 includes a top finger actuating surface 79. The interior of the dispensing head 70 includes an audible emitting rib 170 shown as an extending projection extending from the rigid top surface 76 of the dispensing head 70 adjacent to the nozzle 80. The audible emitting rib 170 interacts with the plural audible actuator ribs 141 and 142 of the base 60. The audible emitting rib 170 sequentially contacts the plural audible actuator ribs 141 and 142 to produce an audible double click upon rotation of the dispensing head 70 relative to the base 60 when the dispensing head is moved between the locked and unlocked rotational position.

The dispensing head 70 includes the groove rib 180 extending from the inner surface 75 and the rigid top surface 76 of the dispensing head 70. Preferably, the groove rib 180 is formed as a one-piece unit of the actuator button 70. More specifically, the groove rib 180 includes plural grooves 181-184 equally spaced about the axis of symmetry 13 of the trigger operated aerosol dispenser 10. The groove rib 182 is aligned with the nozzle 80.

The plurality of groove ribs 181-184 of the dispensing head 70 are misaligned with the plurality of grooves 151-153 defined by the inner ring 110 of the base 60 when the dispensing head 70 is located in the locked rotational position as shown in FIGS. 19-24.

The plurality of groove ribs 181-184 of the dispensing head 70 are aligned with the plurality of grooves 151-153 defined by the inner ring 110 of the base 60 when the dispensing head 70 is established in the unlocked rotational position as shown in FIGS. 25-34. In the unlocked rotational position, the groove rib 184 is aligned with the bridge 125.

As will be described hereinafter, the groove ribs 183 and 184 interact with the locked position stop 131 and the unlocked position stop 132 of the base stop 130 for establishing the locked rotational position and the unlocked rotational position of the dispensing head 70 relative to the base 60.

Figure 24:
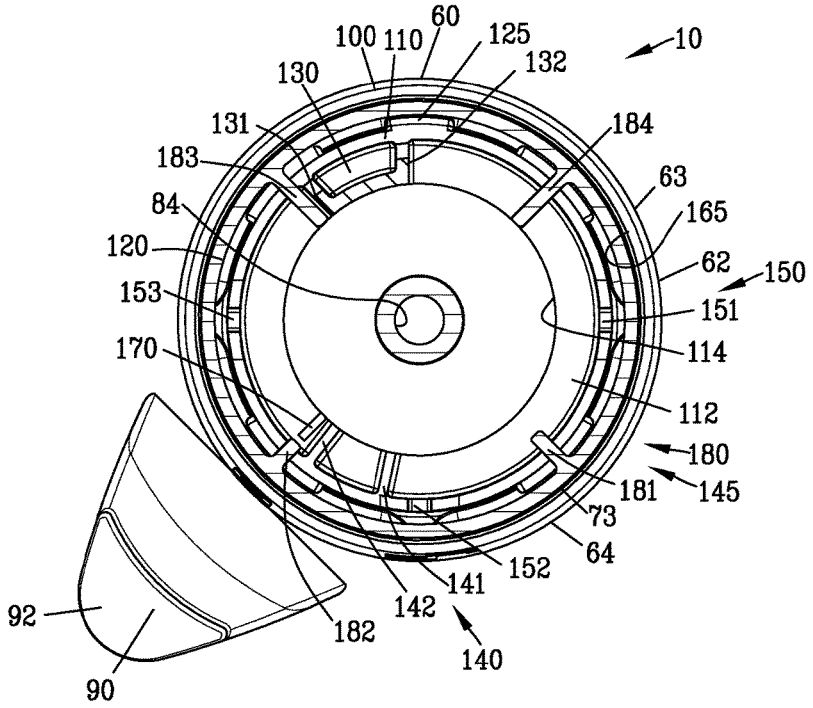
FIG. 24 is a sectional view along line 24-24 in FIG. 21.
Figure 25:
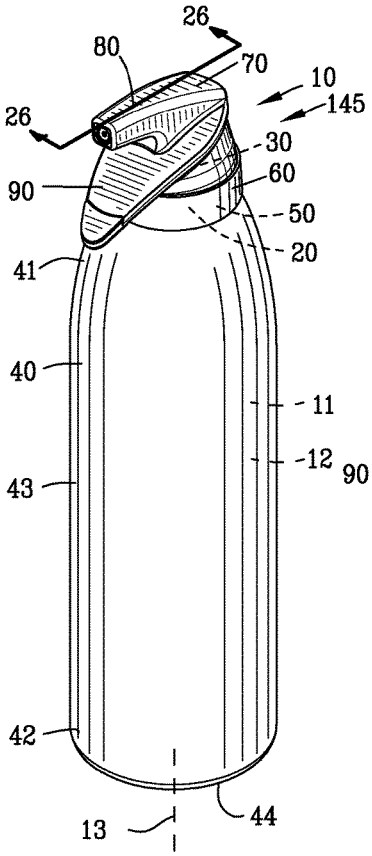
FIG. 25 is a top isometric view similar to FIG. 19 with the dispensing head being located in an unlocked rotational position and in an actuated position.

FIGS. 19-24 are various views of the trigger operated aerosol dispenser 10 of FIGS. 1-6 with the dispensing head 70 being located in the locked rotational position. The dispensing head 70 is rotated clockwise relative to the base 60 until the groove rib 183 of the dispensing head 70 engages the lock position stop 131 of the base 60. During the clockwise rotation of the dispensing head 70 from the unlocked rotational position to the locked rotational position, the audible emitting rib 170 of the dispensing head 70 passes over the plural audible ribs 141 and 142, respectively, to provide two independent audible clicks. As best shown in FIG. 24, the audible emitting rib 170 of the dispensing head 70 cooperates with the audible rib 142 to maintain the dispensing head 70 in the locked rotational position.

When the dispensing head 70 is moved into the locked rotational position, the nozzle 80 is inhibited from actuating the aerosol valve 20. In the locked rotational position, the plurality of groove ribs 181-184 engage with the inner ring 110 of the base 60 to prevent the dispensing head 70 from tilting relative to the base 60.

Figure 31:
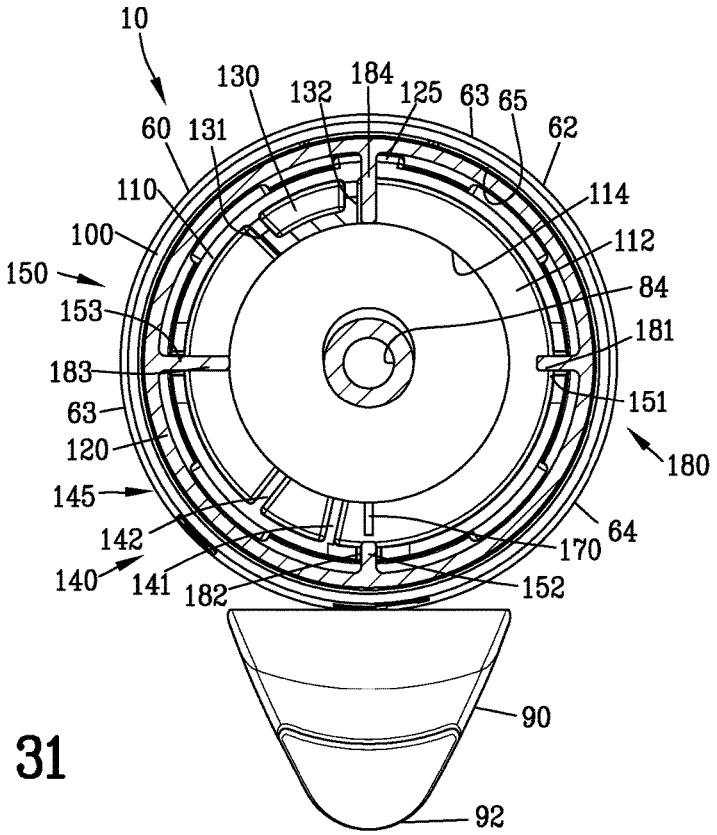
FIG. 31 is a sectional view along line 31-31 in FIG. 28.

FIGS. 25-31 are various views of the trigger operated aerosol dispenser 10 of FIGS. with the dispensing head 70 being located in the unlocked rotational position and with the dispensing head 70 being in an actuated position. The dispensing head 70 has been rotated counterclockwise relative to the base 60 until the groove rib 183 of the dispensing head 70 engages the unlock position stop 132 of the base 60. During the counterclockwise rotation of the dispensing head 70 from the locked rotational position to the unlocked rotational position, the audible emitting rib 170 of the dispensing head 70 passes over the plural audible ribs 142 and 141, respectively, to provide two independent audible clicks. As best shown in FIG. 31, the audible emitting rib 170 of the dispensing head 70 cooperates with the audible rib 141 to maintain the dispensing head 70 in the unlocked rotational position.

When the dispensing head 70 is located in the unlocked rotational position, the plurality of groove ribs 181-183 are aligned with the plurality of grooves 151-153 of the base to enable the dispensing head 70 to tilt relative to the base 60. The groove rib 184 is aligned with the bridge 125. The alignment of the groove ribs 181-183 with the grooves 151-153 permits the dispensing head 70 to be tilted relative to the base 60 to actuate the aerosol valve 20.

Figure 26:
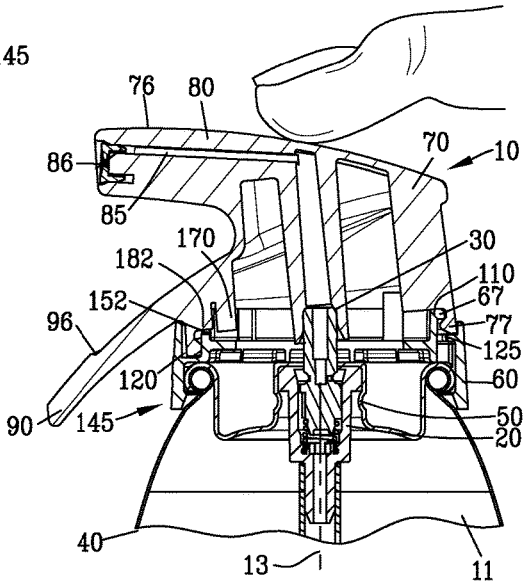
FIG. 26 is an enlarged partial sectional view along line 26-26 in FIG. 25 illustrating the dispensing head being moved into the actuated position by a depression of a top finger actuating surface.

FIG. 26 illustrates the dispensing head 70 being titled into the actuated position by a depression of the top finger actuating surface 79. A depression of the top finger actuating surface 79 by an operator causes the total dispensing head 70 to tilt about the bridge 125. The dispensing head 70 tilts in its entirety as a unit relative to the base 60 as the plurality of groove ribs 181-183 enter the plurality of grooves 151-153 defined in the inner ring 110 of the base 60. The groove rib 184 is aligned with the bridge. A portion of the sidewall 73 of the dispensing head 70 enters the void 120 between the outer ring 100 and the inner ring 110.

Figure 32:
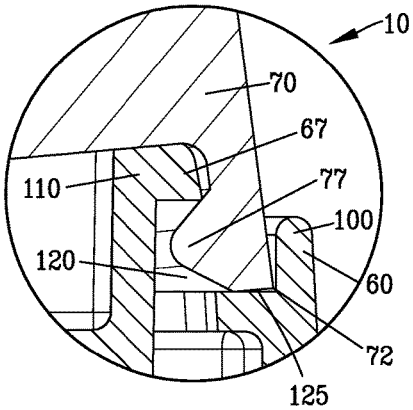
FIG. 32 is a magnified view of a portion of FIG. 26.

FIG. 32 is a magnified view of a portion of FIG. 26 illustrating the tilting of the dispensing head 70 about the bridge 125. The bottom portion 72 of the dispensing head 70 engages the bridge 125 to tilt the nozzle 80 for depressing the valve stem 30 to actuate the aerosol valve 20 thereby dispensing the aerosol product 11.

Figure 27:
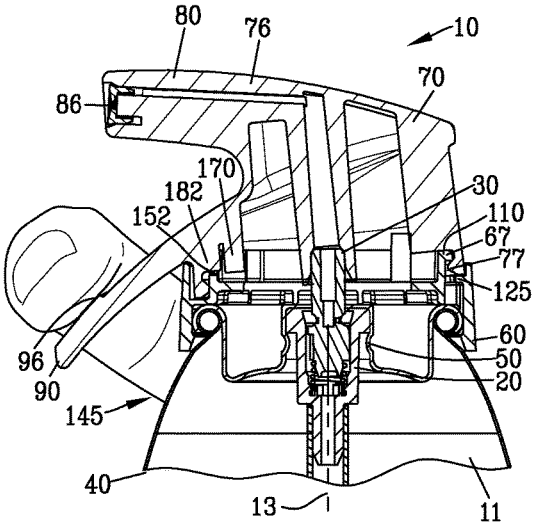
FIG. 27 is a view similar to FIG. 26 illustrating the dispensing head being moved into the actuated position by a trigger actuating surface.
Figure 28:
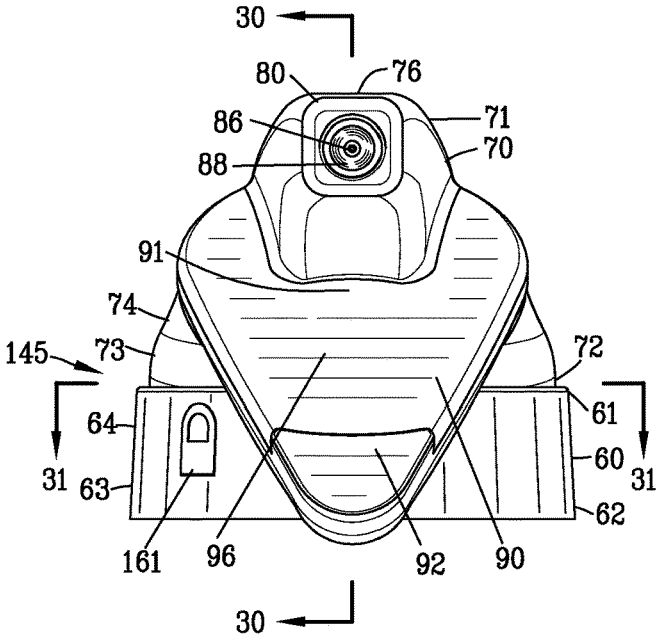
FIG. 28 is an enlarged front view of the improved actuator of FIG. 25.
Figure 29:
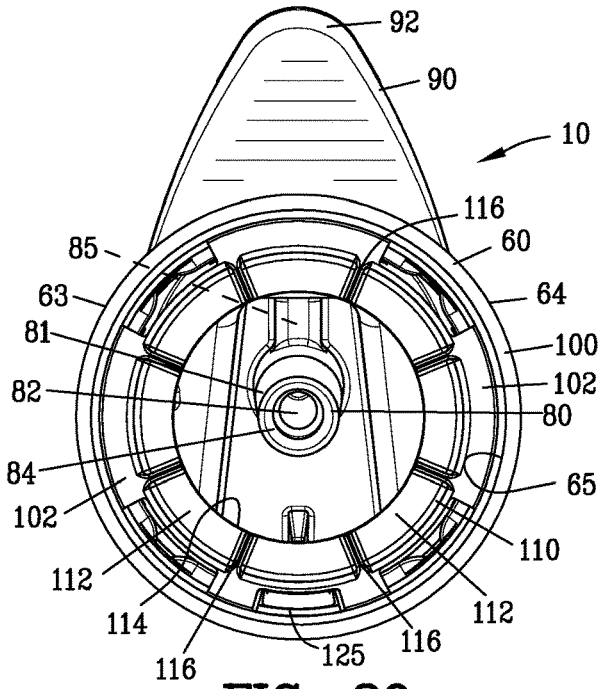
FIG. 29 is a bottom view of FIG. 28.
Figure 30:
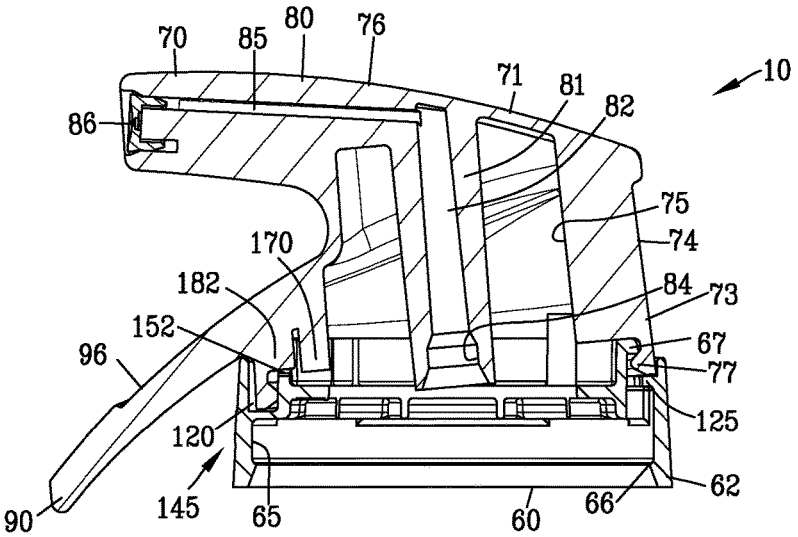
FIG. 30 is a sectional view along line 30-30 in FIG. 28.

FIG. 27 is a view similar to FIG. 26 illustrating the dispensing head 70 being moved into the actuated position by depression of the finger actuating surface 96 of the trigger 90. A depression of the finger actuating surface 96 of the trigger 90 by an operator tilts the dispensing head 70 tilts in its entirety as a unit relative to the base 60 as the plurality of groove ribs 181-183 enter the plurality of grooves 151-153 defined in the inner ring 110 of the base 60. A portion of the sidewall 73 of the dispensing head 70 enters the void 120 between the outer ring 100 and the inner ring 110.

Figure 33:
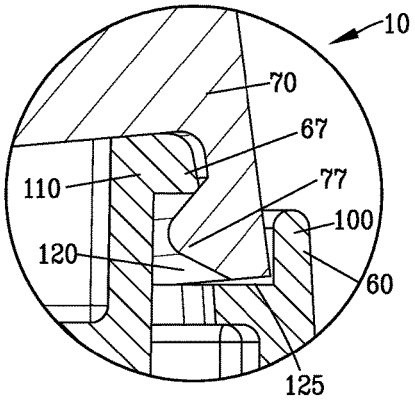
FIG. 33 is a magnified view of a portion of FIG. 27.

FIG. 33 is a magnified view of a portion of FIG. 27 illustrating the tilting of the dispensing head 70. The dispensing head retainer 77 of the dispensing head 70 engages with the base retainer 67 of the base 60 to tilt the nozzle 80 for depressing the valve stem 30 to actuate the aerosol valve 20 thereby dispensing the aerosol product 11.

The improved trigger operated aerosol dispenser 10 of the present invention provides the advantage of a dual actuation aerosol dispenser. The dual actuation enables a user to have the option of two different forms of actuation. For example, an operator may use the finger actuating surface 96 of the trigger 90 for applying a specific product in a one manner using the mechanical advantage to reduce finger fatigue in applying the specific product. However, the same operator may use the top finger actuating surface 79 of the dispensing head 70 for applying the specific product in a different manner. The following TABLE 1 illustrates some examples of the use of the

TABLE 1

| Product | Trigger Actuator | Finger Actuator |
|---|---|---|
| Hairspray | Hairstylists - Others | Self |
| Sunscreen | Body and Back | Face |
| Deodorant | Body | Under Arm |
| Lotions | Body | Face/Arms |
| Lubricants | Large applications | Precise Applications |
| Cooking oils | Pan | Food |
| Fragrances | Body | Head/Neck |
| Household | Large Applications | Local Application |
| Surface cleaning | Countertops | Plumbing fixtures |
| Repellent | Body and Back | Head |
| Laundry | Large Stains | Spot Stains |
| Paint spray | Large Areas | Small Areas |

The different uses of the dual actuation aerosol dispenser of the present invention are too numerous to mention and the immediate advantages of such the dual actuation aerosol dispenser should be readily apparent to those skilled in the art.

Figure 34:
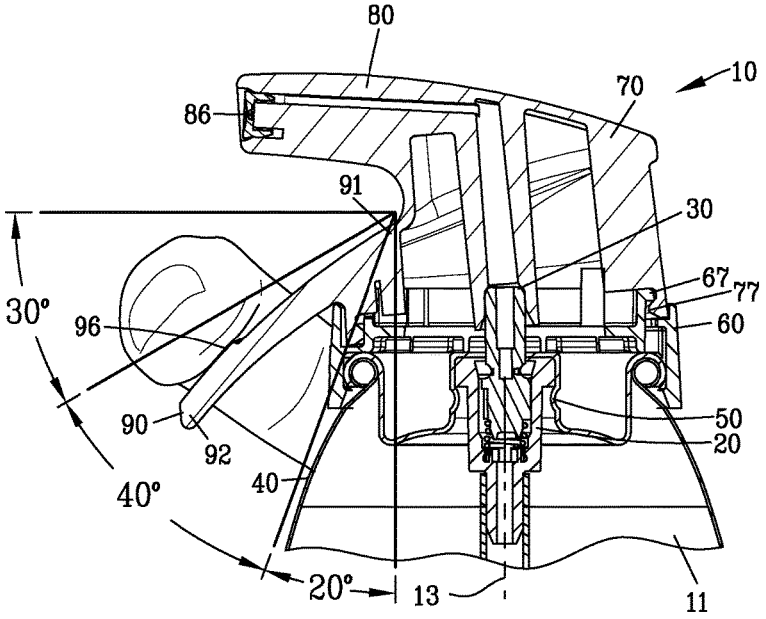
FIG. 34 illustrates a preferred range of angles of the trigger actuator of the dispensing head.
Figure 35:
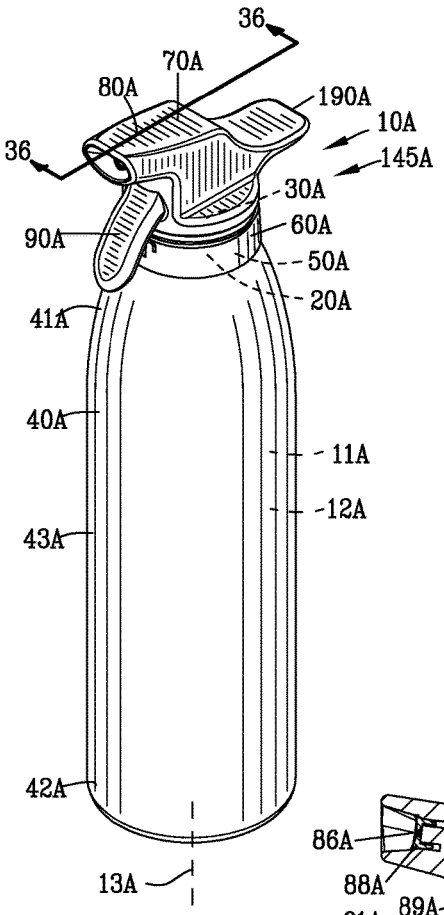
FIG. 35 is a top isometric view of a second embodiment of the trigger operated aerosol dispenser of the present invention located on an aerosol container.
Figure 36:
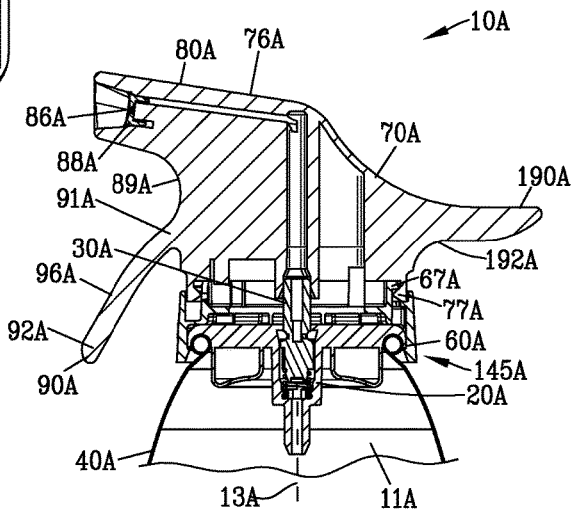
FIG. 36 is an enlarged partial sectional view along line 36-36 in FIG. 35.
Figure 37:
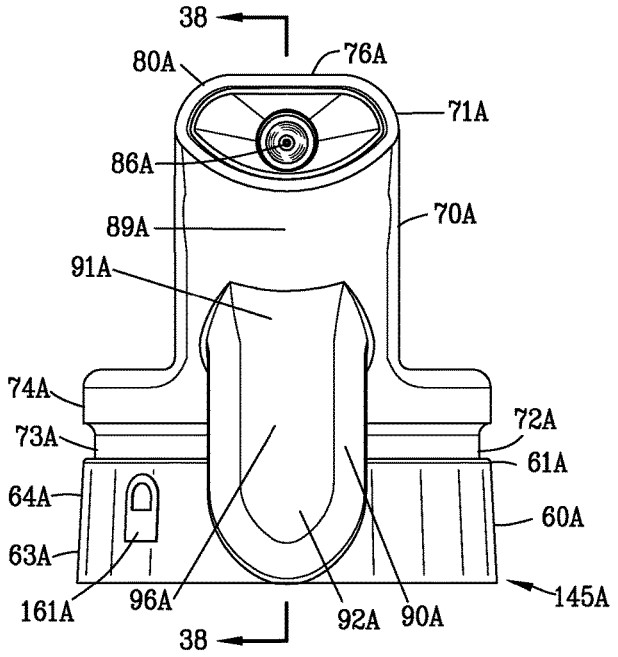
FIG. 37 is an enlarged front view of the trigger operated aerosol dispenser of FIG. 35 shown in an unattended position.
Figure 38:
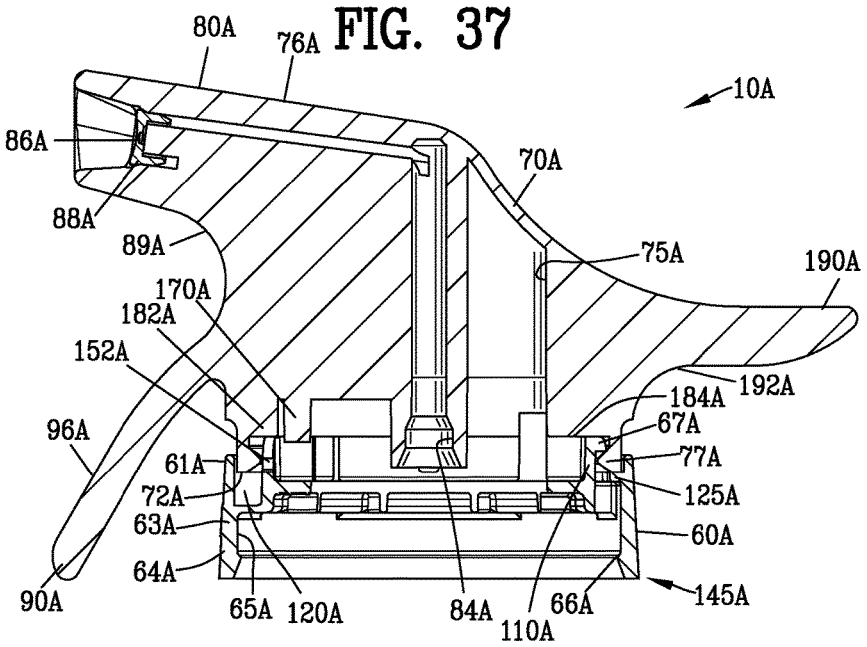
FIG. 38 is a sectional view along line 38-38 in FIG. 37.
Figure 39:
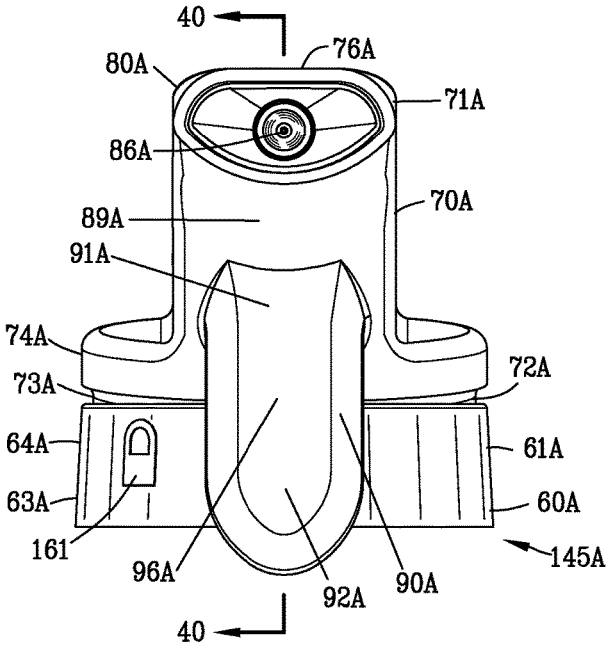
FIG. 39 is a view similar to FIG. 37 with the trigger operated aerosol dispenser shown in an actuated position.
Figure 40:
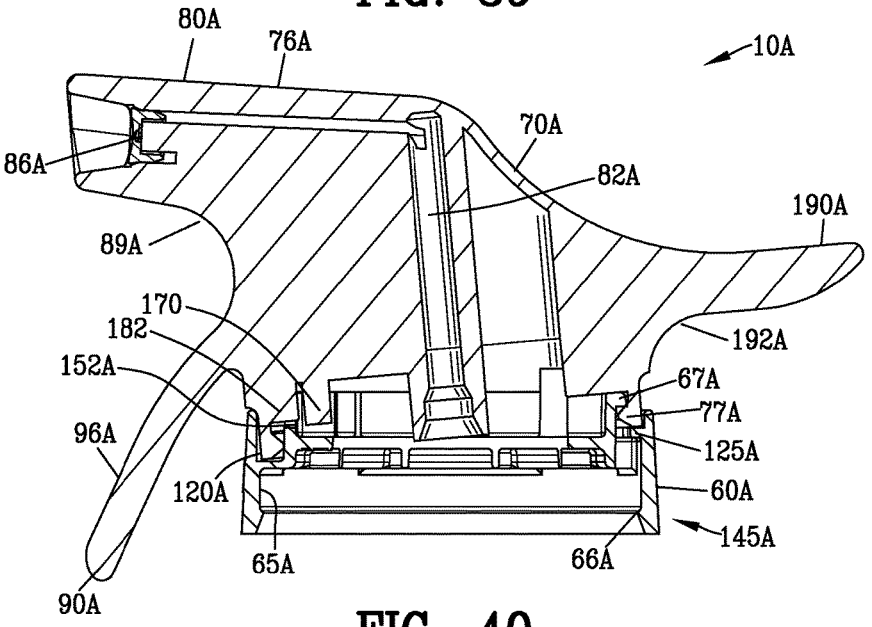
FIG. 40 is a sectional view along line 40-40 in FIG. 39.
Figure 41:
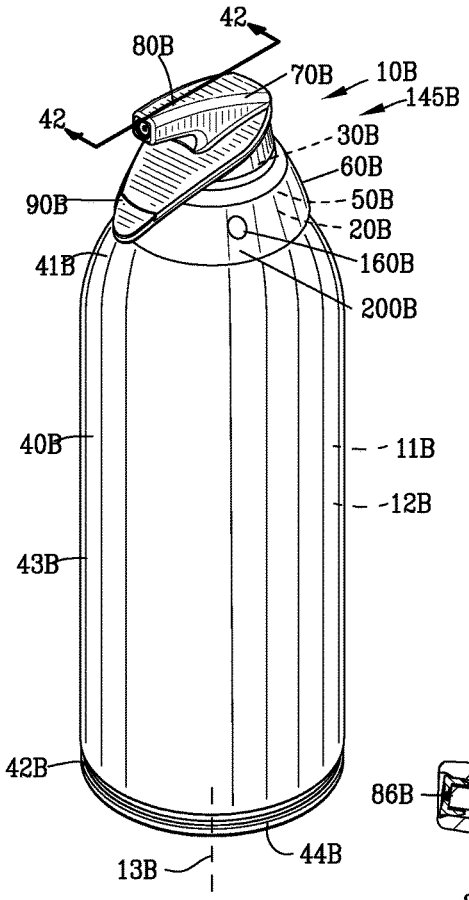
FIG. 41 is a top isometric view of a third embodiment of the trigger operated aerosol dispenser of the present invention located on an aerosol container.
Figure 42:
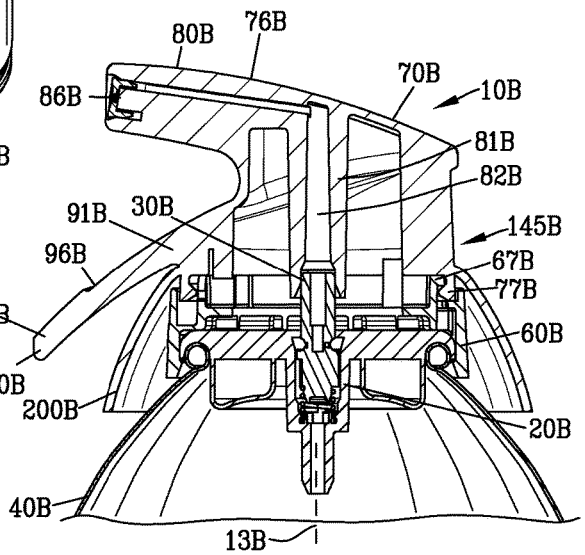
FIG. 42 is an enlarged partial sectional view along line 42-42 in FIG. 41.
Figure 43:
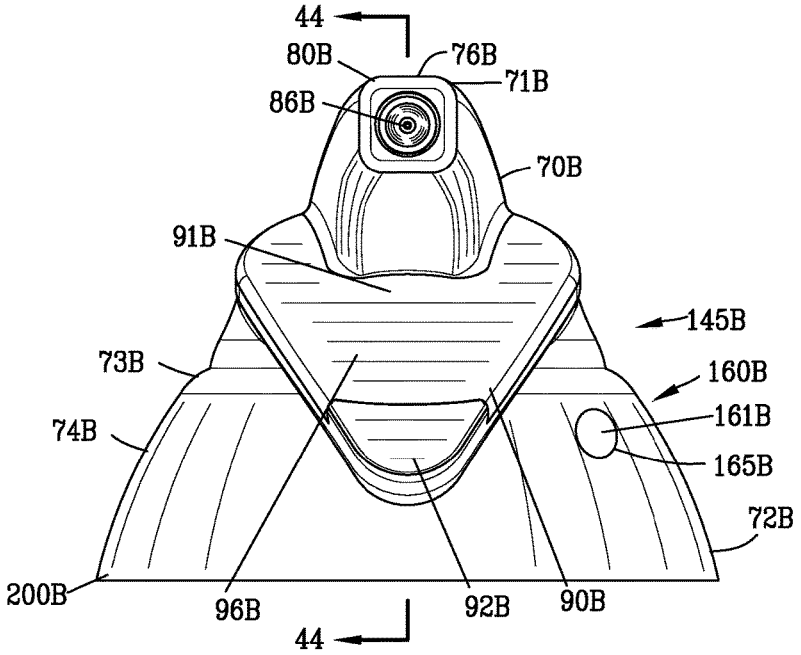
FIG. 43 is an enlarged front view of the trigger operated aerosol dispenser of FIG. 41 shown in an unattended position.
Figure 44:
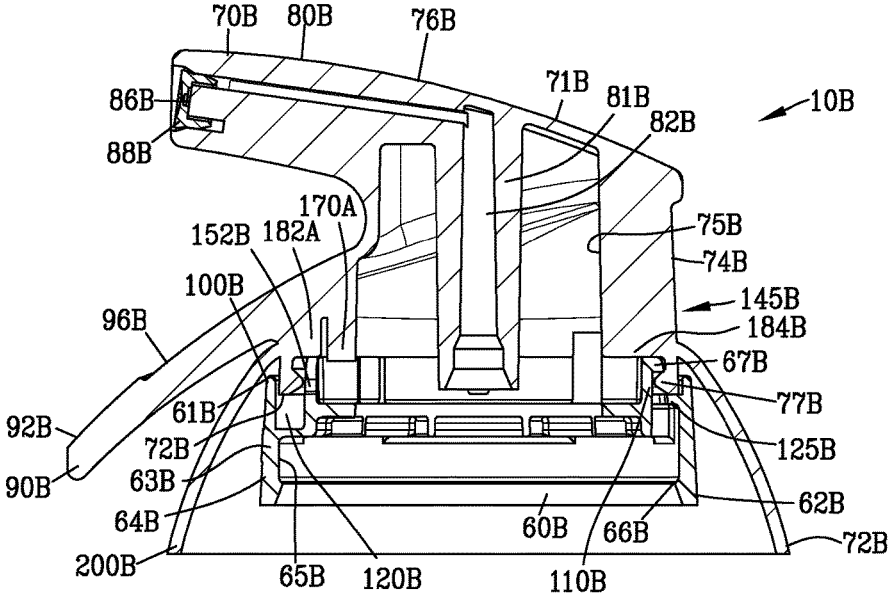
FIG. 44 is a sectional view along line 44-44 in FIG. 43.
Figure 45:
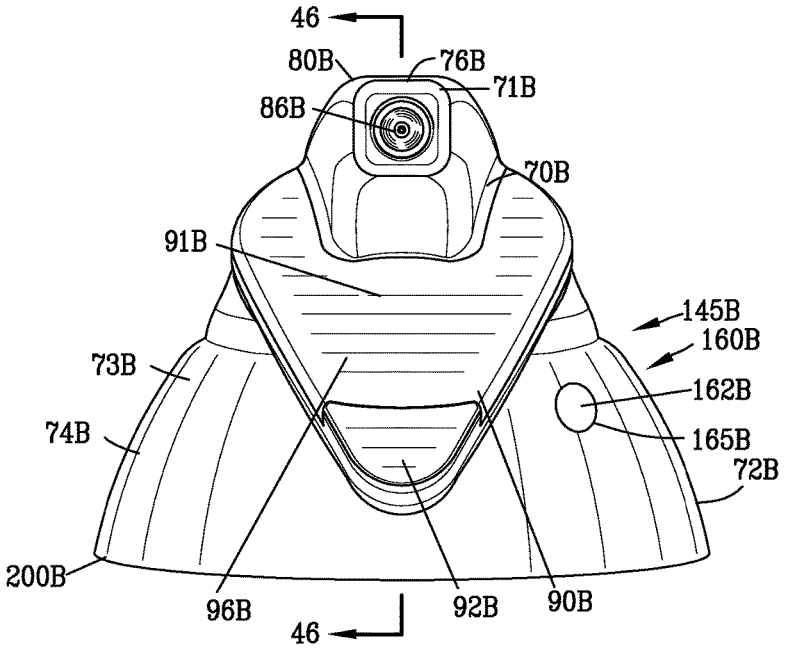
FIG. 45 is a view similar to FIG. 43 with the trigger operated aerosol dispenser shown in an actuated position.
Figure 46:
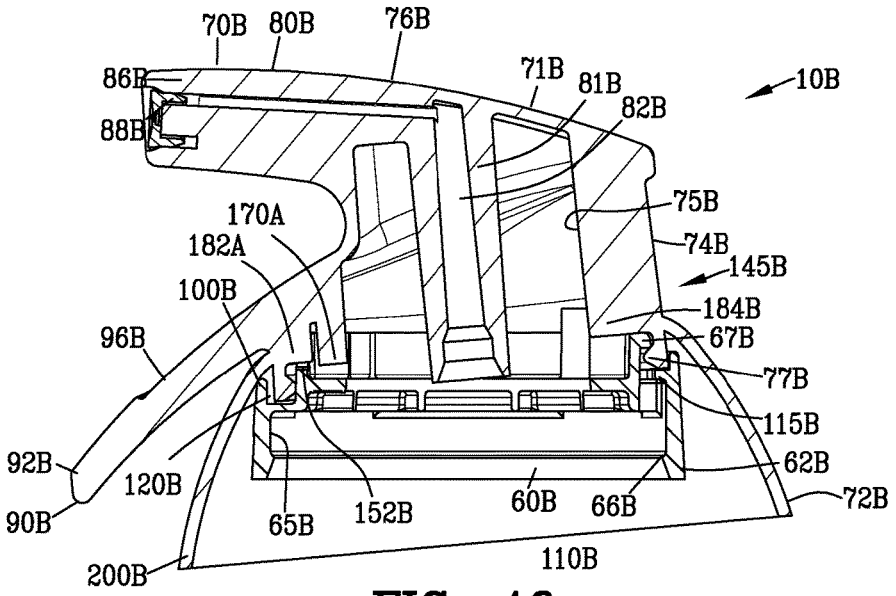
FIG. 46 is a sectional view along line 46-46 in FIG. 45.
Figure 47:
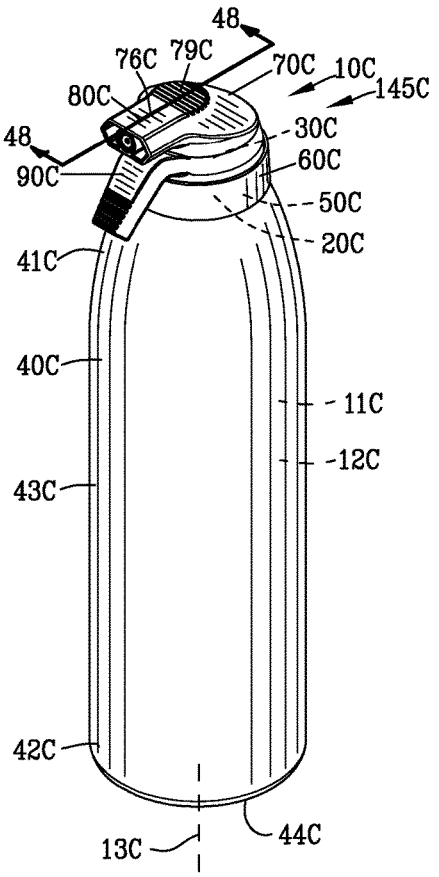
FIG. 47 is a top isometric view of a fourth embodiment of the trigger operated aerosol dispenser of the present invention located on an aerosol container.
Figure 48:
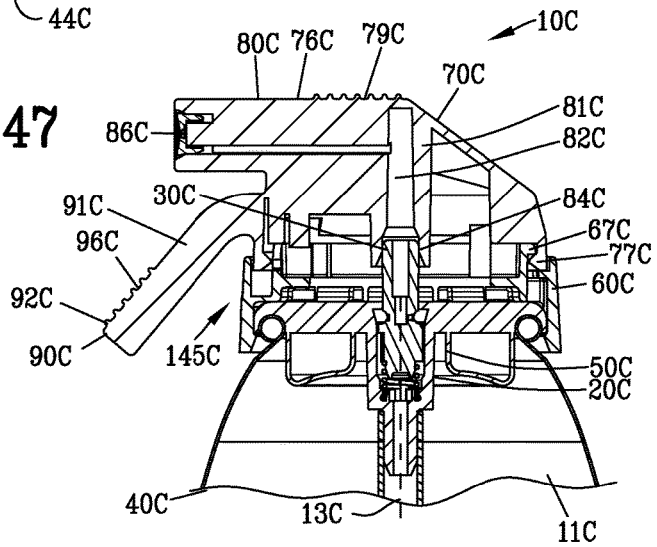
FIG. 48 is an enlarged partial sectional view along line 48-48 in FIG. 47.
Figure 49:
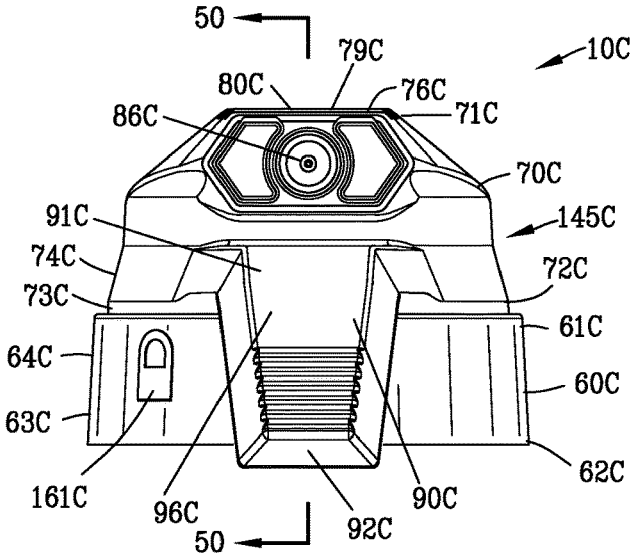
FIG. 49 is an enlarged front view of the trigger operated aerosol dispenser of FIG. 47 shown in an unattended position.
Figure 50:
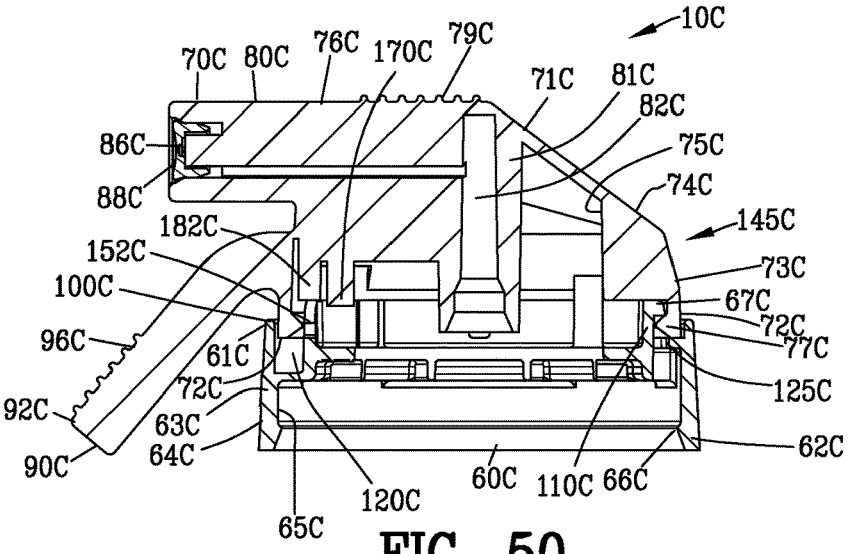
FIG. 50 is a sectional view along line 50-50 in FIG. 49.
Figure 51:
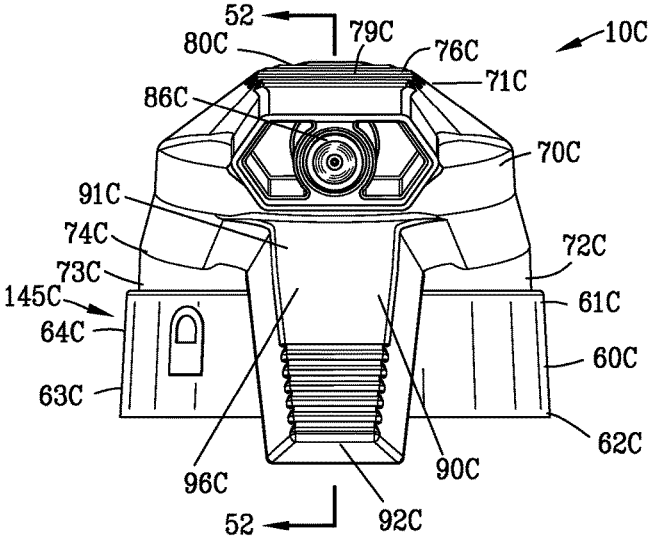
FIG. 51 is a view similar to FIG. 49 with the trigger operated aerosol dispenser shown in an actuated position.
Figure 52:
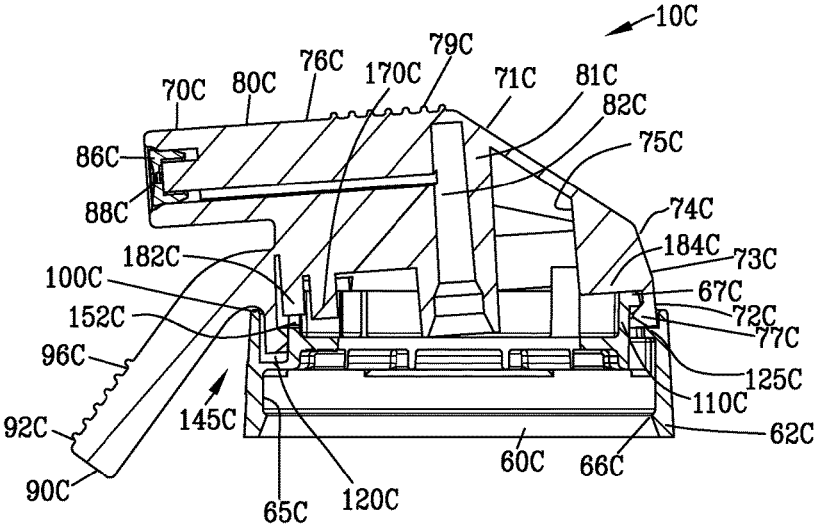
FIG. 52 is a sectional view along line 52-52 in FIG. 51.
Figure 53:
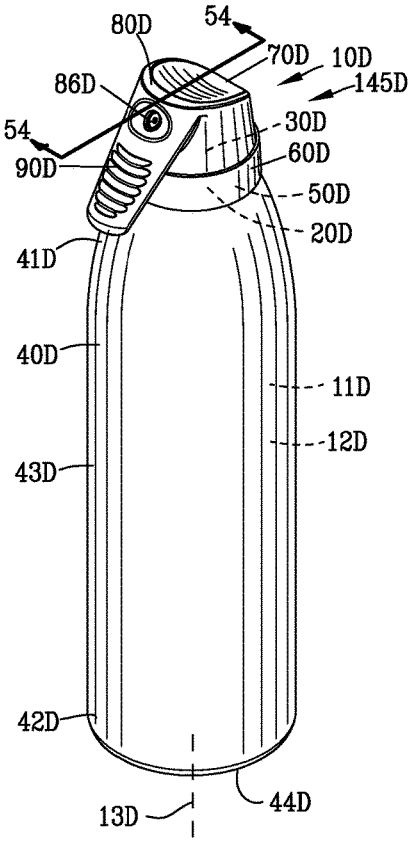
FIG. 53 is a top isometric view of a fifth embodiment of the trigger operated aerosol dispenser of the present invention located on an aerosol container.
Figure 54:
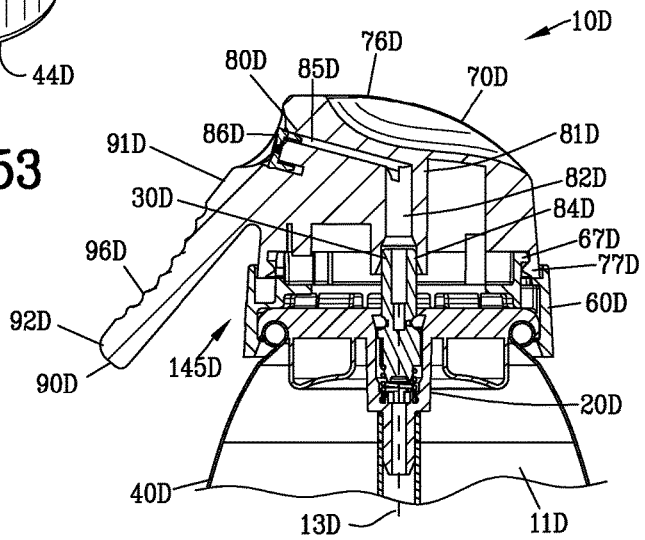
FIG. 54 is an enlarged partial sectional view along line 54-54 in FIG. 53.
Figure 55:
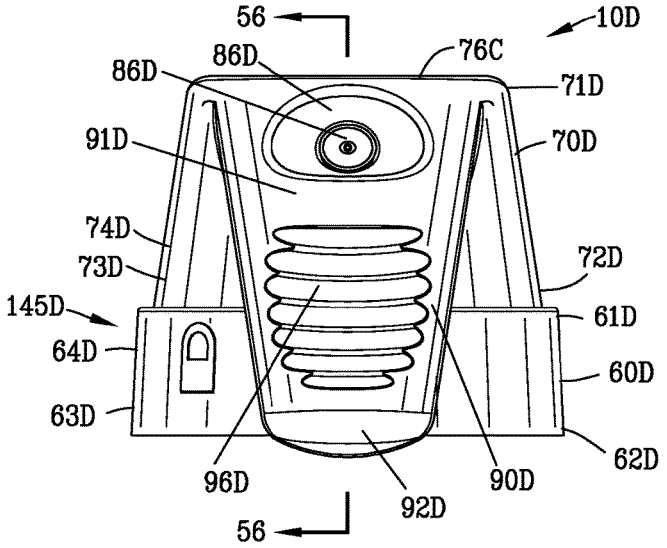
FIG. 55 is an enlarged front view of the trigger operated aerosol dispenser of FIG. 54 shown in an unattended position.
Figure 56:
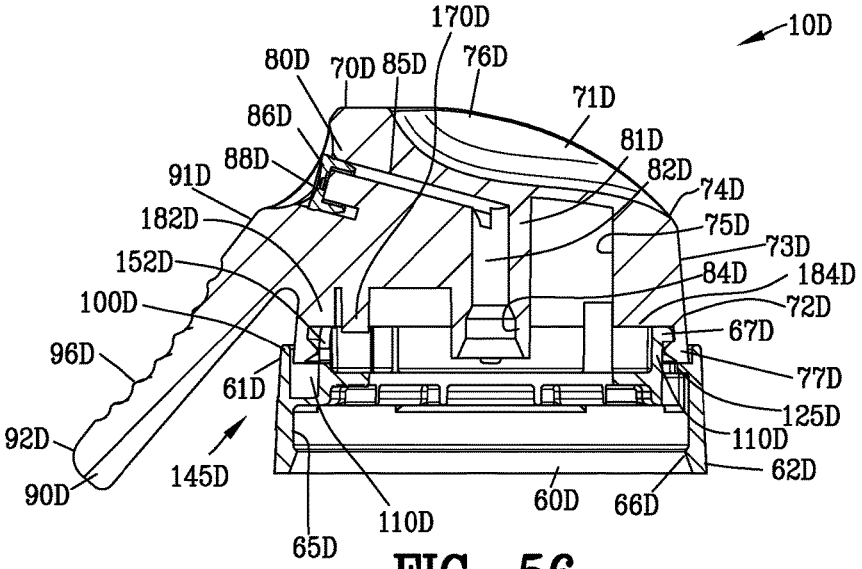
FIG. 56 is a sectional view along line 56-56 in FIG. 55.
Figure 57:
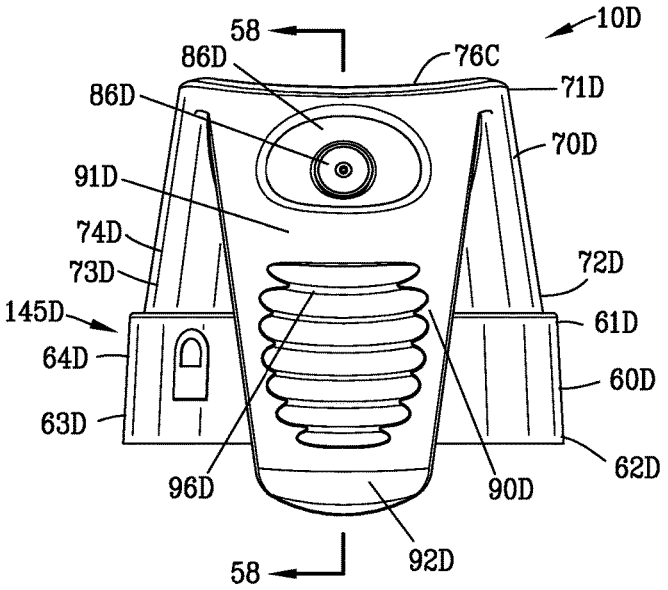
FIG. 57 is a view similar to FIG. 55 with the trigger operated aerosol dispenser shown in an actuated position.
Figure 58:
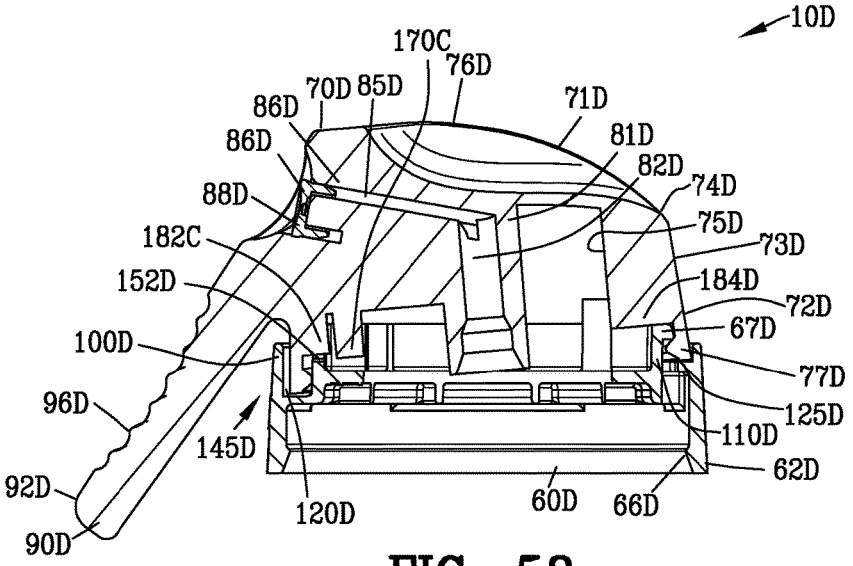
FIG. 58 is a sectional view along line 58-58 in FIG. 51.
Figure 59:
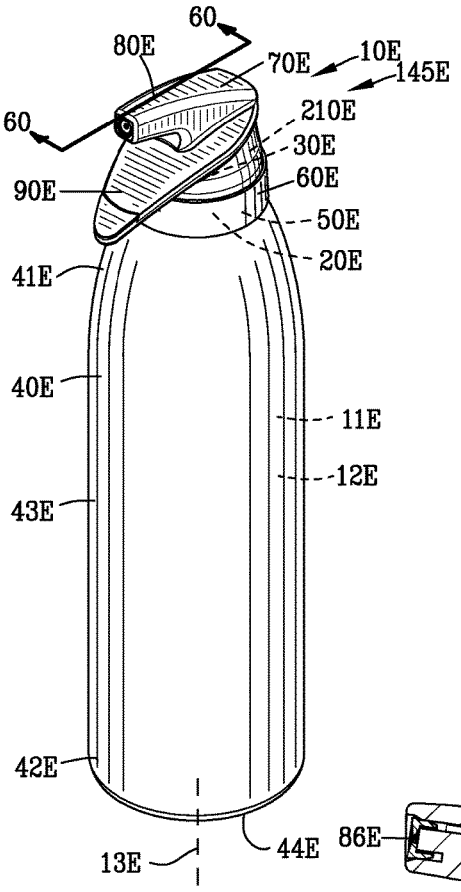
FIG. 59 is a top isometric view of a sixth embodiment of the trigger operated aerosol dispenser of the present invention located on an aerosol container.
Figure 60:
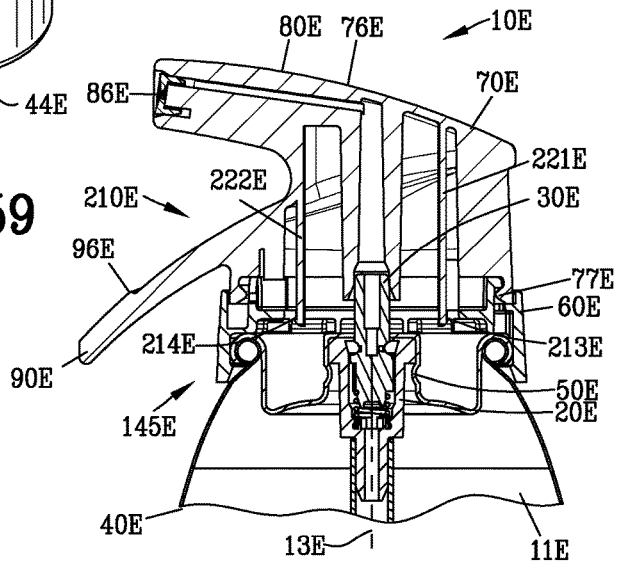
FIG. 60 is an enlarged partial sectional view along line 60-60 in FIG. 59.
Figure 61:
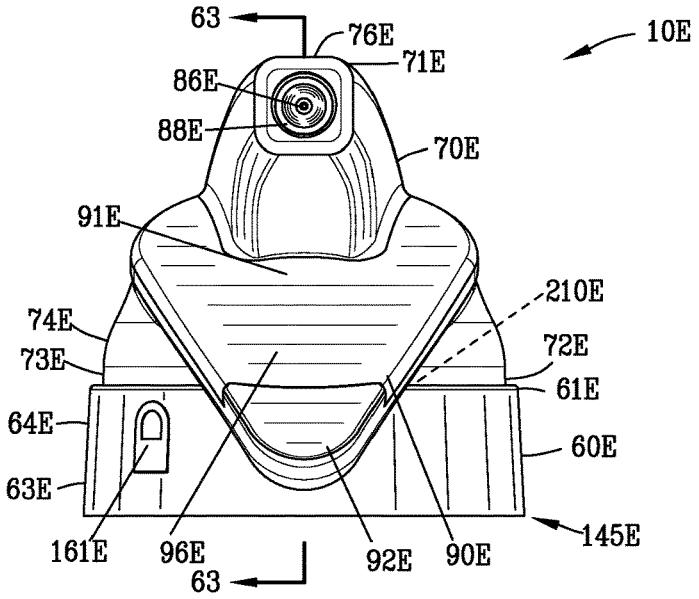
FIG. 61 is an enlarged front view of the trigger operated aerosol dispenser of FIG. 59 shown in an unlocked position.
Figure 62:
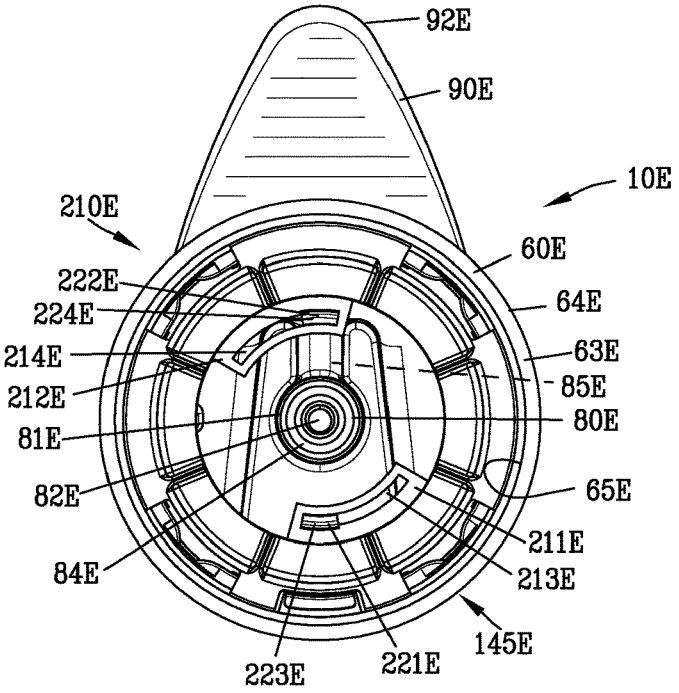
FIG. 62 is a bottom view of in FIG. 61.
Figure 63:
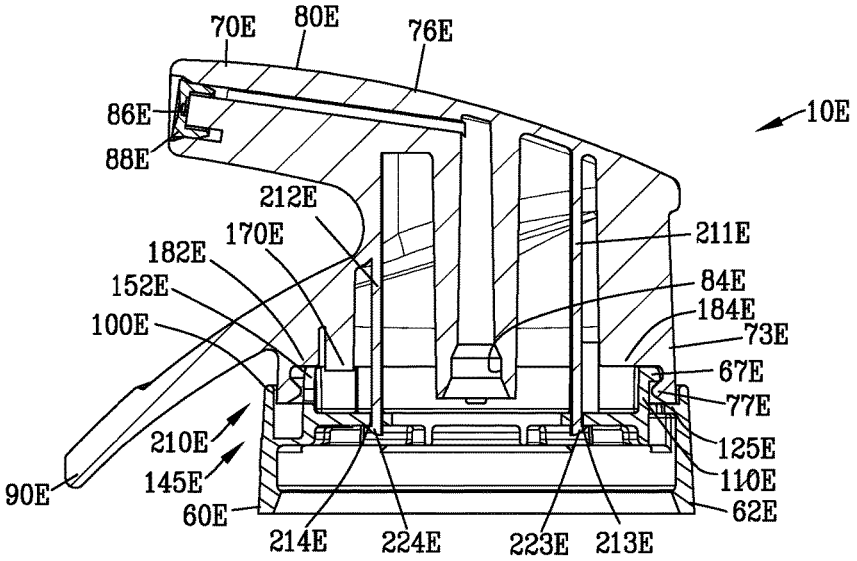
FIG. 63 is a sectional view along line 63-63 in FIG. 61.
Figure 63A:
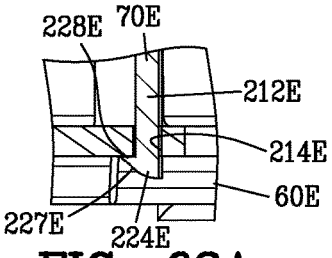
FIG. 63A is a magnified view of a left portion of FIG. 63.
Figure 63B:
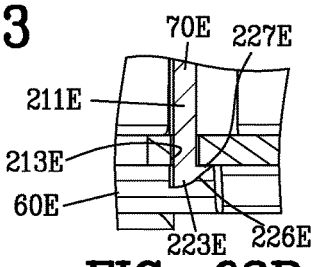
FIG. 63B is a magnified view of a right portion of FIG. 63.
Figure 64:
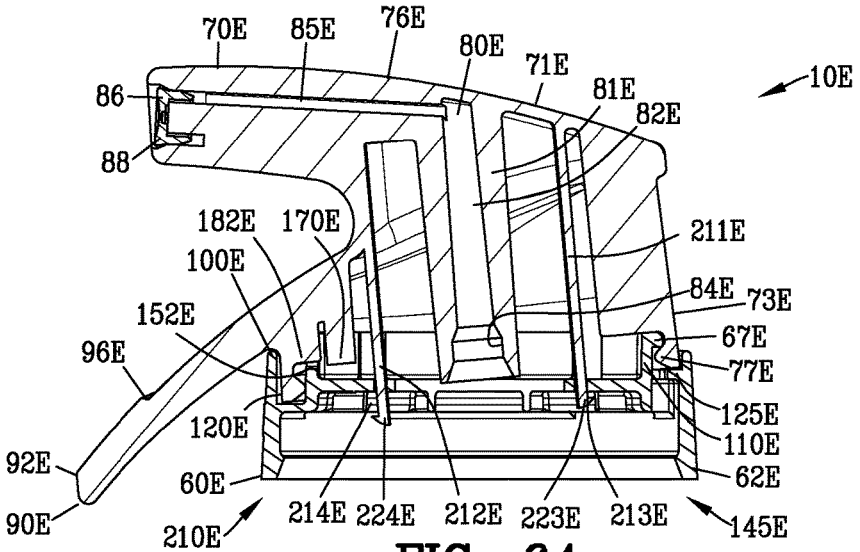
FIG. 64 is a view similar to FIG. 63 with the trigger operated aerosol dispenser shown in an actuated position.
Figure 65:
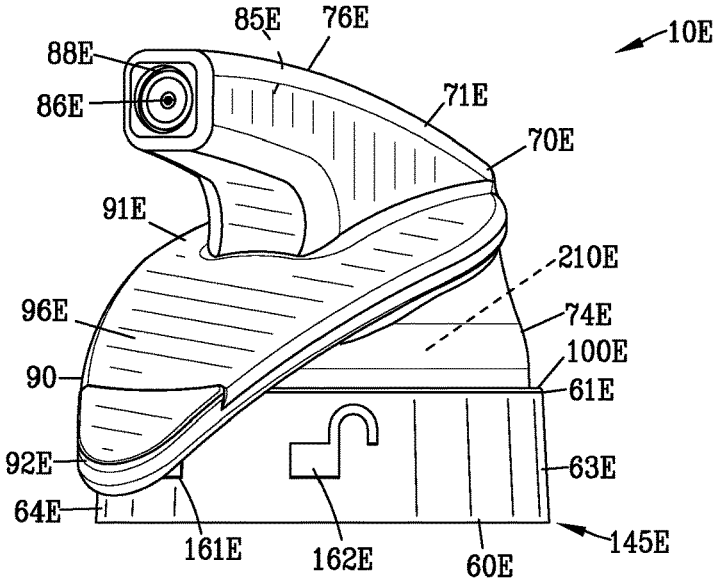
FIG. 65 is an enlarged front view of the trigger operated aerosol dispenser of FIG. 61 shown in a locked position.
Figure 66:
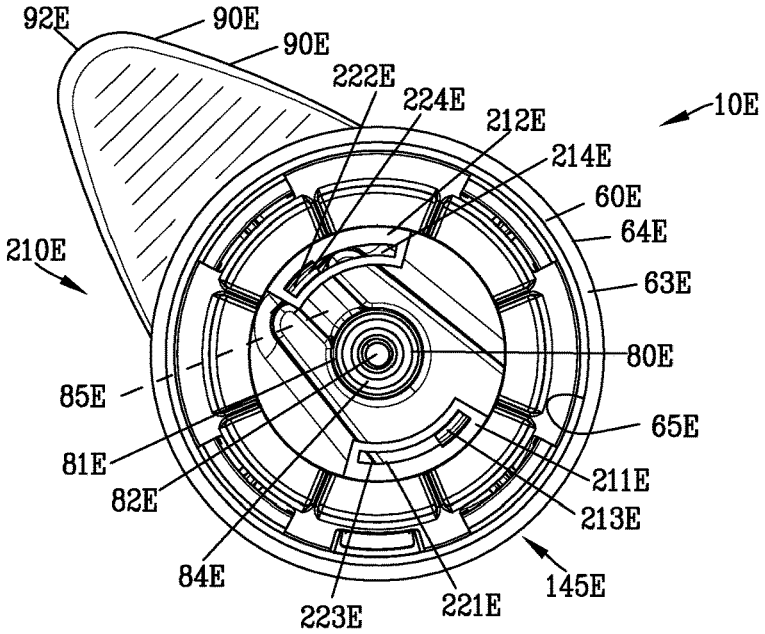
FIG. 66 is a bottom view of in FIG. 65.
Figure 67:
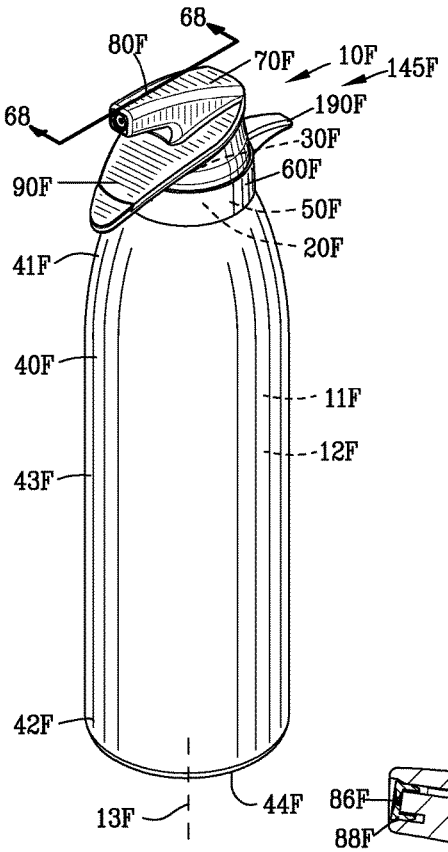
FIG. 67 is a top isometric view of a seventh embodiment of the trigger operated aerosol dispenser of the present invention located on an aerosol container.
Figure 68:
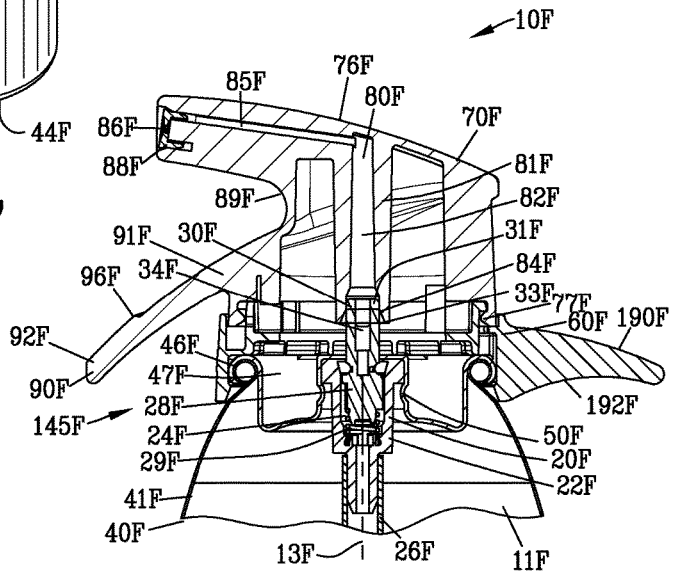
FIG. 68 is an enlarged partial sectional view along line 68-68 in FIG. 67.
Figure 69:
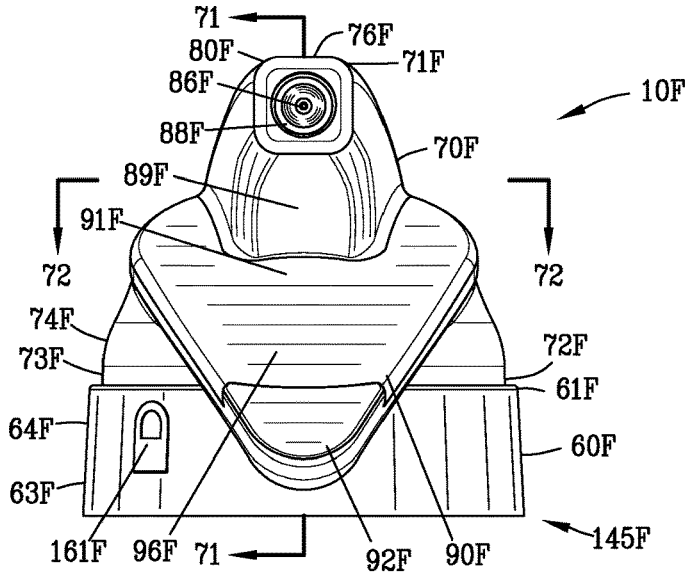
FIG. 69 is an enlarged front view of the trigger operated aerosol dispenser of FIG. 68 shown in an unlocked position.
Figure 70:
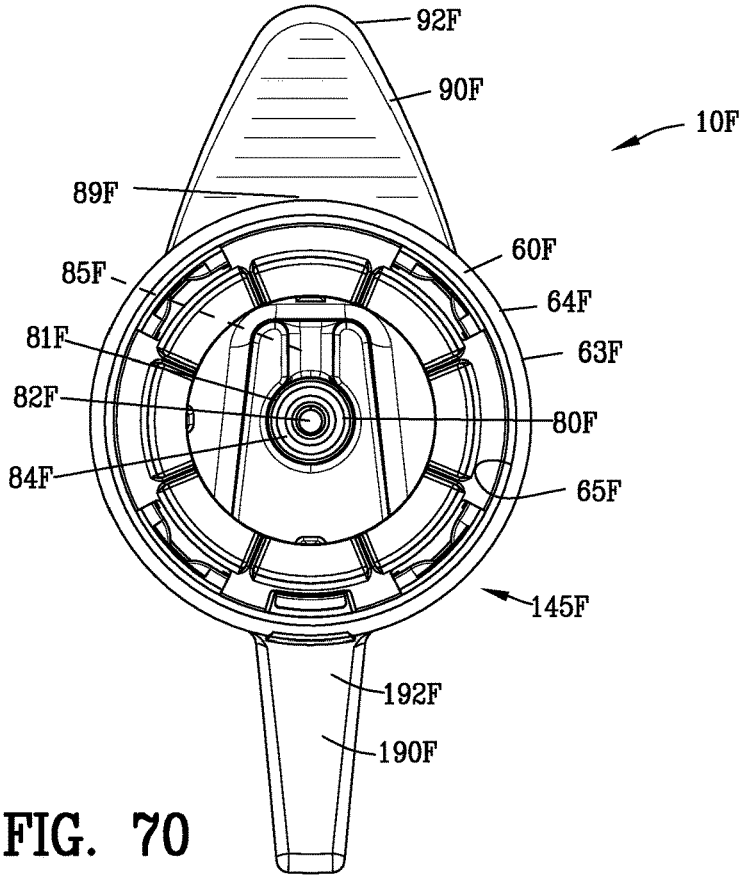
FIG. 70 is a bottom view of in FIG. 69.
Figure 71:
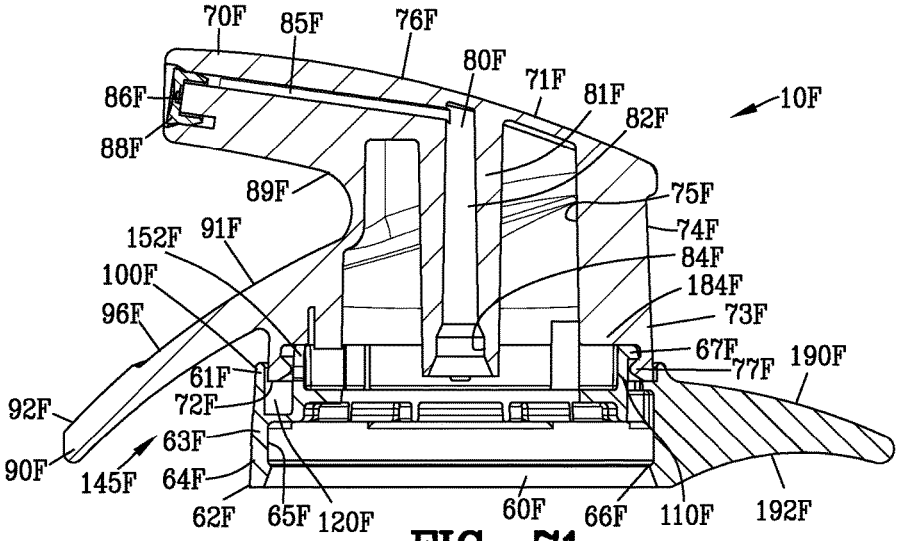
FIG. 71 is a sectional view along line 71-71 in FIG. 69.
Figure 72:
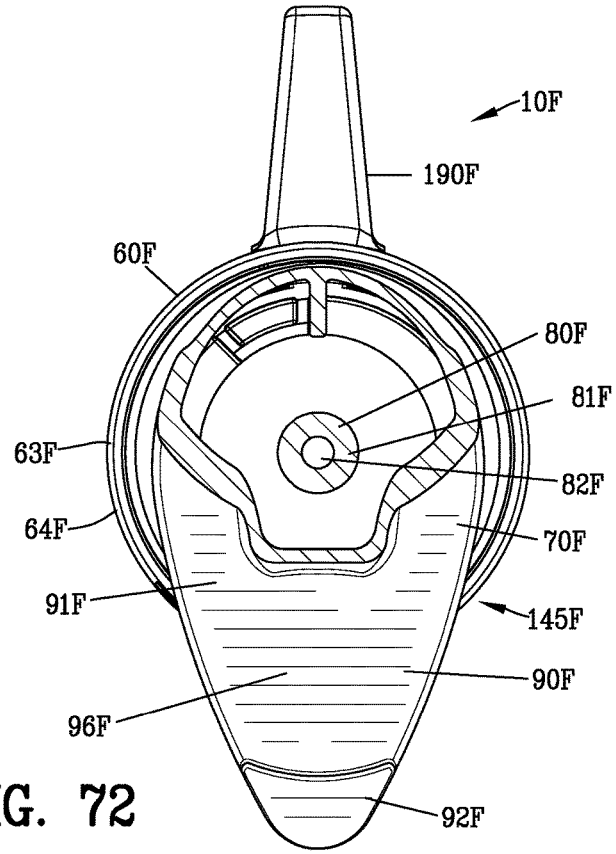
FIG. 72 is a sectional view along line 72-72 in FIG. 69.
Figure 73:
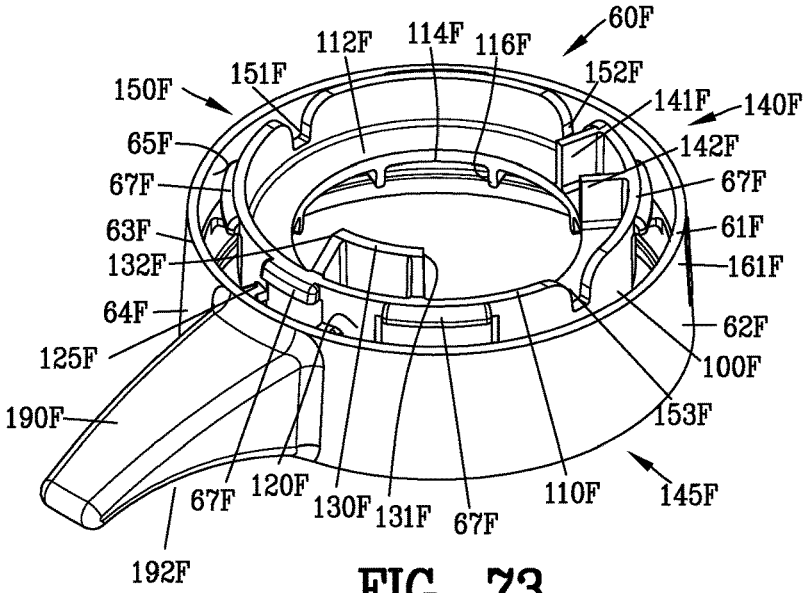
FIG. 73 is a top isometric view of a base of the trigger operated aerosol dispenser of FIGS. 67-72.
Figure 74:
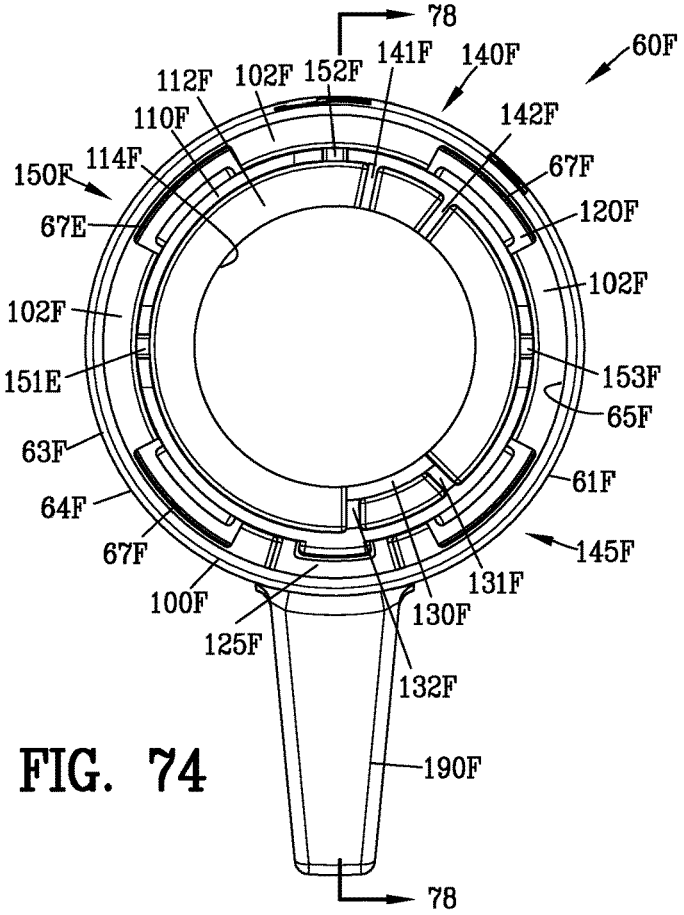
FIG. 74 is a top view of the base shown in of FIGS. 67-72.
Figure 75:
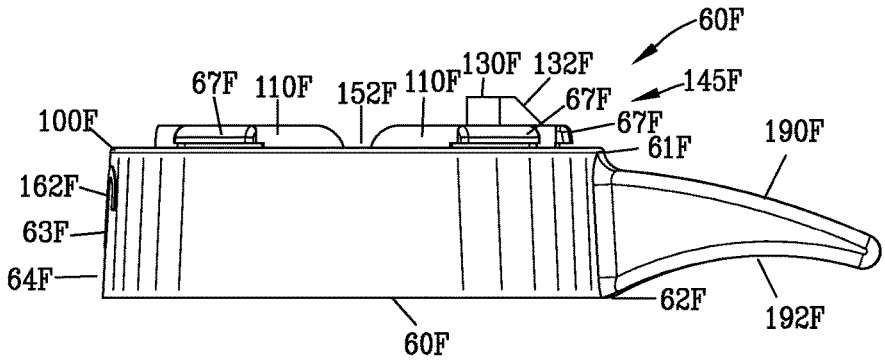
FIG. 75 is a left side view of the base of FIG. 74.
Figure 76:
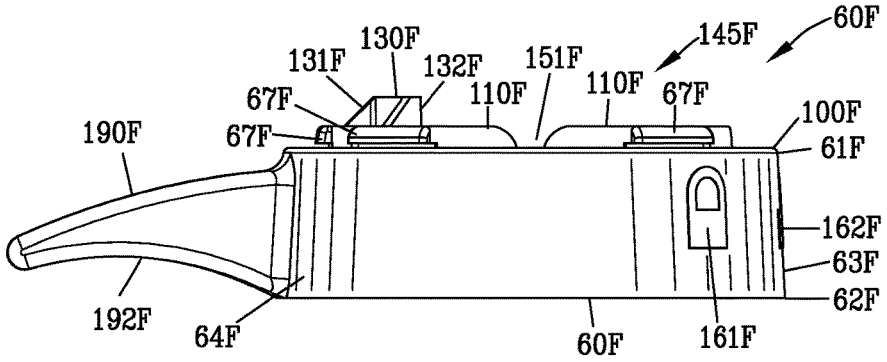
FIG. 76 is a tight side view of the base of FIG. 74.
Figure 77:
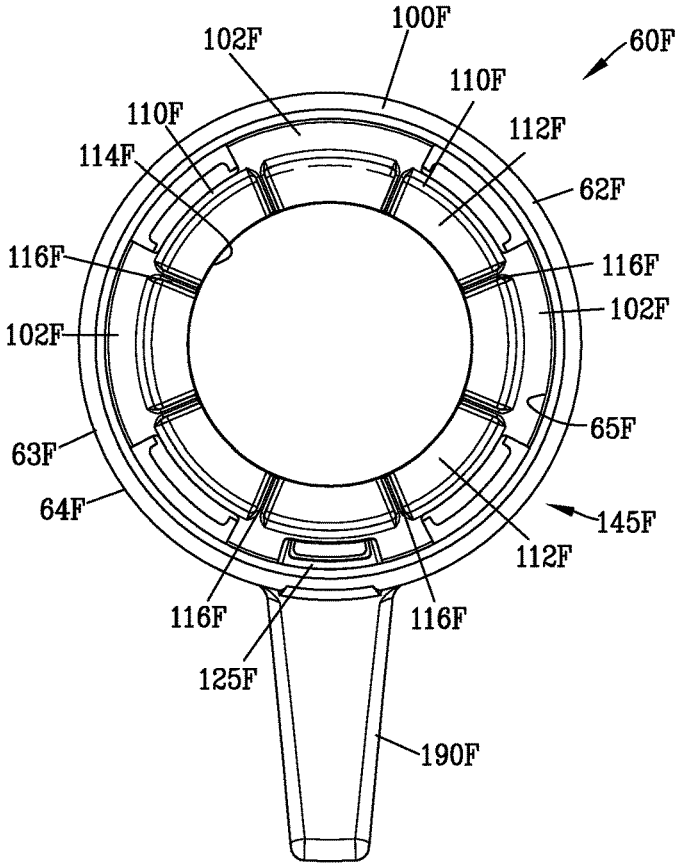
FIG. 77 is a bottom view of FIG. 74.
Figure 78:
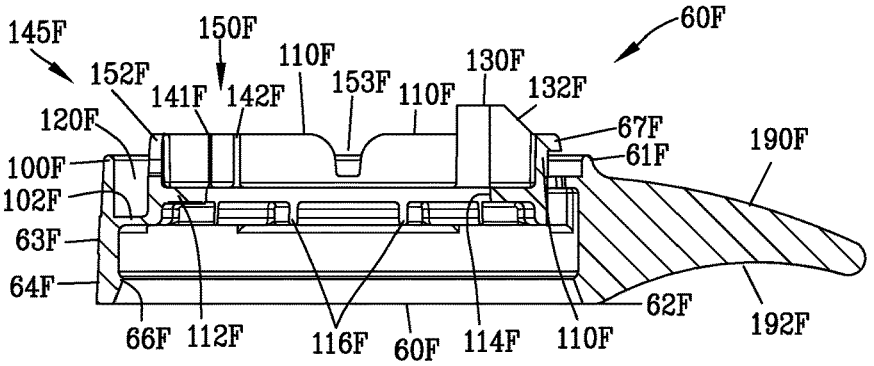
FIG. 78 is a sectional view along line 78-78 in FIG. 74.

FIG. 34 illustrates a preferred range of angles of the trigger actuator 90 of the dispensing head 70. Although the trigger actuator 90 may be oriented at various angles relative to the axis of symmetry 13, thirty degrees (30°) to seventy degrees (70°) appears to be a preferred angle of orientation as shown in FIG. 34.

The trigger actuator 90 of the dispensing head 70 of the present invention provides several advantages over the prior art. Firstly, the trigger actuator 90 is unitary with the dispensing head 70 to move as a one piece unit. The trigger actuator 90 of the present invention has no lost motion found in many articulated trigger assemblies of the prior art. Secondly, no assembly is required to affix the trigger actuator 90 to the dispensing head 70. Thirdly, the trigger actuator 90 of the present invention exhibits a lower force to actuate relative to the prior art.

TABLE 2 sets forth the force to actuate test for samples of the present invention and competitive example of the prior art.

| UNIT TESTED | Trigger Force (pounds) | Travel Distance (Inches) |
|---|---|---|
| Trigger Actuator (Test 1) | 2.30 | 0.040 |
| Trigger Actuator (Test 2) | 2.05 | 0.040 |
| Trigger Actuator (Test 3) | 2.30 | 0.040 |
| Competitor 1 | 6.95 | 0.150 |
| Competitor 2 | 6.65 | 0.150 |
| Competitor 3 | 6.70 | 0.150 |

Fourthly, the lower force to actuate of the trigger actuator 90 of the present invention results in a reduction of the structures and the material required to provide a functional aerosol dispenser. The trigger actuator 90 of the present invention may be used with a wide variety of aerosol products including personal care products, household products, industrial products, food products, healthcare, automotive and the like.

FIGS. 35-40 are various views of a second embodiment of the trigger operated aerosol dispenser 10A of the present invention located on an aerosol container 40A. The second embodiment of the trigger operated aerosol dispenser 10A is similar to the first embodiment of the trigger operated aerosol dispenser 10 of FIGS. 1-34 with similar parts labeled with similar references numbers with the addition of the alphabetical character A.

The second embodiment of the trigger operated aerosol dispenser 10A comprises a base 60A and a dispensing head 70A. The nozzle 80A of the dispensing head 70A defines a nozzle cradle surface 89A. The dispensing head 70A includes an overhang 190A defining an overhang cradle surface 192A. The nozzle cradle surface 89A operates in concert with the overhang cradle surface 192A to provide a hand support for an operator. The index finger (not shown) engages with the nozzle cradle surface 89A with the web (not shown) between the index finger and the thumb engaging with the overhang cradle surface 192A for enabling the hand of the operator (not shown) to ergonomically hold the trigger operated aerosol dispenser 10A. Furthermore, the index finger of the operator is conveniently located to actuate the trigger actuator 90A of the trigger operated aerosol dispenser 10A.

FIGS. 41-46 are various views of a third embodiment of the trigger operated aerosol dispenser 10B of the present invention located on an aerosol container 40B. The third embodiment of the trigger operated aerosol dispenser 10B is similar to the first embodiment of the trigger operated aerosol dispenser 10 of FIGS. 1-34 with similar parts labeled with similar references numbers with the addition of the alphabetical character B.

The aerosol container 40B is shown as a DS container manufactured by the DS Containers of Batavia, Ill. The dispensing head 70B includes a depending skirt 200B extending from the sidewall 74B of the dispensing head 70. The depending skirt 200B is tapered to conform to the contour of the upper portion of the DS container while covering the base 60B. Preferably, the depending skirt 200B is unitary with the dispensing head 70.

The rotational indicator 160B includes a through aperture forming a window 165B defined in the depending skirt 200B. The window 1651 enables an operator the view the rotational position indicators 161B and 162B located on the outer surface 64 of the base 60B. The locked rotational position indicator 161B appears in the window 165B in FIG. 43 whereas the unlocked rotational position indicator 162B appears in the window 165B in FIG. 45.

FIGS. 47-52 are various views of a fourth embodiment of the trigger operated aerosol dispenser 10C of the present invention located on an aerosol container 40C. The fourth embodiment of the trigger operated aerosol dispenser 10C is similar to the first embodiment of the trigger operated aerosol dispenser 10 of FIGS. 1-34 with similar parts labeled with similar references numbers with the addition of the alphabetical character C.

The dispensing head 70C defines a substantially flat and horizontal top surface 76C. The top finger actuating surface 79C is defined within the substantially flat and horizontal top surface 76C. The substantially flat and horizontal top surface 76C facilitates the shipping of the trigger operated aerosol dispenser 10C by enabling the trigger operated aerosol dispenser 10C to be packaged in a stacked relationship. The substantially flat and horizontal top surfaces 76C of a lower tier of trigger operated aerosol dispensers 10C provide a flat surface for supporting an upper tier of trigger operated aerosol dispensers 10C.

FIGS. 53-58 are various views of a fifth embodiment of the trigger operated aerosol dispenser 10D of the present invention located on an aerosol container 40D. The fifth embodiment of the trigger operated aerosol dispenser 10D is similar to the first embodiment of the trigger operated aerosol dispenser 10 of FIGS. 1-34 with similar parts labeled with similar references numbers with the addition of the alphabetical character D.

In the fifth embodiment, the terminal orifice 86D is recess into the sidewall 73 of the dispensing head 70D. The fifth embodiment provides a small trigger operated aerosol dispenser 10D suitable for use with small aerosol containers 40D. Furthermore, the fifth embodiment of the trigger operated aerosol dispenser 10D uses a minimum amount of material providing a low cost trigger operated aerosol dispenser 10D.

FIGS. 59-66 are various views of a sixth embodiment of the trigger operated aerosol dispenser 10E of the present invention located on an aerosol container 40E. The sixth embodiment of the trigger operated aerosol dispenser 10E is similar to the first embodiment of the trigger operated aerosol dispenser 10 of FIGS. 1-34 with similar parts labeled with similar references numbers with the addition of the alphabetical character E.

The sixth embodiment of the trigger operated aerosol dispenser 10E incorporates an auxiliary latching mechanism 210E. The auxiliary latching mechanism 210E inhibits separation of the dispensing head 70E from the base 60E. The integral trigger 90E attached to the dispensing head 70E provides a mechanical advantage for intentionally or inadvertently separating the dispensing head 70E from the base 60E. The dispensing head 70E can be separated from the base 60E by (1) an excess depressing force applied to the trigger 90E, (2) an excess lifting force applied to the trigger 90E and (3) an improper use and/or abuse of the trigger operated aerosol dispenser 10E. The auxiliary latching mechanism 210E inhibits such intentional or inadvertent separation of the dispensing head 70E from the base 60E.

The auxiliary latching mechanism 210E comprises arcuate base locking plates 211E and 212E extending from the inner base platform 112E into the central platform aperture 114E of the base 600E. The arcuate base locking plates 211E and 212E are unitary with the base 60E. Arcuate lock slots 213E and 214E are defined in the arcuate base locking plates 211E and 212E.

Locking ribs 221E and 222E extend downwardly from the dispensing head 70E. The distal ends of the locking ribs 221E and 222E are provided with locking barbs 223E and 224E having ramp surfaces 225E and 226E and locking surfaces 227E and 228E. The locking ribs 221E and 222E and locking barbs 223E and 224E are unitary with the dispensing head 70E. At least one of the arcuate base locking plates 211E and 212E and/or the locking ribs 221E and 222E are formed from a resilient polymeric material.

The locking ribs 221E and 222E are receivable within the arcuate lock slots 213E and 214E defined within the arcuate base locking plates 211E and 212E. The resilient arcuate lock slots 213E and 214E and/or resilient locking ribs 221E and 222E are deformed as the locking surfaces 227E and 228E to pass through the arcuate lock slots 213E and 214E. When the resilient arcuate lock slots 213E and 214E and/or resilient locking ribs 221E and 222E return to a non-deformed condition, the locking surfaces 227E and 228E of the locking barbs 223E and 224E engage an underside of the arcuate base locking plates 211E and 212E to prevent separation of the dispensing head 70E from the base 60E.

The auxiliary latching mechanism 210E prevents separation of the dispensing head 70E from the base 60E while permitting rotation movement of the dispensing head 70E relative to the base 60E and while permitting a tilting and/or downward movement of the dispensing head 70E for actuating the aerosol valve 20E.

FIGS. 67-78 are various views of a seventh embodiment of the trigger operated aerosol dispenser 10F of the present invention located on an aerosol container 40F. The seventh embodiment of the trigger operated aerosol dispenser 10F is similar to the first embodiment of the trigger operated aerosol dispenser 10 of FIGS. 1-34 with similar parts labeled with similar references numbers with the addition of the alphabetical character F.

The seventh embodiment of the trigger operated aerosol dispenser 100F comprises a base 60F and a dispensing head 70. The nozzle 80F of the dispensing head 70F defines a nozzle cradle surface 89F. The base 60F includes an overhang 190F defining an overhang cradle surface 192F. The nozzle cradle surface 89F operates in concert with the overhang cradle surface 192F to provide a hand support for an operator. The index finger (not shown) engages with the nozzle cradle surface 89F with the web (not shown) between the index finger and the thumb engaging with the overhang cradle surface 192F for enabling the hand of the operator (not shown) to ergonomically hold the trigger operated aerosol dispenser 10F. Furthermore, the index finger of the operator is conveniently located to actuate the trigger actuator 90F of the trigger operated aerosol dispenser 10F.

FIGS. 79-86 are various views of an eighth embodiment of the trigger operated aerosol dispenser 10G of the present invention located on an aerosol container 40G. The eighth embodiment of the trigger operated aerosol dispenser 10G is similar to the first embodiment of the trigger operated aerosol dispenser 10 of FIGS. 1-34 with similar parts labeled with similar references numbers with the addition of the alphabetical character G.

The eighth embodiment of the trigger operated aerosol dispenser 10G incorporates a second example of a lock 145G for inhibiting tilting of the dispensing head 70G relative to the base 60G. The lock 145G comprise a base groove shown as a base notch 1500G defined in base 60G cooperating with a groove rib shown as boss 180G defined by the dispensing head 70G.

The base notch 150G is defined in the outer ring 100G of the base 60G and occupies a minor portion of the circumference of the outer ring 100G. Preferably, the base notch 150G occupies a minor portion of the circumference of the outer ring 100G commensurate with the arc portion of the circumference of the bridge 125G. In this example, the base notch 150G occupies a five to ten degree arc portion of the circumference of the outer ring 100G about the axis of symmetry 13G of the trigger operated aerosol dispenser 10G.

The dispensing head boss 180G extends from the outer surface 74G of the dispensing head 70G. Preferably, dispensing head boss 180G is formed as a one-piece unit of the actuator button 70G. More specifically, the dispensing head boss 180G extends in proximity to an underside of the proximal end 91G of the trigger 90G.

Figure 79:
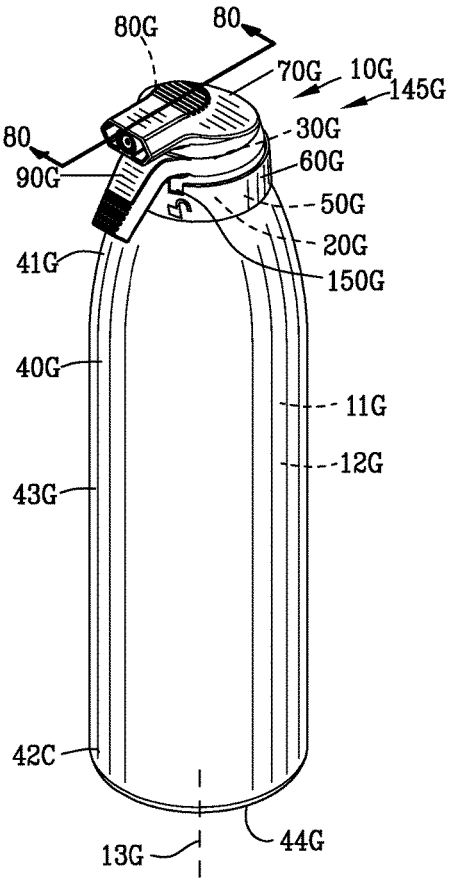
FIG. 79 is a top isometric view of an eighth embodiment of the trigger operated aerosol dispenser of the present invention located on an aerosol container.
Figure 80:
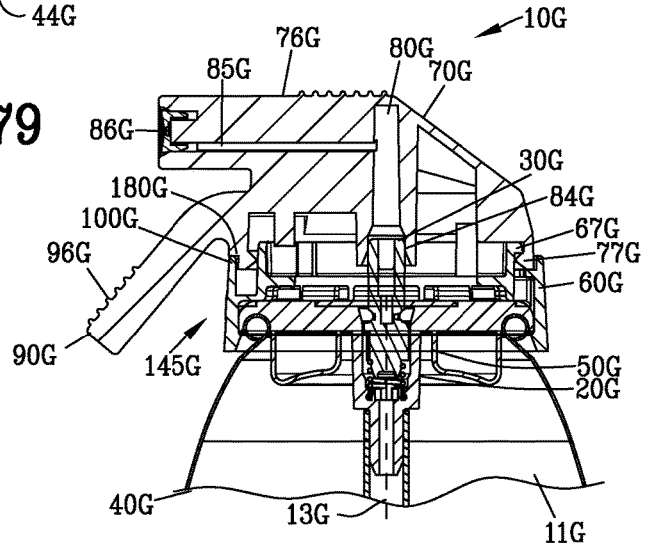
FIG. 80 is an enlarged partial sectional view along line 80-80 in FIG. 79.
Figure 81:
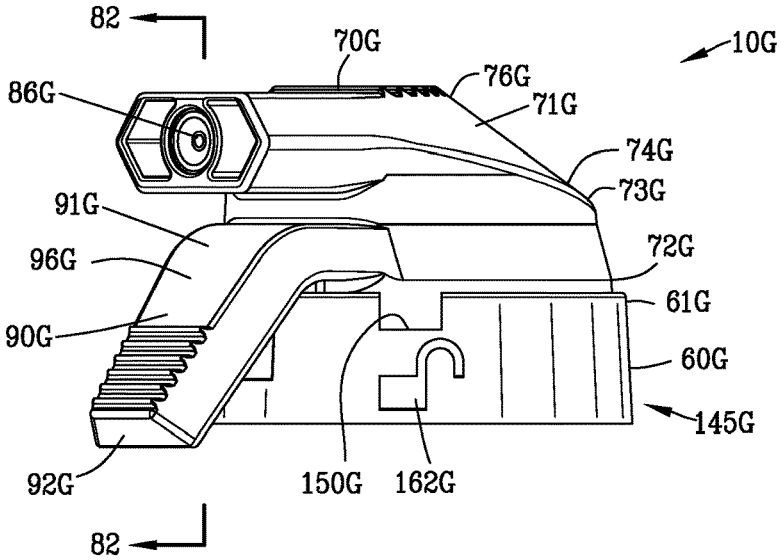
FIG. 81 is an enlarged front view of the trigger operated aerosol dispenser of FIG. 80 shown in a locked position.
Figure 82:
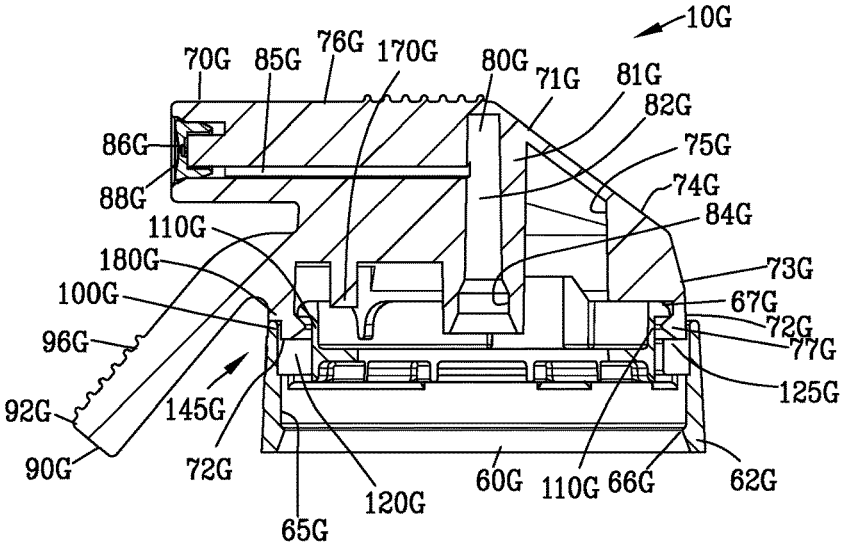
FIG. 82 is a sectional view along line 82-82 in FIG. 81.

FIGS. 81-82 illustrate the trigger operated aerosol dispenser 10G of FIGS. 79 and 80 with the dispensing head 70G located in the locked rotational position. In the locked rotational position, the dispensing head boss 180G is misaligned with the base notch 150G. The dispensing head boss 180G engages with the top portion 61G of the outer ring 1000 of the base 60G to prevent the dispensing head 70G from tilting about the bridge 125G to actuate the aerosol valve 20G.

The engagement of the dispensing head boss 180G with the top portion 61G of the outer ring 100G of the base 60G reinforces the mechanical strength of the substantially flat and horizontal top surface 76G. This reinforcement of the mechanical strength of the substantially flat and horizontal top surface 76G facilitates the shipping of multiple levels of the trigger operated aerosol dispensers 10G.

Figure 83:
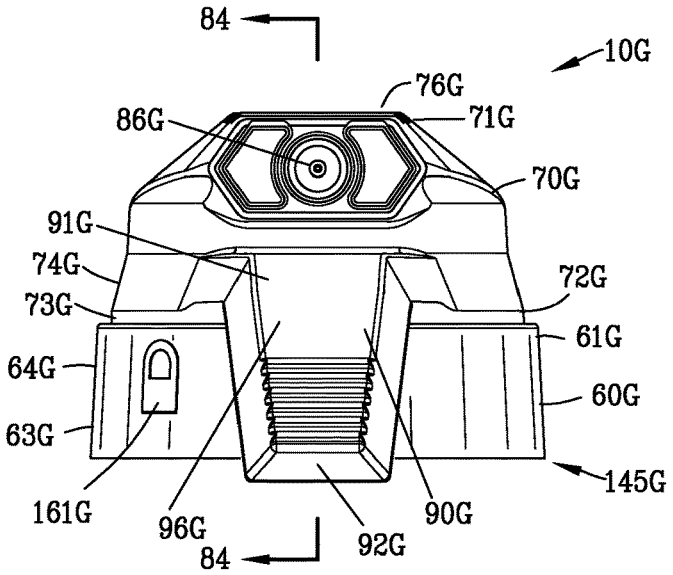
FIG. 83 is an enlarged front view of the trigger operated aerosol dispenser of FIG. 80 shown in an unlocked position.
Figure 84:
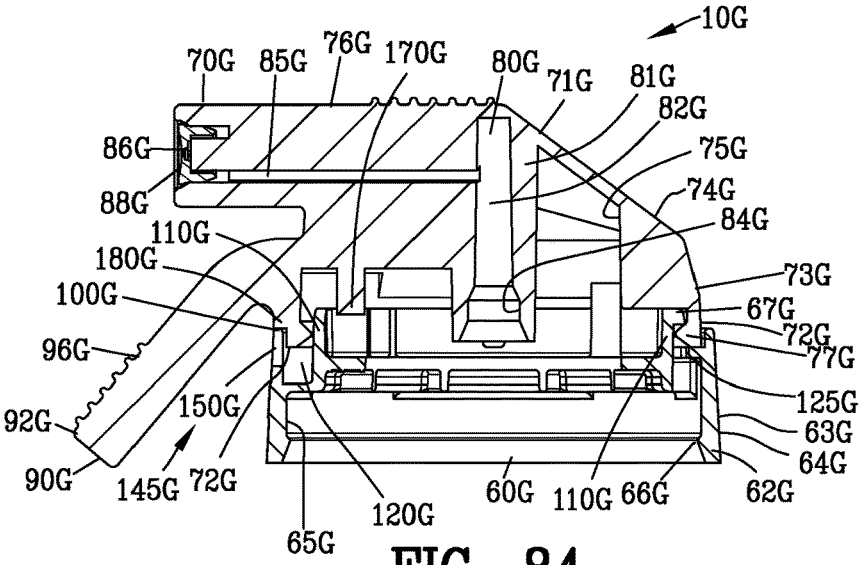
FIG. 84 is a sectional view along line 84-84 in FIG. 83.

FIGS. 83 and 84 illustrate the dispensing head 70G rotated counterclockwise relative to the base 60G until the dispensing head boss 180G is aligned with the base notch 150G. The alignment of the dispensing head boss 180G with the base notch 1500G enables an operator to tilt the dispensing head 70G relative to the base 60G to actuate the aerosol valve 20G.

Figure 85:
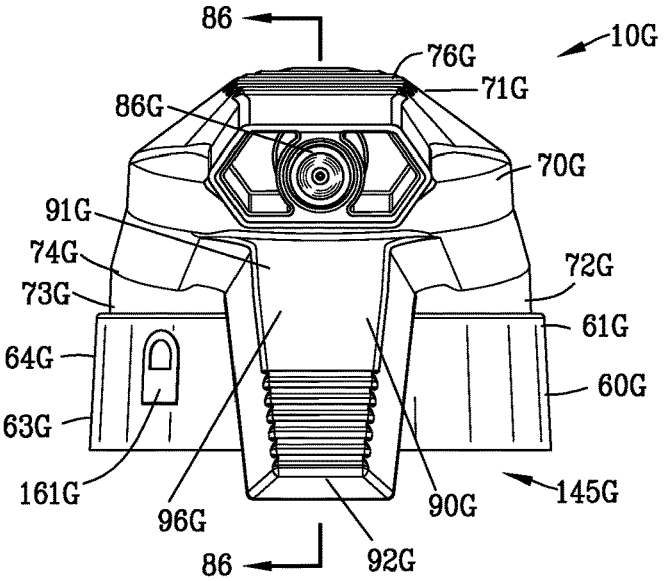
FIG. 85 is a view similar to FIG. 83 with the trigger operated aerosol dispenser shown in an actuated position.
Figure 86:
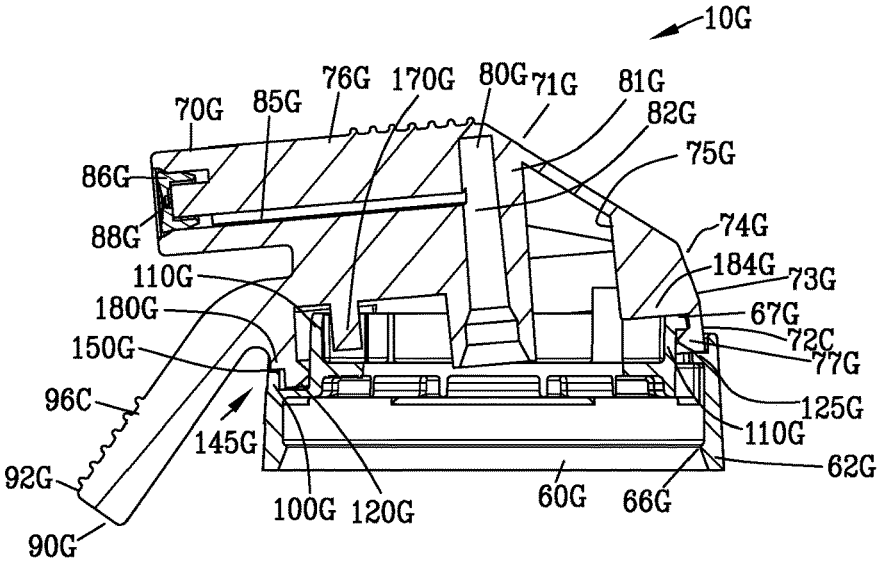
FIG. 86 is a sectional view along line 86-86 in FIG. 85.

FIGS. 85 and 86 illustrate the dispensing head 70G tilted relative to the base 60G for actuating the aerosol valve 20G. A depression of the finger actuating surface 96G of the trigger 90G by an operator tilts the dispensing head 70G tilts in its entirety as a unit relative to the base 60G as the dispensing head boss 180G enters the base notch 150G. A portion of the sidewall 73G of the dispensing head 70G enters the void 120G between the outer ring 1000 and the inner ring 1100.

FIGS. 87-102 are various views of a ninth embodiment of the trigger operated aerosol dispenser 10H of the present invention located on an aerosol container 40H. The ninth embodiment of the trigger operated aerosol dispenser 10H is similar to the first embodiment of the trigger operated aerosol dispenser 10G of FIGS. 79-86 with similar parts labeled with similar references numbers with the alphabetical character H.

In this embodiment, the base mounting 66H of the base 60H is secure to crimp 5611 sealing the mounting cup 50H to the bead 46H of the aerosol container 4011. The base mounting 66H of the base 60H is unitary with the base 80H.

The ninth embodiment of the trigger operated aerosol dispenser 10H incorporates a another example of a lock 145H for locking the dispensing head 70H relative to the base 60H. The lock 145H comprises a base groove shown as a base notch 150H defined in base 60H cooperating with a groove rib shown as boss 182H defined by the dispensing head 70H.

FIGS. 89-92 illustrate the base notch 150H defined in the outer ring 100H of the base 60H and occupies a minor portion of the circumference of the outer ring 100H. Preferably, the base notch 150H occupies a minor portion of the circumference of the outer ring 100 commensurate with the arc portion of the circumference of the bridge 125H. In this example, the base notch 150H occupies a five to ten degree arc portion of the circumference of the outer ring 100H about the axis of symmetry 13H of the trigger operated aerosol dispenser 10H.

FIGS. 93-96 illustrate the dispensing head boss 182H extending from the inner surface 75H of the dispensing head 70H. Preferably, dispensing head boss 182H is formed as a one-piece unit of the actuator button 70H. More specifically, the dispensing head boss 182H extends in proximity to an underside of the proximal end 91H of the trigger 90H.

Figure 87:
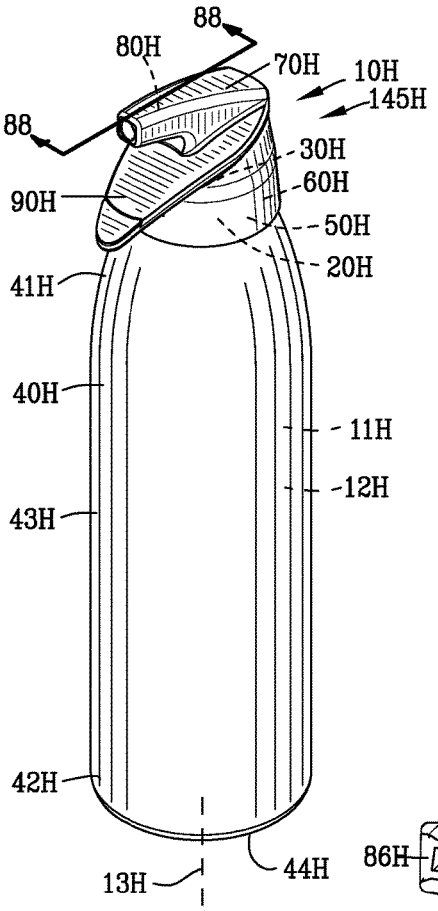
FIG. 87 is a top isometric view of a ninth embodiment of the trigger operated aerosol dispenser of the present invention located on an aerosol container.
Figure 88:
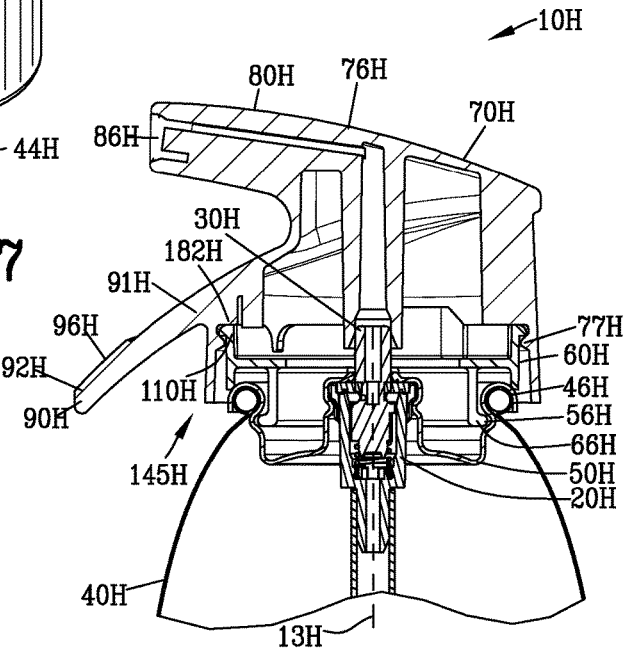
FIG. 88 is an enlarged partial sectional view along line 88-88 in FIG. 87.
Figure 89:
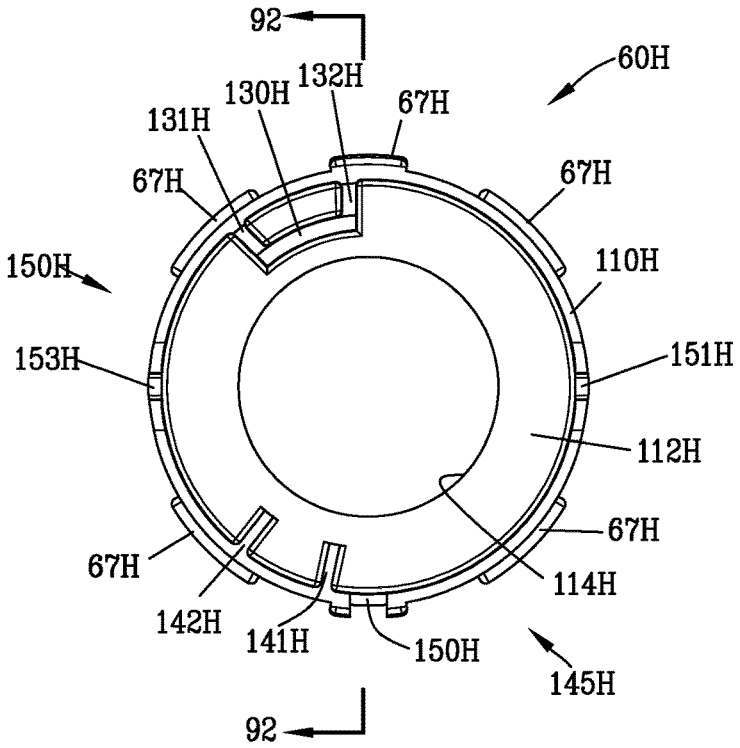
FIG. 89 is a top view of the base shown in of FIGS. 87-88.
Figure 90:
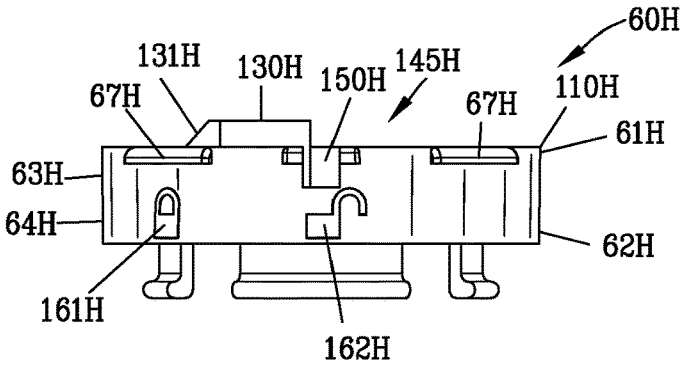
FIG. 90 is a front view of the base of FIG. 89.
Figure 91:
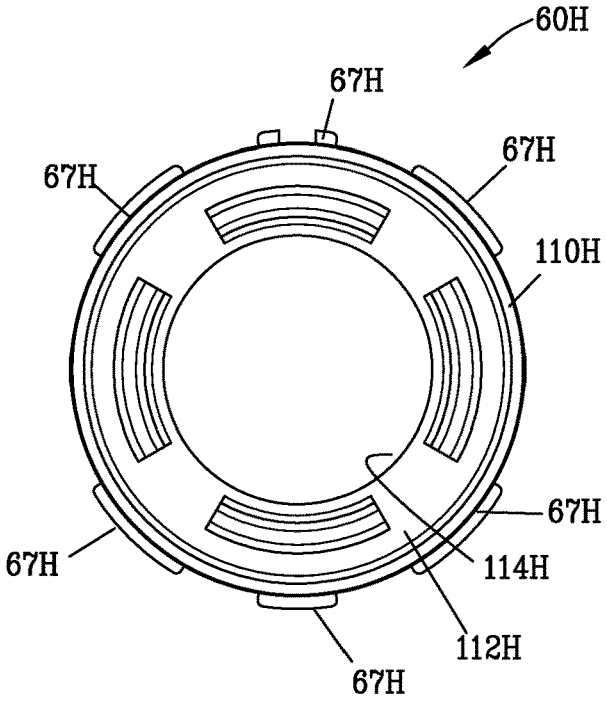
FIG. 91 is a bottom view of FIG. 89.
Figure 92:
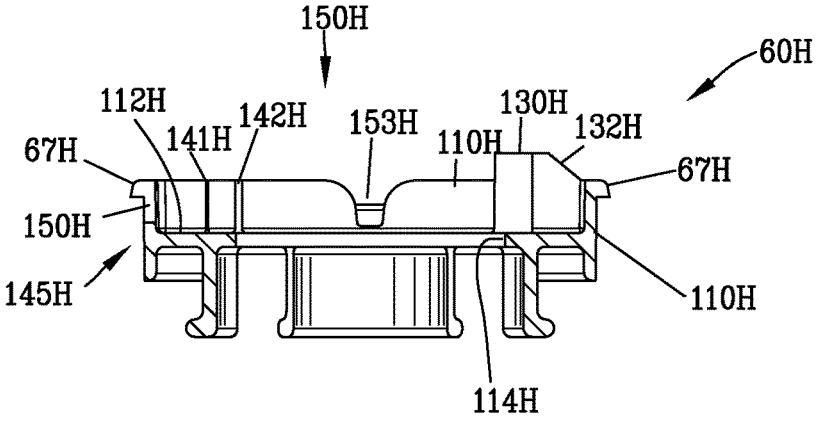
FIG. 92 is a sectional view along line 92-92 in FIG. 89.
Figure 93:
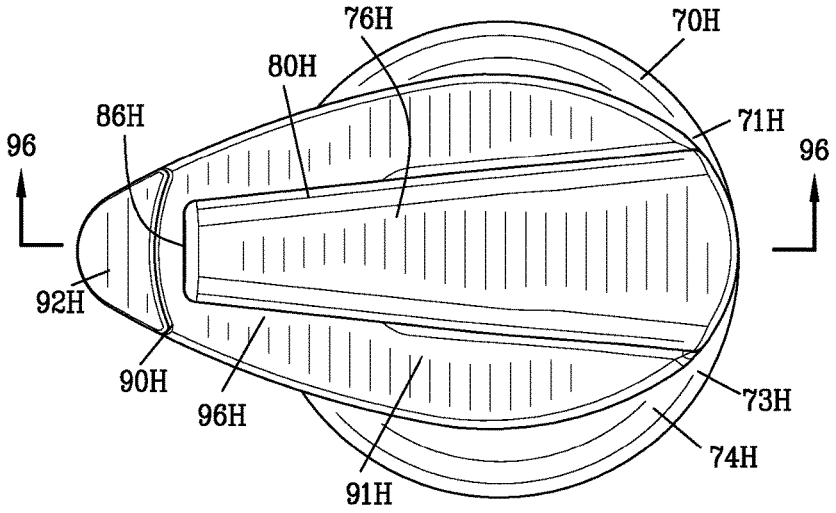
FIG. 93 is a top view of the dispensing head of FIGS. 87-88.
Figure 94:
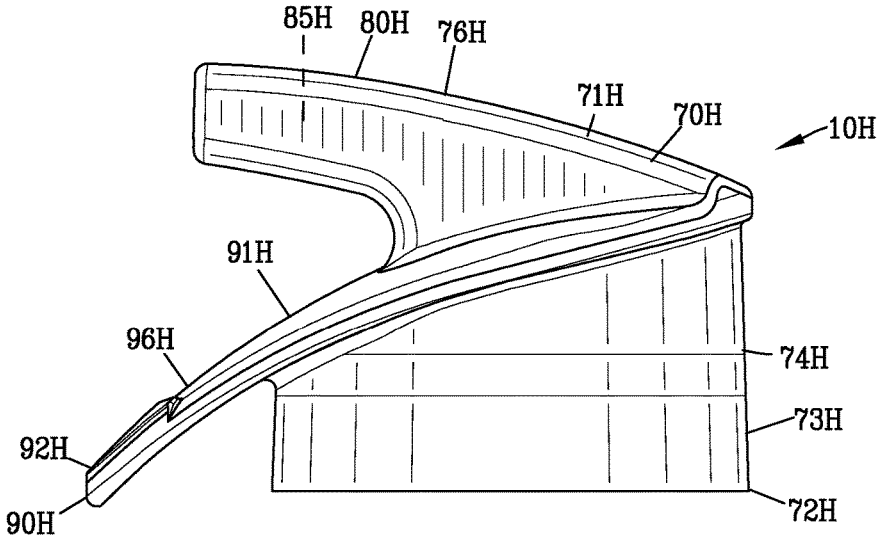
FIG. 94 is a left side view of the dispensing head of FIG. 93.
Figure 95:
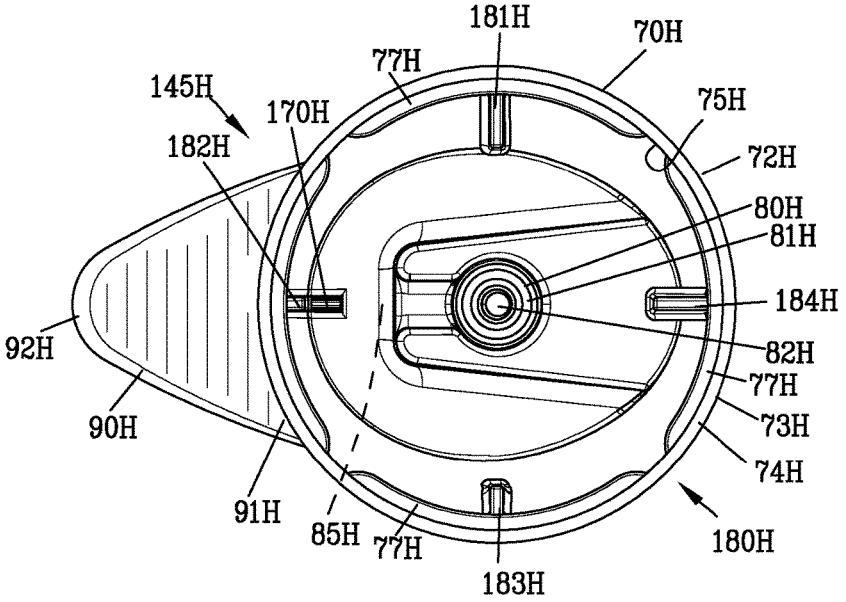
FIG. 95 is a bottom view of FIG. 93.
Figure 96:
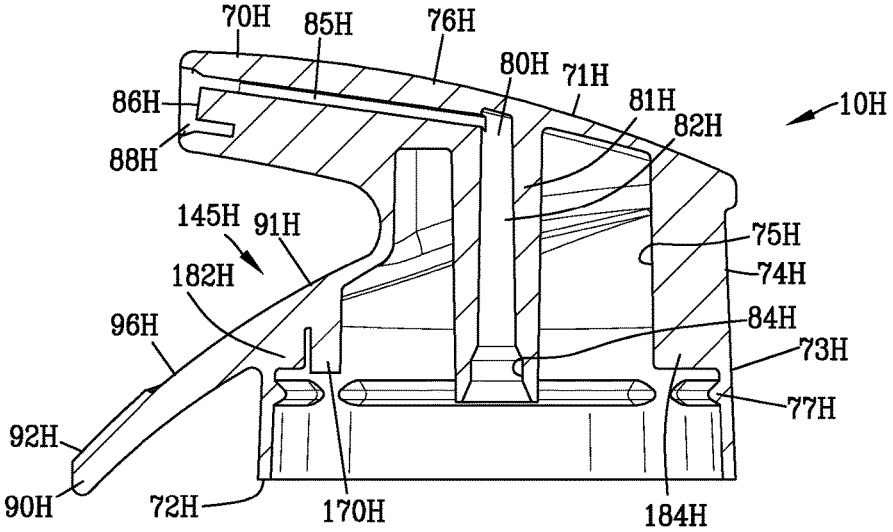
FIG. 96 is a sectional view along line 96-96 in FIG. 93.
Figure 97:
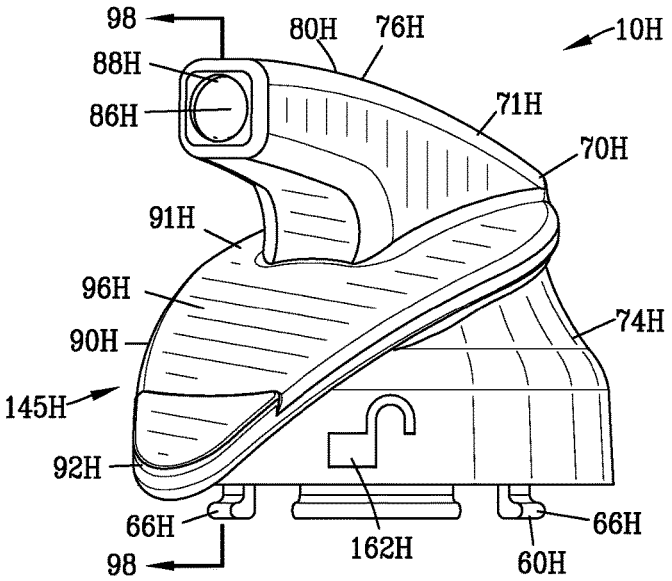
FIG. 97 is an enlarged front view of the trigger operated aerosol dispenser of FIG. 87 shown in a locked position.
Figure 98:
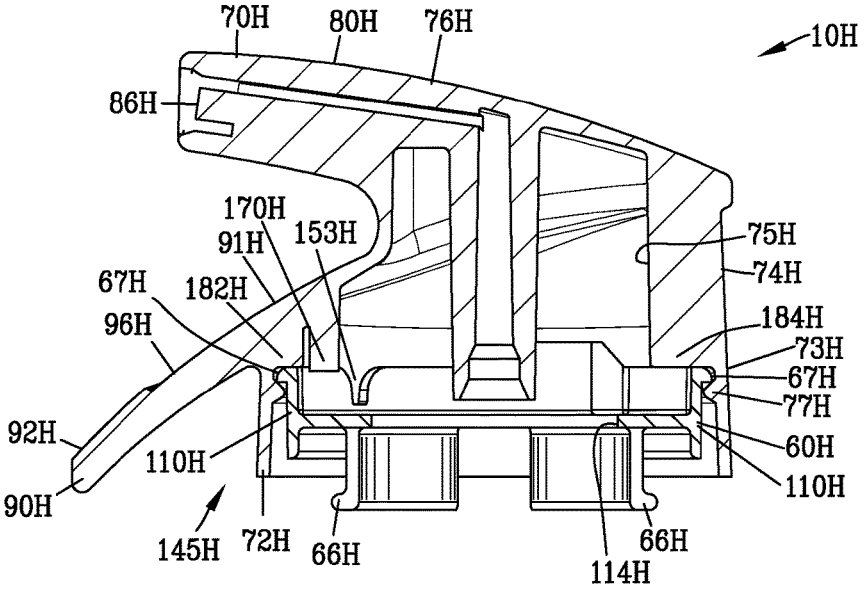
FIG. 98 is a sectional view along line 98-98 in FIG. 97.

FIGS. 97-98 illustrate the trigger operated aerosol dispenser 101H of FIGS. 87 and 88 with the dispensing head 70H located in the locked rotational position. In the locked rotational position, the dispensing head boss 182H is misaligned with the base notch 150H. The dispensing head boss 182H engages with the top portion 61H of the outer ring 100H of the base 60H to prevent the dispensing head 70H from tilting about the bridge 125H to actuate the aerosol valve 20H.

The engagement of the dispensing head boss 182H with the top portion 61H of the outer ring 100H of the base 6011 reinforces the mechanical strength of the substantially flat and horizontal top surface 76H. This reinforcement of the mechanical strength of the substantially flat and horizontal top surface 76H facilitates the shipping of multiple levels of the trigger operated aerosol dispensers 10H.

Figure 99:
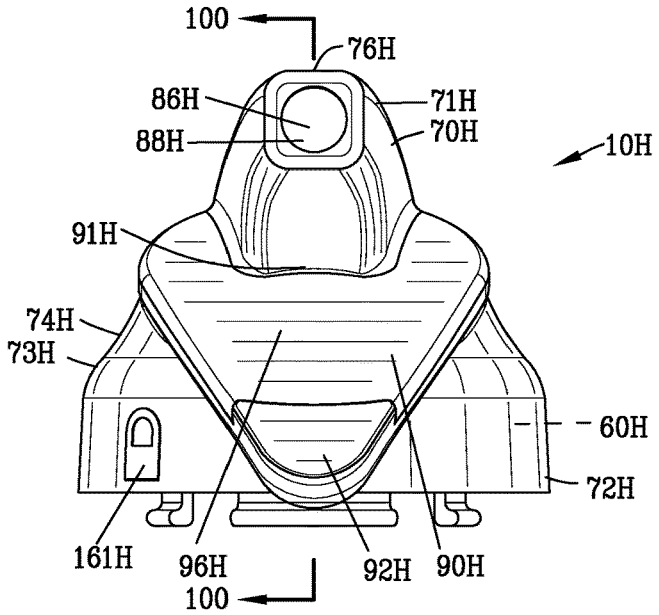
FIG. 99 is an enlarged front view of the trigger operated aerosol dispenser of FIG. 87 shown in an unlocked position.
Figure 100:
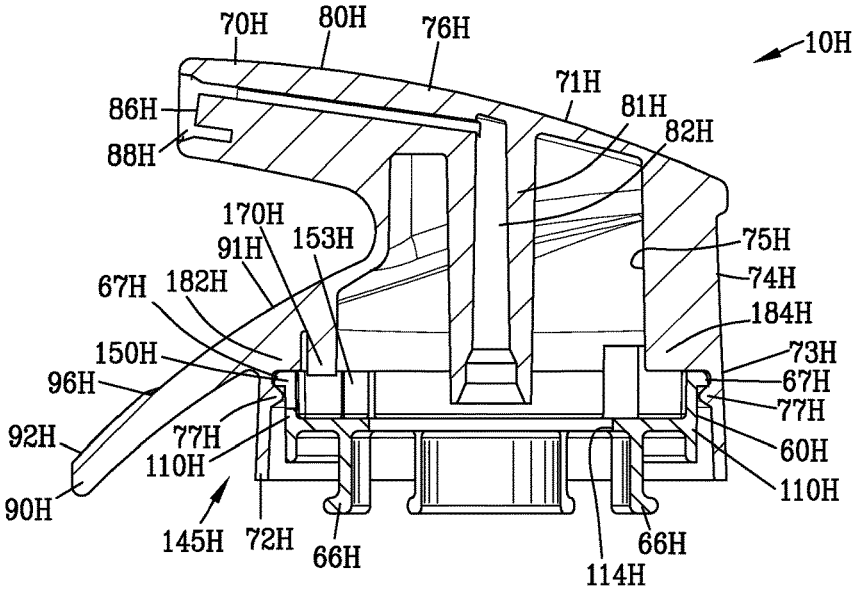
FIG. 100 is a sectional view along line 100-100 in FIG. 99.

FIGS. 99 and 100 illustrate the dispensing head 70H rotated counterclockwise relative to the base 60H until the dispensing head boss 182H is aligned with the base notch 150H. The alignment of the dispensing head boss 182H with the base notch 150H enables an operator to tilt the dispensing head 70H relative to the base 60H to actuate the aerosol valve 20H.

Figure 101:
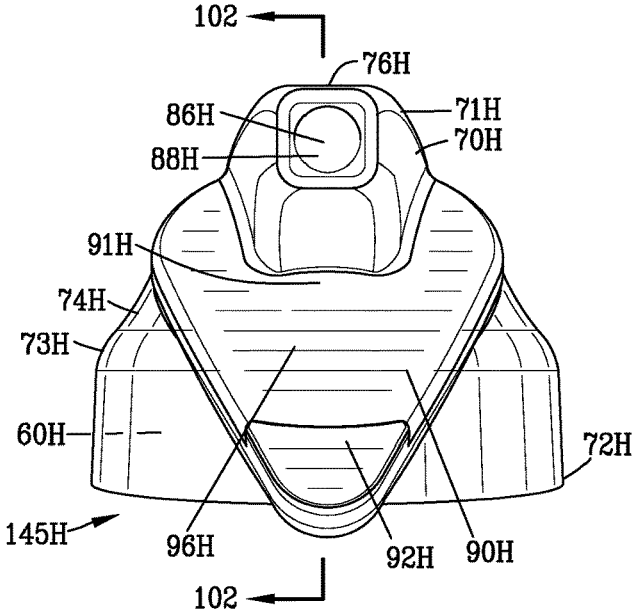
FIG. 101 is a view similar to FIG. 99 with the trigger operated aerosol dispenser shown in an actuated position.
Figure 102:
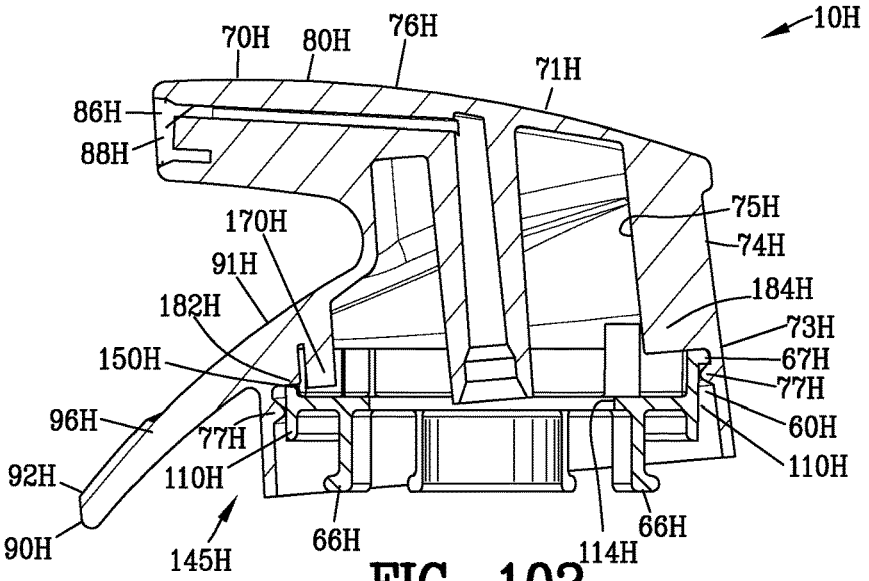
FIG. 102 is a sectional view along line 102-102 in FIG. 101.
Figure 103:
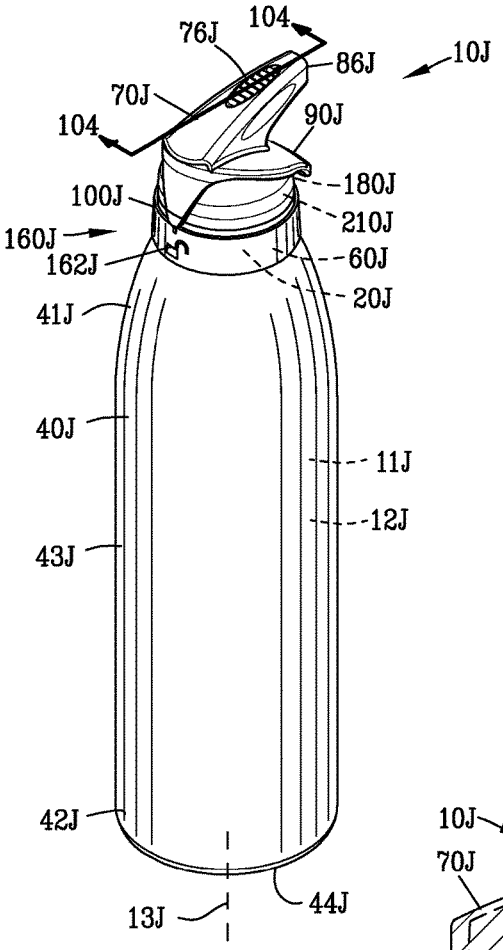
FIG. 103 is a top isometric view of a tenth embodiment of the trigger operated aerosol dispenser of the present invention located on an aerosol container.
Figure 104:
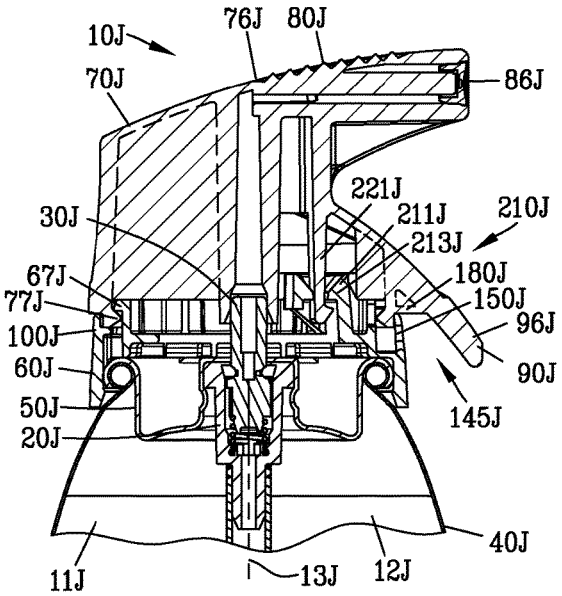
FIG. 104 is an enlarged partial sectional view along line 104-104 in FIG. 103.
Figure 105:
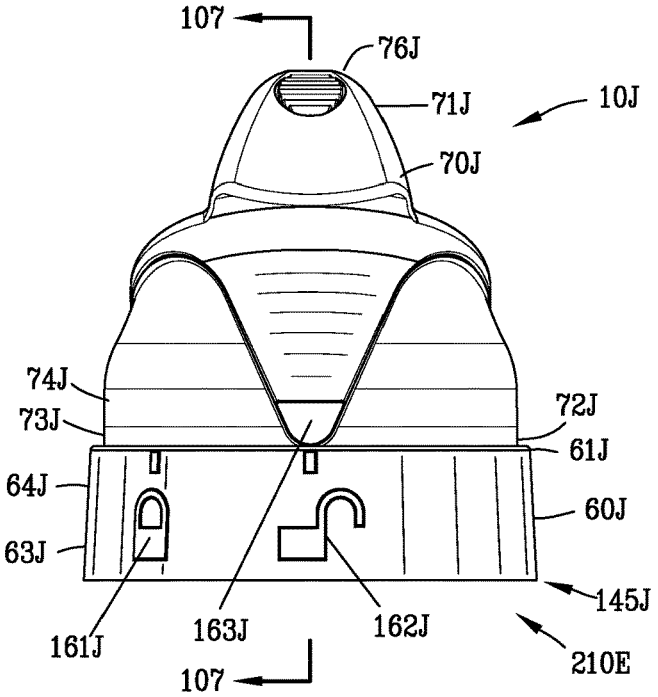
FIG. 105 is an enlarged rear view of the trigger operated aerosol dispenser of FIG. 103 shown in an unlocked position.
Figure 106:
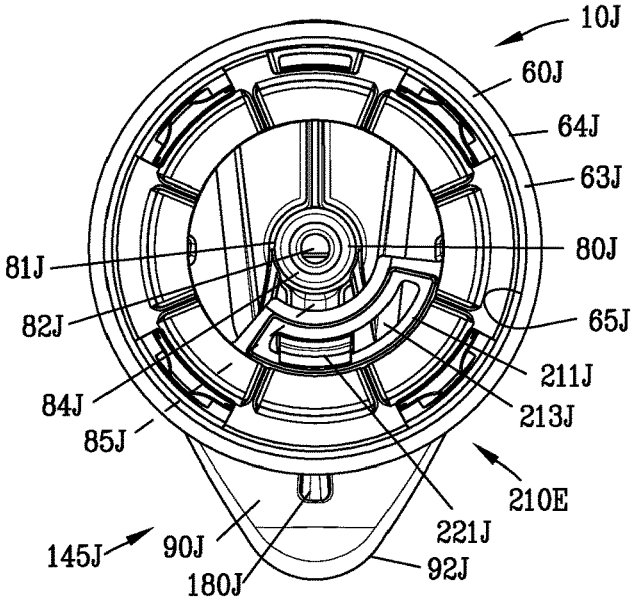
FIG. 106 is a bottom view of FIG. 105.

FIGS. 101 and 102 illustrate the dispensing head 70H tilted relative to the base 60H for actuating the aerosol valve 20H. A depression of the finger actuating surface 96H of the trigger 90H by an operator tilts the dispensing head 70H tilts in its entirety as a unit relative to the base 60H as the dispensing head boss 182H enters the base notch 150H. A portion of the sidewall 73H of the dispensing head 70H enters the void 120H between the outer ring 100H and the inner ring 110H.

FIGS. 103-111 are various views of a tenth embodiment of the trigger operated aerosol dispenser 10J of the present invention located on an aerosol container 40J. The tenth embodiment of the trigger operated aerosol dispenser 10J is similar to the first embodiment of the trigger operated aerosol dispenser 10 of FIGS. 1-34 with similar parts labeled with similar references numbers with the addition of the alphabetical character J.

FIGS. 103-108 illustrate the dispensing head 70J rotated into the unlocked rotational position in a manner as previously described. The trigger operated aerosol dispenser 10J may be tilted into the actuated position by a depression of the top finger actuating surface 76J or may be moved into the actuated position by depression of the finger actuating surface 96J of the trigger 90J.

The trigger operated aerosol dispenser 10J incorporates an auxiliary latching mechanism 210J similar to the auxiliary latching mechanism 210E shown in FIGS. 59-66. The auxiliary latching mechanism 210J inhibits separation of the dispensing head 70J from the base 60J.

Figure 107:
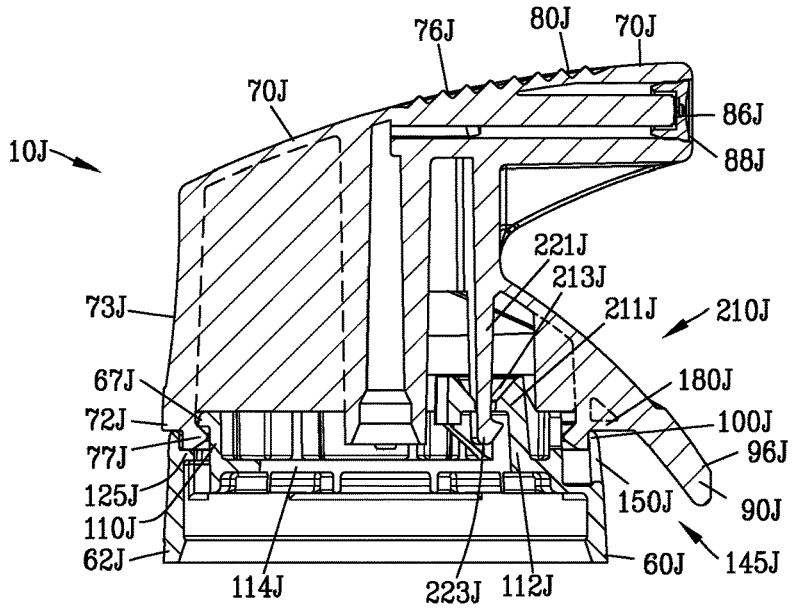
FIG. 107 is a sectional view along line 107-107 in FIG. 105.
Figure 107A:
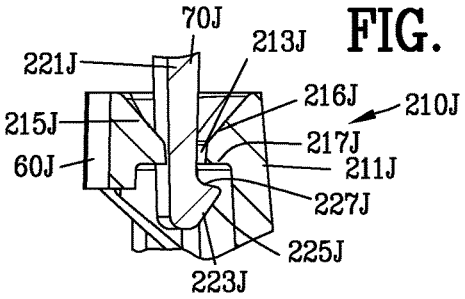
FIG. 107A is a magnified view of a portion of FIG. 107.

As best shown in FIG. 107A, the auxiliary latching mechanism 210J comprises an arcuate base locking plate 211J extending from and unitary with the inner base platform 112J. An arcuate lock slot 213J is defined in the arcuate base locking plate 211J. The arcuate base locking plate 211J includes opposed tapered surfaces 215G and 216G and a locking plate locking underside 217G.

A locking rib 221J extends downwardly from the dispensing head 70J. The distal end of the locking rib 211J is provided with a locking rib barb 223J having a ramp surface 225J and a locking surface 227J. The locking rib 221J and locking rib barb 223J are unitary with the dispensing head 70J. At least one of the arcuate base locking plate 211J and/or the locking rib 221J are formed from a resilient polymeric material.

The locking rib 221J are receivable within the arcuate lock slot 213J defined within the arcuate base locking plate 211J. The arcuate base locking plate 211J proximate the arcuate lock slot 213J and/or locking rib 221J are deformed as the locking rib barb 223J passes through the arcuate lock slot 213J. When the resilient arcuate base locking plate 211J proximate the arcuate lock slot 213J and/or resilient locking rib 221J return to a non-deformed condition, the locking surface 227J of the locking barb 223J is able to engage the underside 217G of the arcuate base locking plate 211J to prevent separation of the dispensing head 70J from the base 603.

The tenth embodiment of the trigger operated aerosol dispenser 10J incorporates an alternative lock 145J similar to the lock illustrated in FIGS. 79 and 81 for inhibiting tilting of the dispensing head 70J relative to the base 60J. The lock 145J comprises a base notch 150J defined in the outer ring 100J of the base 60J. The base notch 150J cooperates with the boss 1801 defined by the dispensing head 70J.

The dispensing head boss 180J extends between the outer surface 74J of the dispensing head 70J and the underside of the trigger actuator 90J. The dispensing head boss 180J is formed as a one-piece unit of the actuator button 70J.

FIGS. 103-107 illustrate the dispensing head 70J rotated relative to the base 60J to align the dispensing head boss 180J with the base notch 150J. The alignment of the dispensing head boss 180J with the base notch 150J enables an operator to tilt the dispensing head 70J relative to the base 60J to actuate the aerosol valve 20J.

Figure 108:
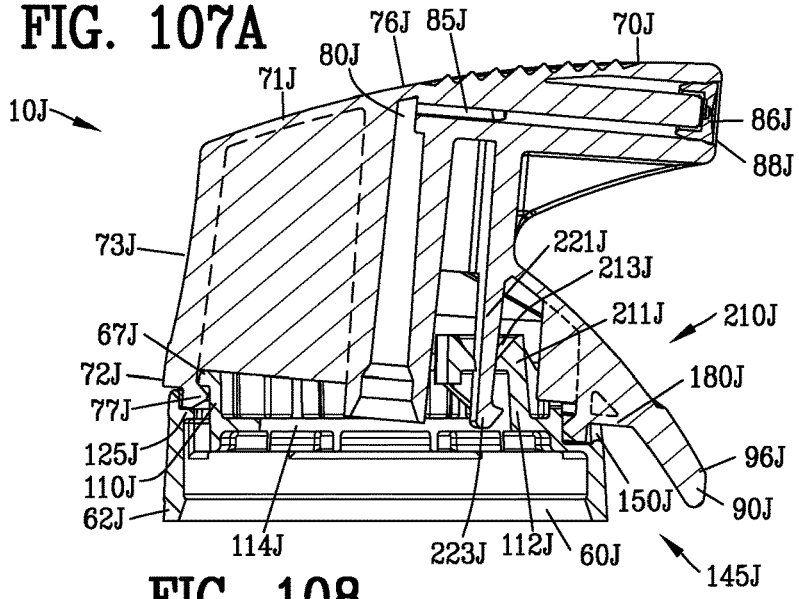
FIG. 108 is a view similar to FIG. 107 with the trigger operated aerosol dispenser shown in an actuated position.

FIG. 108 illustrates the dispensing head 70J tilted relative to the base 60J for actuating the aerosol valve 20J. A depression by an operator tilts the dispensing head 70J tilts in its entirety as a unit relative to the base 60J as the dispensing head boss 180J enters the base notch 150J. A portion of the sidewall 73J of the dispensing head 70J enters the void 120J between the outer ring 100J and the inner ring 1103.

Figure 109:
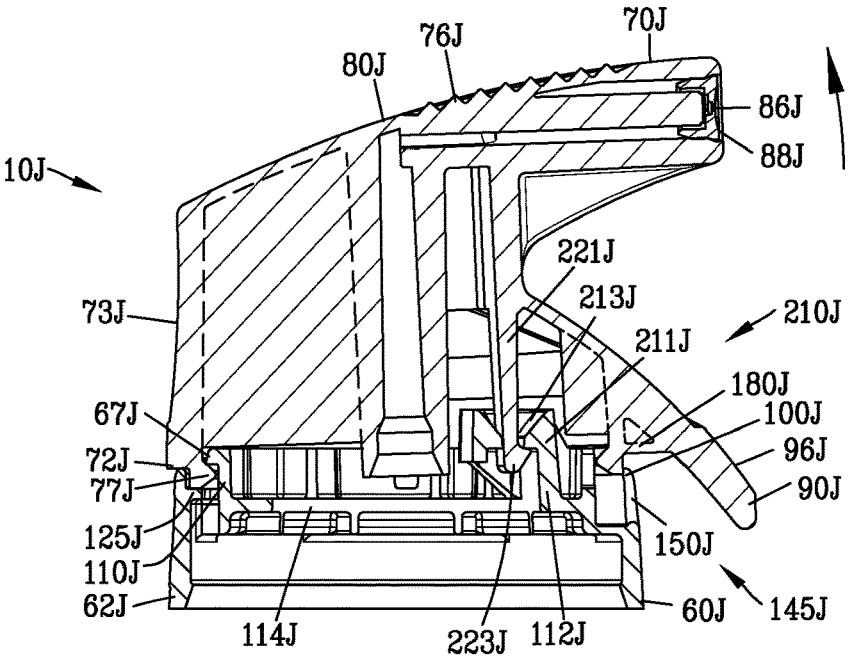
FIG. 109 is a view similar to FIG. 107 with the dispensing head being subjected to an upward force.
Figure 109A:
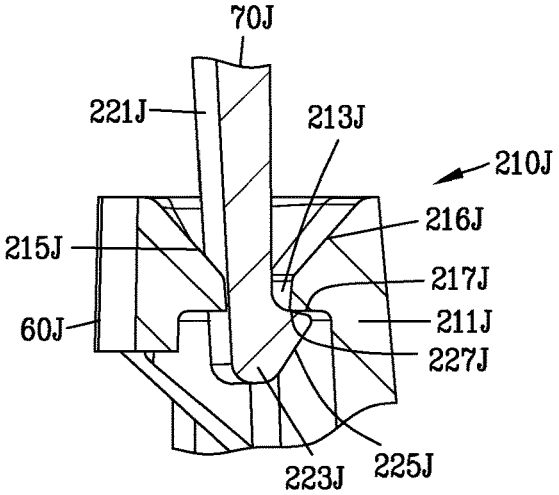
FIG. 109A is a magnified view of a portion of FIG. 109.

FIGS. 109 and 109A illustrate the dispensing head 70J being subjected to an upward force relative to the base 60J as indicate by the arrow. The locking surface of the locking rib barb 2233 engages with the underside 2173 of the arcuate base locking plate 211G to prevent separation of the dispensing head 70J from the base 60J. The auxiliary latching mechanism 210E permits rotation movement of the dispensing head 70J relative to the base 60J and permits a tilting and/or downward movement of the dispensing head 70J for actuating the aerosol valve 20J.

Figure 110:
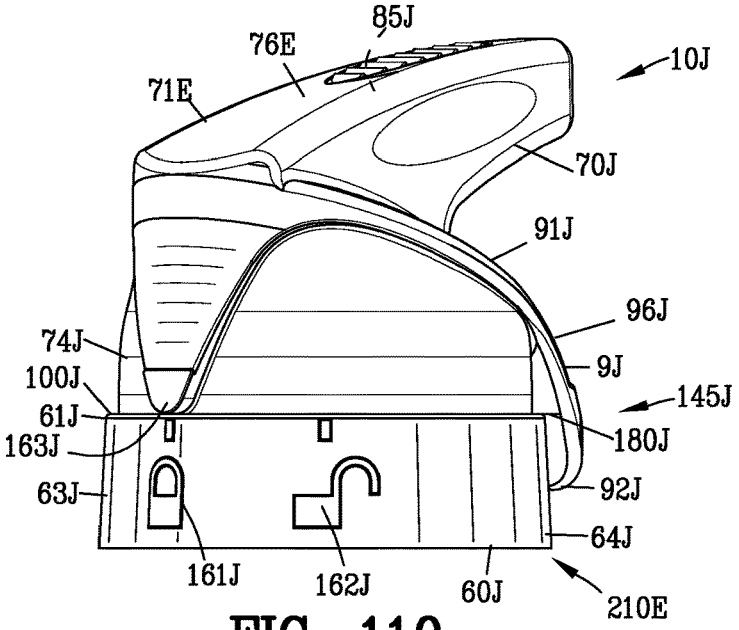
FIG. 110 is a view similar to FIG. 107 with the trigger operated aerosol dispenser rotated into a locked position.
Figure 111:
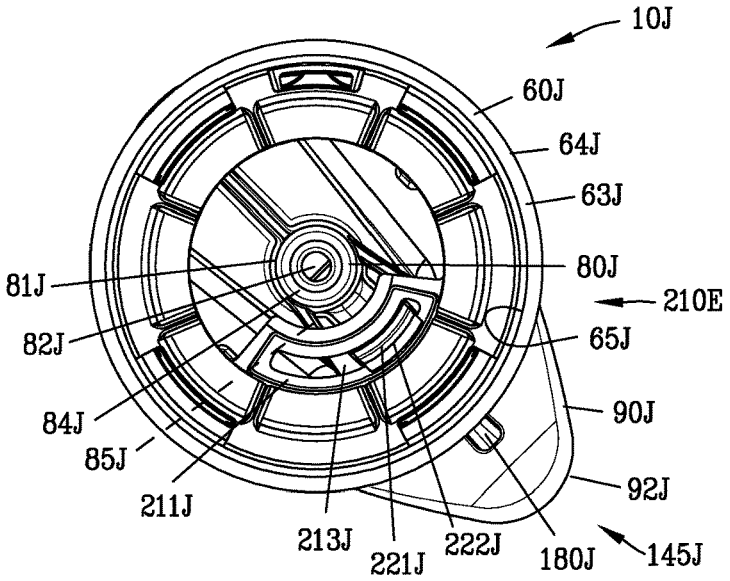
FIG. 111 is a bottom view of a portion of FIG. 110.

FIGS. 110 and 111 illustrate the trigger operated aerosol dispenser 10J with the dispensing head 70J located in the locked rotational position. In the locked rotational position, the dispensing head boss 180J is misaligned with the base notch 150J. The dispensing head boss 180J engages with the top portion 61J of the outer ring 100J of the base 60J to prevent the dispensing head 70J from tilting about the bridge 125J and to prevent actuation of the aerosol valve 20J.

The present invention provides an improved trigger operated aerosol dispenser having a non-articulated trigger actuator. The trigger operated aerosol dispenser may be actuated either by a trigger actuator or alternately be actuated by a depression of a dispenser head. The trigger operated aerosol dispenser has a reduced number of parts and preferably a base and a dispensing head. The trigger operated aerosol dispenser includes a lock for inhibiting actuation of the trigger operated aerosol dispenser.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A two-piece trigger operated aerosol dispenser for dispensing an aerosol product from an aerosol container through an aerosol valve, comprising:

a first piece comprising:

a base having a mounting unitary with said base for securing said base to the aerosol container;

said base having an outer ring and an inner ring defining an annular void between said outer ring and said inner ring of said base;

a second piece comprising;

a dispensing head having a circumferential sidewall supporting a top surface;

a nozzle channel extending through said dispensing head for communicating the aerosol valve with a terminal orifice;

a dispensing head retainer unitary with said dispensing head cooperating with said base retainer for securing said dispensing head to said base with a lower end of said circumferential sidewall of said dispensing head contained within said outer ring of said base;

a trigger actuator unitary with said dispensing head and extending outwardly therefrom in alignment with and below said nozzle channel for actuating the aerosol valve upon depression of said trigger actuator for dispensing the aerosol product from said terminal orifice; and a lock comprising a portion of one of said inner and said outer rings of said base and a portion of said dispensing head for inhibiting said trigger actuator from actuating the aerosol valve.

2. A two-piece trigger operated aerosol dispenser as set forth in claim 1, wherein said lock includes a first lock interacting between said inner ring of said base and said dispensing head and a second lock interacting between said outer ring of said base and said dispensing head to inhibit said trigger actuator from actuating the aerosol valve.

3. A two-piece trigger operated aerosol dispenser as set forth in claim 1, wherein said dispensing head is rotatably mounted to said base for rotation between a locked rotational position and an unlocked rotational position; and said trigger actuator being inhibited from actuating the aerosol valve when said dispensing head is rotated into said locked rotational position.

4. A two-piece trigger operated aerosol dispenser for dispensing an aerosol product from an aerosol container through an aerosol valve, comprising:

a first piece comprising:

a base having a mounting unitary with said base for securing said base to the aerosol container;

said base having an outer ring and an inner ring defining an annular void between said outer ring and said inner ring of said base;

a second piece comprising:

a dispensing head having a sidewall supporting a top surface;

a nozzle channel extending through said dispensing head for communicating the aerosol valve with a terminal orifice;

a trigger actuator unitary with said dispensing head and extending outwardly therefrom in alignment with and below said nozzle channel for actuating the aerosol valve upon depression of said trigger actuator for dispensing the aerosol product from said terminal orifice; and a first lock comprising a portion of said inner ring of said base and a second lock comprising a portion of said outer ring of said base.

5. A two-piece trigger operated aerosol dispenser for dispensing an aerosol product from an aerosol container through an aerosol valve, comprising:

a first piece comprising:

a base having a mounting unitary with said base for curing said base to the aerosol container;

said base has an outer ring and an inner ring defining an annular void between said outer ring and said inner ring of said base;

said base having a base retainer unitary with said base;

a base notch defined in said outer ring of said base;

a second piece comprising:

a dispensing head having a circumferential sidewall supporting a top surface;

a nozzle channel extending through said dispensing head for communicating the aerosol valve with a terminal orifice;

a dispensing head retainer unitary with said dispensing head cooperating with said base retainer for securing said dispensing head to said base with a lower end of said circumferential sidewall of said dispensing head contained within said outer ring of said base;

a trigger actuator unitary with said dispensing head and extending outwardly therefrom in alignment with and below said nozzle channel for actuating the aerosol valve upon depression of said trigger actuator for dispensing the aerosol product from said terminal orifice:

a boss defined by said dispensing head below said trigger actuator; and said boss of said dispensing head being receivable within said base notch of said base upon depression of said trigger actuator when said boss is aligned with said base notch for opening the aerosol valve to dispense the aerosol product from said terminal orifice.

6. A two-piece trigger operated aerosol dispenser for dispensing an aerosol product from an aerosol container through an aerosol valve, comprising:

a first piece comprising:

a base having a mounting unitary with said base for securing said base to the aerosol container;

said base having an inner and an outer ring defining an annular void between said inner ring and said outer ring of said base;

a base retainer unitary with said base;

a second piece comprising:

a dispensing head having a sidewall supporting a top surface;

a nozzle channel extending through said dispensing head for communicating the aerosol valve with a terminal orifice;

a dispensing head retainer unitary with said dispensing head cooperating with said base retainer for rotationally securing said dispensing head to said base with a lower end of said sidewall of said dispensing head rotationally secured below a top surface of said outer ring of said base;

a lock comprising a portion of said inner ring of said base and a portion of said dispensing head for inhibiting said trigger actuator from actuating the aerosol valve when said dispensing head is rotated into a locked rotational position:

said dispensing head defining a dispensing head actuator surface for actuating the aerosol valve upon depression of said dispensing head actuator surface to dispense the aerosol product from said terminal orifice when said dispensing head is rotated into said unlocked rotational position;

a trigger actuator unitary with said dispensing head and extending outwardly therefrom in alignment with and below said nozzle channel for actuating the aerosol valve upon depression of said trigger actuator for dispensing the aerosol product from said terminal orifice when said dispensing head is rotated into said unlocked rotational position; and said dispensing head actuator surface and said trigger actuator being inhibited from actuating the aerosol valve when said dispensing head is rotated into said locked rotational position.

7. A two-piece trigger operated aerosol dispenser for dispensing an aerosol product from an aerosol container through an aerosol valve, comprising:

a first piece comprising:

a base having a mounting unitary with said base for securing said base to the aerosol container;

said base having an outer ring and a base retainer unitary with said base;

a second piece comprising:

a dispensing head having a circumferential sidewall supporting a top surface;

a nozzle channel extending through said dispensing head for communicating the aerosol valve with a terminal orifice;

a dispensing head retainer unitary with said dispensing head cooperating with said base retainer for securing said dispensing head to said base with a lower end of said circumferential sidewall of said dispensing head contained within said outer ring of said base;

a trigger actuator unitary with said dispensing head and extending outwardly therefrom in alignment with and below said nozzle channel for actuating the aerosol valve upon depression of said trigger actuator for dispensing the aerosol product from said terminal orifice: and an auxiliary latching mechanism for inhibiting separation of said dispensing head from said base.

8. A lockable dual actuation aerosol dispenser for dispensing an aerosol product from an aerosol container through an aerosol valve, comprising:

a base having an inner ring and an outer ring defining an annular void between said inner ring and said outer ring and defined about an axis of symmetry of said base;

a base retainer extending from said base;

a mounting for securing said base to the aerosol container;

a dispensing head comprising a sidewall supporting a top surface;

a nozzle located within said dispensing head defining a nozzle channel extending between the aerosol valve and a terminal orifice;

a dispensing head retainer extending from said dispensing head cooperating with said base retainer for rotationally securing said dispensing head to said base with a lower portion of said sidewall of said dispensing head rotationally disposed below a top surface of said outer ring and within said an annular void between said inner ring and said outer ring of said base;

said dispensing head being rotatable about said axis of symmetry of said base between a locked rotational position and an unlocked rotational position;

said dispensing head defining a dispensing head actuator surface for actuating the aerosol valve upon depression of said dispensing head actuator surface to dispense the aerosol product from said terminal orifice;

a trigger actuator unitary with said dispensing head aligned with and below said terminal orifice for actuating the aerosol valve upon depression of said trigger actuator to dispense the aerosol product from said terminal orifice when said dispensing head is rotated into said unlocked rotational position;

each of said dispensing head actuator surface and said trigger actuator providing an independent surface for actuating the aerosol valve to dispense the aerosol product from said terminal orifice; and said dispensing head actuator surface and said trigger actuator being inhibited from actuating the aerosol valve when said dispensing head is rotated into said locked rotational position.

9. A lockable dual actuation aerosol dispenser for dispensing an aerosol product from an aerosol container through an aerosol valve, comprising:

a base having an outer ring and an inner ring defined about an axis of symmetry of said base and defining an annular void between said outer ring and said inner ring of said base;

a base retainer extending from said base;

a mounting for securing said base to the aerosol container;

a dispensing head comprising a sidewall supporting a top surface;

a nozzle located within said dispensing head defining a nozzle channel extending between the aerosol valve and a terminal orifice;

a dispensing head retainer extending from said dispensing head cooperating with said base retainer for rotationally securing said dispensing head to said base with a lower portion of said sidewall of said dispensing head rotationally secured below a top surface of said outer ring of said base;

said dispensing head being rotatable about said axis of symmetry of said base between a locked rotational position and an unlocked rotational position;

said dispensing head defining a dispensing head actuator surface for actuating the aerosol valve upon depression of said dispensing head actuator surface to dispense the aerosol product from said terminal orifice;

a trigger actuator unitary with said dispensing head aligned with and below said terminal orifice with said dispensing head being tiltable within said annular void of said base for foractuating the aerosol valve upon depression of said trigger actuator to dispense the aerosol product from said terminal orifice when said dispensing head is rotated into said unlocked rotational position;

each of said dispensing head actuator surface and said trigger actuator providing an independent surface for actuating the aerosol valve to dispense the aerosol product from said terminal orifice; and said dispensing head actuator surface and said trigger actuator being inhibited from tilting within said annular void of said base and inhibited from actuating the aerosol valve when said dispensing head is rotated into said locked rotational position.

10. A lockable dual actuation aerosol dispenser for dispensing an aerosol product from an aerosol container through an aerosol valve, comprising:

a base having an inner ring and an outer ring defined about an axis of symmetry of said base;

a base retainer unitary with said base extending from said base;

a mounting unitary with said base for securing said base to the aerosol container;

a dispensing head comprising a circumferential sidewall supporting a top surface;

a nozzle located within said dispensing head defining a nozzle channel extending between the aerosol valve and a terminal orifice;

a dispensing head retainer unitary with said dispensing head extending from said dispensing head cooperating with said base retainer for rotationally securing said dispensing head to said base with a lower circumferential end of said circumferential sidewall of said dispensing head rotationally secured below a top surface of said outer ring of said base;

a dispensing head actuator surface unitary with said dispensing head defined by said top surface of said dispensing head;

a trigger actuation surface defined by a trigger actuator unitary with said dispensing head extending from said dispensing head aligned with and below said terminal orifice;

each of said dispensing head actuator surface and said trigger actuator being capable of actuating the aerosol valve for dispensing the aerosol product from said terminal orifice; and a lock unitary with a portion of said inner ring of said base and said dispensing head for inhibiting said dispensing head actuator surface and said trigger actuator from actuating the aerosol valve when said lock is in a locked position.

11. A two-piece dual actuation aerosol dispenser for dispensing an aerosol product from an aerosol container through an aerosol valve, comprising:

a first piece comprising:

a base defined about an axis of symmetry of said base;

a base retainer unitary with said base extending from said base;

a mounting unitary with said base for securing said base to the aerosol container;

said base having an inner ring and an outer ring defining an annular void between said inner ring and said outer ring of said base;

a second piece comprising:

a dispensing head having a circumferential sidewall supporting a top surface;

a nozzle unitary with said dispensing head and extending outwardly from said dispensing head;

said dispensing head having a nozzle channel for communicating the aerosol valve with a terminal orifice;

a dispensing head retainer unitary with said dispensing head extending from said dispensing head cooperating with said base retainer for rotationally securing said dispensing head to said base with a lower circumferential end of said circumferential sidewall of said dispensing head disposed below a top surface of said outer ring and within said an annular void between said inner ring and said outer ring of said base said dispensing head being rotatable about said axis of symmetry of said base between a locked rotational position and an unlocked rotational position;

said dispensing head defining a dispensing head actuator surface for actuating the aerosol valve upon depression of said dispensing head actuator surface to dispense the aerosol product from said terminal orifice when said dispensing head is rotated into said unlocked rotational position;

a trigger actuator unitary with said dispensing head and extending outwardly from said dispensing head in alignment with and below said nozzle for actuating the aerosol valve upon depression of said trigger actuator for dispensing the aerosol product from said terminal orifice when said dispensing head is rotated into said unlocked rotational position;

each of said dispensing head actuator surface and said trigger actuator independently actuating the aerosol valve to dispense the aerosol product from said terminal orifice; and said dispensing head actuator surface and said trigger actuator being inhibited from actuating the aerosol valve when said dispensing head is rotated into said locked rotational position.

* * * * *